US005777251A

United States Patent [19]

Hotta et al.

[11] Patent Number: 5,777,251

[45] Date of Patent: Jul. 7, 1998

[54] ELECTRONIC MUSICAL INSTRUMENT WITH MUSICAL PERFORMANCE ASSISTING SYSTEM THAT CONTROLS PERFORMANCE PROGRESSION TIMING, TONE GENERATION AND TONE MUTING

[75] Inventors: Harumichi Hotta; Kazuhide Iwamoto; Hiroyuki Torimura; Masanobu Chihana, all of Hamamatsu, Japan

[73] Assignee: Yamaha Corporation, Hamamatsu, Japan

[21] Appl. No.: 759,745

[22] Filed: Dec. 3, 1996

[30] Foreign Application Priority Data

Dec. 7, 1995 [JP] Japan ..... 7-345718

[51] Int. Cl.[6] ..... A63H 5/00; G04B 13/00; G10H 7/00

[52] U.S. Cl. ..... 84/609; 84/613

[58] Field of Search ..... 84/609, 616, 619, 84/613, 634, 637, 743

[56] References Cited

U.S. PATENT DOCUMENTS

| | | | |
|---|---|---|---|
| 4,448,104 | 5/1984 | Hoshii . | |
| 4,633,751 | 1/1987 | Fukaya et al. . | |
| 4,974,486 | 12/1990 | Wallace | 84/609 |
| 5,085,117 | 2/1992 | Morokuma et al. . | |
| 5,247,128 | 9/1993 | Suzuki | 84/611 |
| 5,367,121 | 11/1994 | Yanase . | |
| 5,488,196 | 1/1996 | Zimmerman et al. | 84/612 |
| 5,600,082 | 2/1997 | Torimura | 84/610 |

FOREIGN PATENT DOCUMENTS

| | | |
|---|---|---|
| 54-159213 | 12/1979 | Japan . |
| 527757 | 2/1993 | Japan . |
| 6274160 | 9/1994 | Japan . |
| 7152372 | 6/1995 | Japan . |

*Primary Examiner*—William M. Shoop, Jr.
*Assistant Examiner*—Jeffrey W. Donels
*Attorney, Agent, or Firm*—Pillsbury Madison & Sutro LLP

[57] ABSTRACT

An electronic musical instrument apparatus includes a pad and fret switches. When the pad is stricken while any one of the fret switches is depressed, at least a musical tone is generated. The apparatus has different modes of performance operation including a first melody mode, a second melody mode, a base mode, a first chord mode, a second chord mode, an ad-lib mode and the like. In the first melody mode, each time the pad is operated, a note event is read out from a memory, a previous tone that has been generated is muted and, at the same time, a next tone for the note event read out is immediately generated so that a legato-like performance can be performed. If desired, a mute switch is operated to mute a previous tone that is being generated so that a staccato like performance is performed. In the second melody mode, the base mode, the first chord mode and the second chord mode, performance data for note events is successively and continuously read out from a memory. Each time the pad is operated, the apparatus generates at least a tone for a note event that is read out at a moment of operation of the pad. In the ad-lib mode, different tones for ad-lib performance are assigned to the fret switches. When the pad is operated while any of the fret switches is depressed, at least a tone having a pitch assigned to the fret switch is generated.

28 Claims, 53 Drawing Sheets

SCALE ASSIGNMENT TABLE

SCALE

FRET POSITIONS

| | DIATONIC | PENTATONIC 1 | PENTATONIC 2 | CHORD COMPOSING TONES | MELODY COMPOSING TONES |
|---|---|---|---|---|---|
| 0 | C 4 | G 3 | G 3 | E 3 | B 3 |
| 1 | D 4 | A 3 | B ♭ 3 | G 3 | C 4 |
| 2 | E 4 | C 4 | C 4 | B 3 | E 4 |
| 3 | F 4 | D 4 | E ♭ 4 | C 4 | F 4 |
| 4 | G 4 | E 4 | F 4 | E 4 | G 4 |
| : | : | : | : | : | : |
| 16 | E 6 | A 6 | B ♭ 6 | E 7 | G 6 |
| 17 | F 6 | C 7 | C 7 | G 7 | A 6 |
| 18 | G 6 | D 7 | E ♭ 7 | B 7 | B 6 |
| 19 | A 6 | E 7 | F 7 | C 8 | C 7 |
| 20 | B 6 | G 7 | G 7 | E 8 | E 7 |

FIG. 6

TONE RANGE CONTROL TABLE

FRET POSITIONS

| TONE RANGE | 0 | 1 | 2 | ... | 9 | 10 | 11 | ... | 19 | 20 |
|---|---|---|---|---|---|---|---|---|---|---|
| | E0 | F#0 | G#0 | ... | A#1 | C2 | D2 | ... | F#3 | G#3 |
| | F0 | G0 | A0 | | B1 | C#2 | D#2 | | G3 | A3 |
| | F#0 | G#0 | A#0 | | C2 | D2 | E2 | | G#3 | A#3 |
| | G0 | A0 | B0 | | C#2 | D#2 | F2 | | A3 | B3 |
| | ⋮ | ⋮ | ⋮ | | ⋮ | ⋮ | ⋮ | | ⋮ | ⋮ |
| | C#2 | D#2 | F2 | | G3 | A3 | B3 | | D#5 | F5 |
| | D2 | E2 | F#2 | | G#3 | A#3 | C4 | | E5 | F#5 |
| | D#2 | F2 | G2 | | A3 | B3 | C#4 | | F5 | G5 |
| | E2 | F#2 | G#2 | | A#3 | C4 | D4 | | F#5 | G#5 |

FIG. 10(A)

OCTAVE SHIFT RESULT

FRET POSITION

| INPUTTED TONE | 0 | 1 | 2 | ... | 9 | 10 | 11 | ... | 19 | 20 |
|---|---|---|---|---|---|---|---|---|---|---|
| C4 | C2 | C2 | C2 | ... | C2 | C4 | C4 | ... | C4 | C4 |
| C3 | C1 | C1 | C1 | | C3 | C3 | C3 | | C5 | C5 |
| C2 | C2 | C2 | C2 | | C2 | C2 | C4 | | C4 | C4 |

FIG. 10(B)

ELECTRONIC MUSICAL INSTRUMENT WITH MUSICAL PERFORMANCE ASSISTING SYSTEM THAT CONTROLS PERFORMANCE PROGRESSION TIMING, TONE GENERATION AND TONE MUTING

BACKGROUND OF THE INVENTION

1. Field of the Invention

The present invention relates to electronic musical instruments and electronic musical apparatus that perform melody parts and accompaniment parts by relatively simple operations.

2. Description of Related Art

There are various types of electronic musical instruments, such as, for example, a keyboard musical instrument, a percussion instrument, a string musical instrument, a wind instrument and the like. Each of the electronic musical instruments is a copy of its respective natural musical instrument. In order to play an electronic musical instrument, a player needs to master a performance method for the electronic musical instrument. It is therefore difficult for a beginner player to play an electronic musical instrument, much as it is for the beginner player learning the corresponding natural musical instrument.

In this respect, a one-key play system has been proposed to facilitate the performance of an electronic musical instrument that typically stores a sequence of melody note data of a music piece or the like. In the one-key play system, each of the note data is read out at each switch operation to perform the melody. For example, Japanese laid-open patent application HEI 6-274160 describes a system in which a tone of one note is generated in response to a trigger signal provided by a keyboard of a musical instrument. More specifically, note data for a piece of music, that is stored in a memory, is successively read out with progression of performance of the piece of music. Generation of a tone corresponding to note data that has been read out is started in response to a trigger signal generated upon operation of the keyboard, and the tone is muted at a specified key-off timing of the note data. Japanese laid-open patent application SHO 54-159213 describes a system in which note data stored in a memory is read out and a tone corresponding to the note data is generated at each operation of a switch, the tone continuing as long as the switch is depressed.

In the former system, the tone generation period is terminated at the key-off timing of the note data. Accordingly, a player cannot control the duration of tone generation. In the later system, because the duration of tone generation corresponds to a period in which the switch is depressed, the duration of tone generation can be controlled by a player. However, when shifting from one note to the next note, the switch needs to be turned off and thereafter depressed again to generate a tone of a next note. As a result, the tone generation is normally stopped between the two adjacent notes, and thus playing notes with a touch of tenuto is difficult.

Further, with the above musical instruments, once a current musical performance diverges from an original musical performance, it is very difficult to bring back the current musical performance to the progression position of the original musical performance. More specifically, when the musical performance by a player is advanced with respect to the original musical performance, the player must stop the musical performance and wait until the original musical performance catches up. Furthermore, while the player is waiting, he may lose track of the position where he stopped the musical performance, with the result that he is at a loss to know where he should re-start the musical performance. On the other hand, when the musical performance is delayed with respect to the original musical performance, the player may operate relevant switches to readjust the musical performance to the timing of the original musical performance. However, while the player is trying to advance his own musical performance, the player's rhythm of the musical performance may diverge from the rhythm of the original musical performance, with the result that the player may lose track of the position of the musical performance where he is performing.

Moreover, with the above musical instruments, since a musical performance can be performed only in accordance with a predetermined sequence of notes, an ad-lib performance cannot be performed.

SUMMARY OF THE INVENTION

It is an object of the present invention to provide an electronic musical instrument that realizes a musical performance that is rich in expression with relatively simple operations.

In accordance with a first embodiment of the present invention, an electronic musical instrument comprises a first operation member, a second operation member, and a memory device that stores performance data for a piece of music. A reading device reads out the performance data from the memory device in response to operation of the first operation member and directs a sound source circuit to generate a tone based on the performance data. Upon each operation of the first operation member, the reading device renews a position of performance and mutes a tone that has been generated. The electronic musical instrument further comprises a mute directing device that directs the sound source circuit to mute the tone currently being generated in response to operation of the second operation member.

In accordance with the first embodiment, upon each operation of the first operation member, the performance data is read out from the memory device and a new tone corresponding to the performance data is generated, and at the same time, a tone being currently generated is stopped. Accordingly, a legato performance is performed only by operating the first operation member. The second operation member may be operated, as required, to stop a tone being currently generated, with the result that a staccato performance can be performed.

In accordance with a second embodiment of the present invention, an electronic musical instrument comprises a first operation member, a second operation member and a memory device that stores performance data for a piece of music. Furthermore, a reading device successively reads out the performance data from the memory device with progression of the performance. A tone generation directing device directs, in response to operation of the first operation member, a sound source circuit to generate a tone based on the performance data that is read out from the memory device and directs the sound source circuit to mute a tone that has been generated. A mute directing device directs the sound source circuit to mute the tone in response to operation of the second operation member.

In accordance with the second embodiment, at each time the first operation member is operated, a tone is generated base on the performance data that has been read out from the memory device, and at the same time, a tone that has so far been generated is muted. Accordingly, a legato performance can be performed only by operating the first operation member. The second operation member may be operated, as required, to stop a tone being currently generated, with the result that a staccato performance can be performed. Moreover, since the performance position is successively renewed even without operating the first operating member, a player can operate the first operation member without paying too much attention to the performance position.

In accordance with a third embodiment of the present invention, an electronic musical instrument comprises a first operation member, a second operation member, a memory device that stores first performance data and second performance data for performance of a piece of music. Further, the electronic musical instrument includes a first reading device and a second reading device. The first reading device reads out, in response to operation of the first operation member, the first performance data from the memory device and directs a sound source circuit to generate a tone based on the first performance data. The first reading device directs the sound source circuit, at each operation of the first operation member, to renew a position of the performance. The second reading device successively reads out the second performance data from the memory device and directs the sound source circuit to generate a tone based on the second performance data. The electronic musical instrument further includes a switching device that selectively makes effective the tone based on the first performance data read out by the first reading device or the tone based on the second performance data read out by the second reading device. When tone generation by the first reading device is made operationally effective and the second operation member is operated, the switching device makes effective the tone generation by the second reading device instead of the tone generation by the first reading device.

In accordance with the third embodiment of the present invention, when the player loses track of the position where he is performing through operating the first operation member, the player may operate the second operation member to start an automatic performance instead of the performance by the player. As a result, when the position of the player's performance diverges from the current position of progression of an original performance, the player can readily confirm the position of progression of the original performance.

In a preferred embodiment, the switching device effects tone generation by the first reading device instead of tone generation by the second reading device when the first operation member is operated while tone generation by the second reading device is effective. By this arrangement, the player can easily return from the automatic performance to his own performance.

In accordance with a fourth embodiment of the present invention, an electronic musical instrument comprises a first operation member, a second operation member and a memory device that stores performance data for performance of a piece of music. The electronic musical instrument further includes a reading device that successively reads out the performance data from the memory device with progression of the performance of the piece of music and a note pitch changing device that changes pitch of the performance data read out by the reading device in response to operation of the second operation member. Further, the electronic musical instrument includes a tone generation directing device that directs, in response to operation of the first operation member, a sound source circuit to generate a tone based on the performance data that is read out from the memory device and has the pitch changed by the note pitch changing device.

In accordance with the fourth embodiment of the present invention, a musical tone having a note pitch changed by the operation of the second operation member is generated in response to the operation of the first operation member. Accordingly, the player can more freely control musical notes as he desires, compared with musical tones that are generated based solely on the performance data stored in the memory device.

In accordance with a fifth embodiment of the present invention, an electronic musical instrument comprises a first operation member having a plurality of operating sections, a second operation member and a memory device that stores performance data for performance of a piece of music. The electronic musical instrument further includes an assigning device that determines a scale appropriate to a key or a chord progression of the performance data and assigns scale tones of the scale to the plurality of operating sections of the first operation member. A tone generation directing device directs, in response to operation of the second operation member, a sound source circuit to generate at least one of the tones assigned to the operating sections of the first operating member that is operated.

In accordance with the fifth embodiment of the present invention, tones having note pitches assigned to the operating sections of the first operating member are generated by the operation of the second operation member. Since the note pitches to be generated match the key or the chord progression of the piece of music, it is relatively easy to play an ad-lib performance that matches the piece of music.

Also, in a preferred embodiment, the assigning device determines a plurality of scales appropriate to a key or a chord progression of the performance data. Scale tone of one of the scales selected is assigned to the plurality of operating sections of the first operation member. As a result, the musical atmosphere of an ad-lib performance can be changed.

In accordance with a sixth embodiment of the present invention, an electronic musical instrument comprises a first operation member having a plurality of operating positions, a second operation member and a memory device that stores performance data for performance of a piece of music. The electronic musical instrument further includes an assigning device that calculates how frequently each note included in the performance data appears, determines a plurality of notes appearing at higher frequencies as scale notes for the performance and assigns the scale notes to the plurality of operating positions of the first operation member. When the second operation member is operated while one of the operating positions of the first operating member is operated, a tone generation directing device directs a sound source circuit to generate at least one tone based on a scale note assigned to the operated one of the operating positions of the first operating member.

In accordance with the above-described sixth embodiment, notes included in a piece of music that appear at higher frequencies are determined as scale notes for the performance of the piece of music. As a result, without having to use a complicated key detection algorithm, an ad-lib performance can be played, using tones that match the piece of music.

In accordance with a seventh embodiment of the present invention, an electronic musical instrument comprises a first operation member having a plurality of operating positions, a second operation member, a memory device that stores performance data for performance of a piece of music and a reading device that successively reads out the performance data from the memory device with progression of the performance.

The electronic musical instrument further comprises an assigning device that, when the second operation member is operated, detects a plurality of notes included in the performance data read out from the reading device, determines the detected plurality of notes as chord composing notes that form a chord and assigns the determined chord composing notes to the plurality of positions of the first operation member. A tone generation directing device directs, in response to operation of the second operation member and one of the operation positions of the first operating member, a sound source circuit to generate at least a tone based on a note assigned to the operated one of the operating positions of the first operating member.

In accordance with the seventh embodiment of the present invention, when the second operation member is operated, a plurality of notes that have been read out by the reading device are determined as chord composing notes at the time when the second operation member is operated. Without having to use a complicated chord detection algorithm, an ad-lib performance can be played, using tones that match the piece of music.

In accordance with an eighth embodiment of the present invention, an electronic musical instrument comprises a first operation member having a plurality of operating positions, a second operation member, a memory device that stores performance data for performance of a piece of music and a reading device that successively reads out the performance data from the memory device. The electronic musical instrument includes a scale determining device that calculates a frequency of appearance of each note included in the performance data and determines a plurality of notes appearing at higher frequencies as scale composing notes that form a scale for the performance. The electronic musical instrument further includes an assigning device that, when the second operation member is operated, detects a plurality of notes included in the performance data read out from the reading device, determines the detected plurality of notes as chord composing notes that form a chord and assigns the determined chord composing notes to the plurality of positions of the first operation member. When the number of the detected plurality of notes does not reach a specified number, appropriate notes are selected from the determined scale composing notes and added to the chord composing notes to reach the specified number. A tone generation directing device directs, in response to operation of the first operation member, a sound source circuit to generate at least a tone based on a note pitch assigned to each of the operating positions of the first operating member that is operated.

In accordance with the eighth embodiment of the present invention, when the second operation member is operated, a plurality of notes that have been read out by the reading device are determined as chord composing notes at the current time. If the number of a plurality of the detected notes does not reach a predetermined number, appropriate notes that are present in the piece of music and appear at higher frequencies are added to the detected notes to determine a set of full chord composing notes. As a result, notes other than the chord composing notes may be generated in an ad-lib performance so that the ad-lib performance does not sound monotonous.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

FIG. 6 is a scale assignment table in accordance with an embodiment of the present invention.

FIG. 10 (A) is a tone range control table in accordance with an embodiment of the present invention FIG. 10 (B) is a table showing various octaves controlled by the tone range control table of FIG. 10 (A) in accordance with an embodiment of the present invention.

DETAILED DESCRIPTION OF EMBODIMENTS

The present invention is hereafter described with reference to the accompanying drawings.

Figure 1:
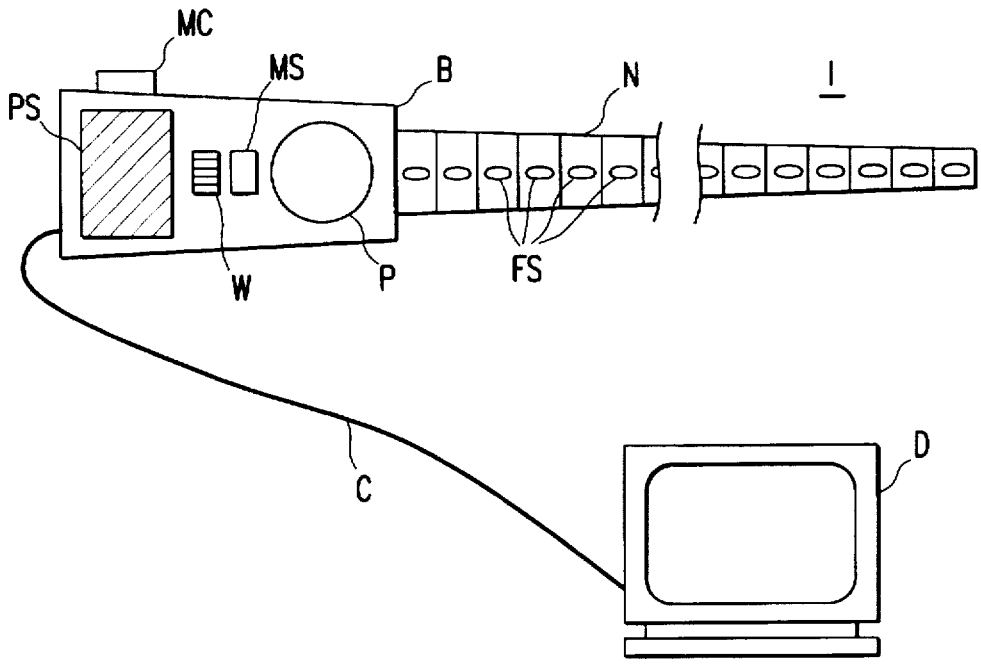
FIG. 1 schematically shows a front view of an exterior of an electronic musical instrument in accordance with an embodiment of the present invention.

FIG. 1 shows an exterior view of an electronic musical instrument in accordance with the present invention. The electronic musical instrument has a musical instrument body I and a separate monitor apparatus D that are connected to each other by a cable C. The musical instrument body I has a shape similar to a guitar, and is formed from a body portion B and a neck portion N. The body portion B is provided with a pad P, a mute switch MS, a wheel W, a panel switch PS, and a memory cartridge MC that is removably mounted to the body portion B.

The pad P has a percussion sensor (for example, a piezoelectric sensor or the like) for detecting the presence or absence of the player's fingers striking the pad and the striking force of the fingers. In response to a strike by the finger, a musical tone is generated. The pad P can be rotated in a circumferential direction of the pad P and has a rotary sensor (a rotary volume and the like) for detecting the rotating operation of the pad P performed by the player. By rotating the pad P, note pitches of tones to be generated can be changed. The pad P is designed so that after it is rotated and released by the player, it returns to its original position. Further, the pad P has an internally mounted pressure sensor for detecting pressure applied to the pad by the player. By the application of various pressures to the pad P, loudness and tone color of tones to be generated, sound effects of tones, and the like are changed.

The mute switch MS operates to mute a musical tone that is generated by the operation of the pad P. Namely, the musical tone that is generated by the operation of the pad P continues until the mute switch MS is depressed. The mute switch MS has a depression speed detection sensor that controls the manner of muting a musical tone, depending upon the depression speed. For example, the mute switch MS changes the manner of controlling the release time of the muting operation. If the pad P is depressed before the mute switch MS is depressed, a tone that has been generated is muted, and a new tone is uninterruptedly generated right after the muted tone.

In addition to the tone muting function that mutes a tone being generated, the mute switch MS has a function that changes and controls a tone color of a tone that is to be newly generated. Namely, when the pad P is operated while the mute switch MS is being depressed, the mute switch MS is designed to generate a tone having a tone color different from a tone color that is generated when the pad P is operated without depressing the mute switch MS. For example, when the pad P is operated without depressing the mute switch MS, a tone color of an ordinary guitar is generated. On the other hand, when the pad P is operated while the mute switch MS is being depressed, a tone color of a mute guitar is generated. In an alternative embodiment, the mute switch MS is provided with a depression force detection sensor for detecting a depression force. By this arrangement, filter parameters of a sound source circuit are controlled in response to the degree of the detected depression force of the mute switch MS when the pad P is operated while the mute switch is being depressed. In this manner, a tone color of a tone to be generated is changed depending upon whether the mute switch MS is operated. This provides effects similar to playing the guitar in two different ways that generate different tone colors, namely, picking the strings of the guitar with and without the strings being pressed by the palm of the player's hand. Accordingly, a musical performance that is richer in expression can be realized by a relatively simple operation. It should be noted that the tone color is not limited to that of the guitar, and other tone colors of a variety of musical instruments may be employed in the same manner.

The wheel W is constructed so that the player can rotate it. The wheel W has a rotary sensor that detects the magnitude of its rotation. The rotary sensor may be formed from a rotary volume controller and the like to change the loudness, tone color or tone effect as the player rotates the wheel W.

The memory cartridge MC is formed from a ROM cartridge or a RAM cartridge that stores music data for a plurality of pieces of music. Each of the music data consists of a plurality of performance parts, such as a melody part, a base part, a chord part, a rhythm part and the like. In the electronic musical instrument in accordance with an embodiment of the present invention, one of the plurality of performance parts is operated by the operation of the pad P, and the other parts are automatically performed based on the stored music data.

The body B includes a loud speaker and MIDI terminals (not shown), and the neck portion N has a plurality of fret switches FS arranged in a line along the neck portion N. In an embodiment, 20 fret switches are provided along the neck portion N. The pitch of a musical tone, that is generated as the pad P is struck, is controlled depending upon the position of a fret switch FS that is depressed. A pressure sensor is provided under each of the fret switches FS so that a pressure force applied at each fret switch SF is detected as the fret switch FS is depressed. The loudness, tone color or tone effect of a tone to be generated may be changed by pressing the fret switches FS.

The monitor apparatus D is formed from a CRT monitor, liquid crystal display or the like for displaying a position of progression of musical performance and the like. In an alternative embodiment, the monitor apparatus D may be installed on the musical instrument body 1.

Figure 2:
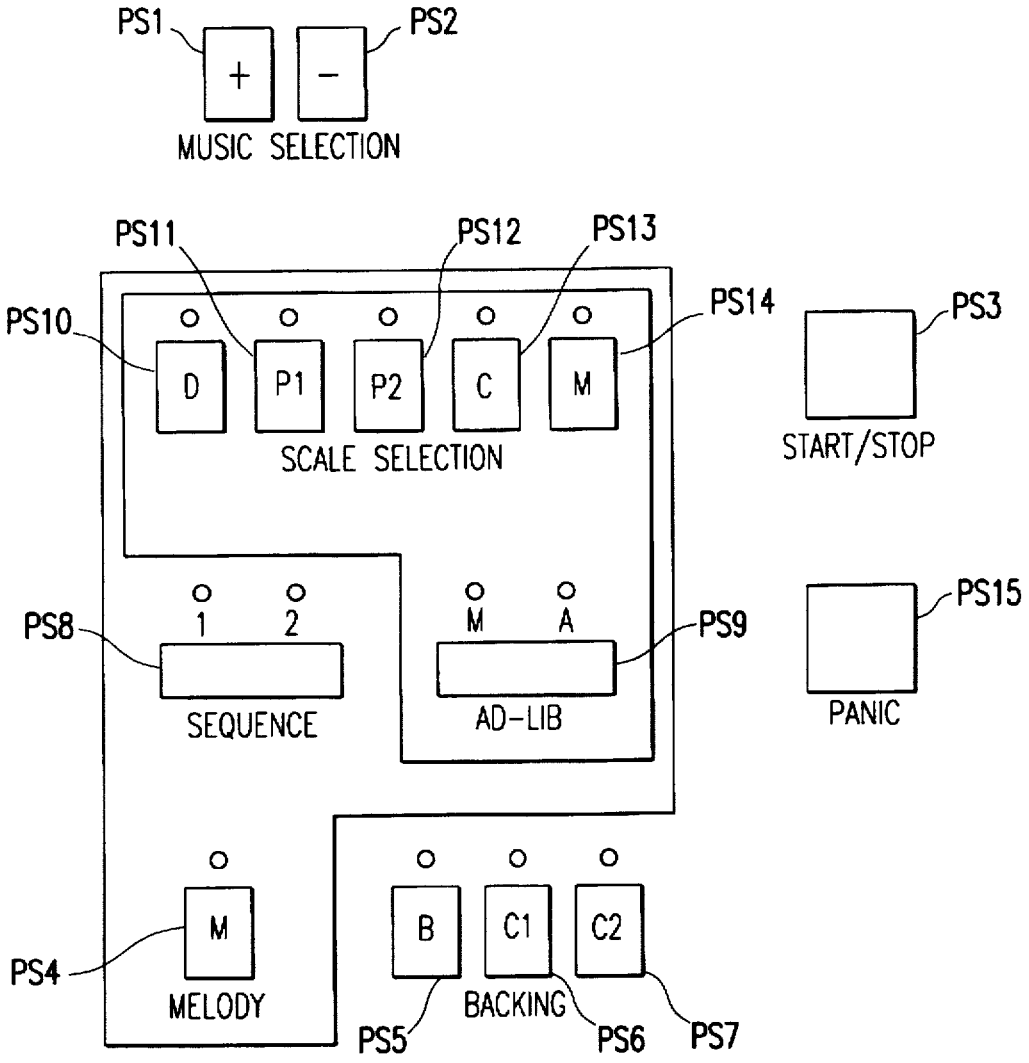
FIG. 2 shows a front view of a panel switch in detail in accordance with an embodiment of the present invention.

FIG. 2 shows the panel switch PS in detail. Characters PS1 and PS2 designate music selection switches + and −, respectively, that select one of the plurality of music data that is stored in the memory cartridge MC. With the music selection switch PS1, numbers assigned to the respective performance parts are increased, namely, shifted in (+) direction. With the music selection switch PS2, the number are decreased, namely, shifted in (−) direction. A selected one of the numbers is displayed on the monitor apparatus D.

Character PS3 designates a start/stop switch for starting or stopping a performance of the selected music data.

Characters PS4 through PS7 designate controlling part selection switches, respectively. The controlling part selection switch PS4 is adapted to select a melody part of a piece of music, the switch PS5 is adapted to select a base part of the piece of music, the switch PS6 is adapted to select a first chord part of the piece of music and the switch PS7 is adapted to select a second chord part. It is noted that the base part, the first chord part and the second chord part are defined as a backing part that is generally distinguished from the melody part. One of the parts is selected by one of the controlling part selection switches PS4 through PS7, and the selected part is performed by the operation of the pad P.

Characters PS8 and PS9 designate selection switches, respectively, for selecting a melody part performance mode when the melody part is selected as a part to be controlled. The selection switch PS8 is adapted to select one of sequence modes for a performance that is carried out based on a melody sequence data in the music data stored in the memory cartridge MC. The selection switch PS9 is adapted to select one of ad-lib modes to perform an ad-lib performance, that is different from the melody sequence representative of the melody sequence data in the music data.

The selection switch PS8 selectively and alternately sets one of the sequence modes, a first melody mode or a second melody mode. In the first melody mode, the melody part is advanced by one sequence and a tone of the melody part is generated each time the pad P is operated. Therefore, if the operation of the pad P is delayed, the melody part is delayed with respect to the parts other than the melody part. On the other hand, if the operation of the pad P is advanced, the melody part is advanced with respect to the parts other than the melody part. Therefore, in the first melody part, while no melody tone is missed, once the position of progression of the melody part diverges from the position of progression of the other parts, it is difficult to match the position of progression of the melody part with the position of progression of the other parts.

On the other hand, in the second melody mode, the sequence for the melody part is advanced with the progression of the other parts regardless of the operation of the pad P. In the second melody mode, the melody part is advanced regardless of the operation of the pad P, and a tone of the melody part is generated at the current time of progression of the melody part upon operation of the pad P. In other words, the melody part is advanced without tones of the melody part being generated unless the pad P is operated. As a result, tones of the melody part may be lost if the pad P is not operated. However, the position of progression of the melody part and the position of progression of the other parts always coincide with each other. Accordingly, the second melody mode is more suitable for a beginner player than the first melody mode.

The selection switch PS9 selectively and alternately sets one of the ad-lib modes, namely, a manual ad-lib mode and an automatic ad-lib mode. In the manual ad-lib mode, tones of a scale that match the key of a selected one of the music data are assigned to a corresponding plurality of the fret switches. In the manual ad-lib mode, an ad-lib performance of the melody part is performed by designating tone pitches by the fret switches FS and operating the pad P. The scale to be assigned to the fret switches FS can be selected by scale selection switches PS10 through PS14, which are described later. Since a scale to be assigned to the fret switches FS matches the key of the piece of music representative of the music data that is read out, an ad-lib performance that matches the key of the piece of music is readily performed simply by pressing appropriate ones of the fret switches FS and operating the pad P.

On the other hand, in the automatic ad-lib mode, a specified ad-lib phrase is assigned to each of the plurality of the fret switches FS. When an appropriate one of the fret switches FS and the pad P are operated, an ad-lib performance of a specified ad-lib phrase that is assigned to the operated fret switch FS is performed. Since an ad-lib phrase that matches the key of the piece of music is assigned to the fret switch FS, an ad-lib performance that matches the key of the piece of music is readily performed simply by pressing the fret switch FS and operating the pad P. In the above-mentioned manual ad-lib mode, a tone having the same pitch is generated while each of the fret switches FS is being depressed. Therefore, to play an ad-lib, different ones of the fret switches FS must be rapidly depressed in a similar manner as when an ordinary guitar is played. On the other hand, in the automatic ad-lib mode, tones having different pitches are successively generated while the same fret switch FS is being depressed. Therefore, the automatic ad-lib mode is more suitable for a beginner player than the manual ad-lib mode.

Characters PS10 through PS14 designate scale selection switches, respectively. A scale type to be assigned to the fret switches FS is selected by operation of the scale selection switches PS10 through PS14. By operating the scale selection switch PS10, a diatonic scale that matches the key of the music data is assigned to the fret switches FS. In this embodiment, the key of the music data is determined based on the sequence data of the piece of music. However, in alternative embodiments, an arrangement may be made so that the player can designate a specified key, or data for designating a key may be embedded in the music data.

The scale selection switch PS11 is adapted to select a first pentatonic scale. By operating the switch PS11, the first pentatonic scale that matches the key of the music data is assigned to the fret switches FS. The scale selection switch PS12 is adapted to select a second pentatonic scale. By operating the switch PS12, the second pentatonic scale that matches the key of the music data is assigned to the fret switches FS. Although the first pentatonic scale and the second pentatonic scale are based on the same key, each of them is formed from a different set of five tones. Therefore, although they are similarly called a pentatonic scale, a musical performance has a different musical atmosphere as the scale is changed from one to the other. For example, the fourth note and the seventh note are removed from the diatonic scale to form the first pentatonic scale, and a blues scale accompanied by blue notes may be assigned as the second pentatonic scale. Other appropriate scales may also be selected.

The selection switch PS13 is a chord composing tone selection switch. By operating the switch PS13, tones in the music data that compose a chord (chord composing tones) are assigned to the fret switches FS. Chords are changed as the performance of the piece of music advances. With the change of the chords, the chord composing tones assigned to the fret switches are changed. Namely, when a chord is changed from one to the other, chord composing tones to be assigned to the fret switches FS are renewed. In this embodiment, chords for the music data are detected based on the sequence data of the music data. In alternative embodiments, an arrangement may be made so that a player can designate a specified chord progression, or data designating a specified chord progression may be embedded in the music data. When one of the above-described diatonic scale, the first pentatonic scale and the second pentatonic scale is selected, tones that match the key of the piece of music but do not match the current chord may possibly be generated. On the other hand, when chord composing tones are assigned to the fret switches FS by the operation of the chord composing tone selection switch PS13, tones that match a current chord are generated and tones that do not match the current chord are not generated. However, it is noted that an ad-lib performance may become monotonous since there are a relatively small number of tonal pitches to be assigned to the fret switches FS.

The selection switch PS14 is a melody composing tone selection switch. By operating the switch PS1 4, tones that appear in the melody part of the music data are assigned to the fret switches FS. The music data is divided into a plurality of phrases, and tonal pitches that appear in each of the phrases are assigned to the fret switches FS. In the present embodiment, the music data is divided into a plurality of phrases, relying on line-change codes (placed at phrase cut positions) in song lyric data that is included in the music data. However, in alternative embodiments, an arrangement may be made so that a player can designate phrase cut positions, or the chord progression or the melody progression of the music data is analyzed to detect phrase cut positions. When melody composing tones are assigned to the fret switches FS, tones that match a chord at the current time are generated and tones that do not match a chord at the current time are not generated, as similarly described above with respect to the chord composing tones. However, an ad-lib performance with the melody composing notes would likely become monotonous. It is noted that the melody composing tones would effect an ad-lib performance that sounds more like the melody part when compared to an ad-lib performance performed with the chord composing tones.

The selection switch PS15 is a panic switch. The panic switch PS15 is used when the melody sequence is performed in the first melody mode. When the operation of the pad P by the player is slower or faster compared with the other parts, a current progression position of the melody part may substantially diverge with respect to an original progression position of the other parts. In such a circumstance, the panic switch PS15 is used to correct the current progression position of the melody part to match the original progression position of the other parts. By pressing the panic switch PS15, the melody sequence mode is released, the melody part that has been played by the player returns to the original progression position and the melody part is automatically performed in a manner similar to the other parts. Thereafter, when the pad P is operated again, the melody sequence mode is restarted. This function is useful when a player does not know the melody of the piece of music very well or loses track of where he is playing in the piece of music, or if he panics.

Figure 3A:
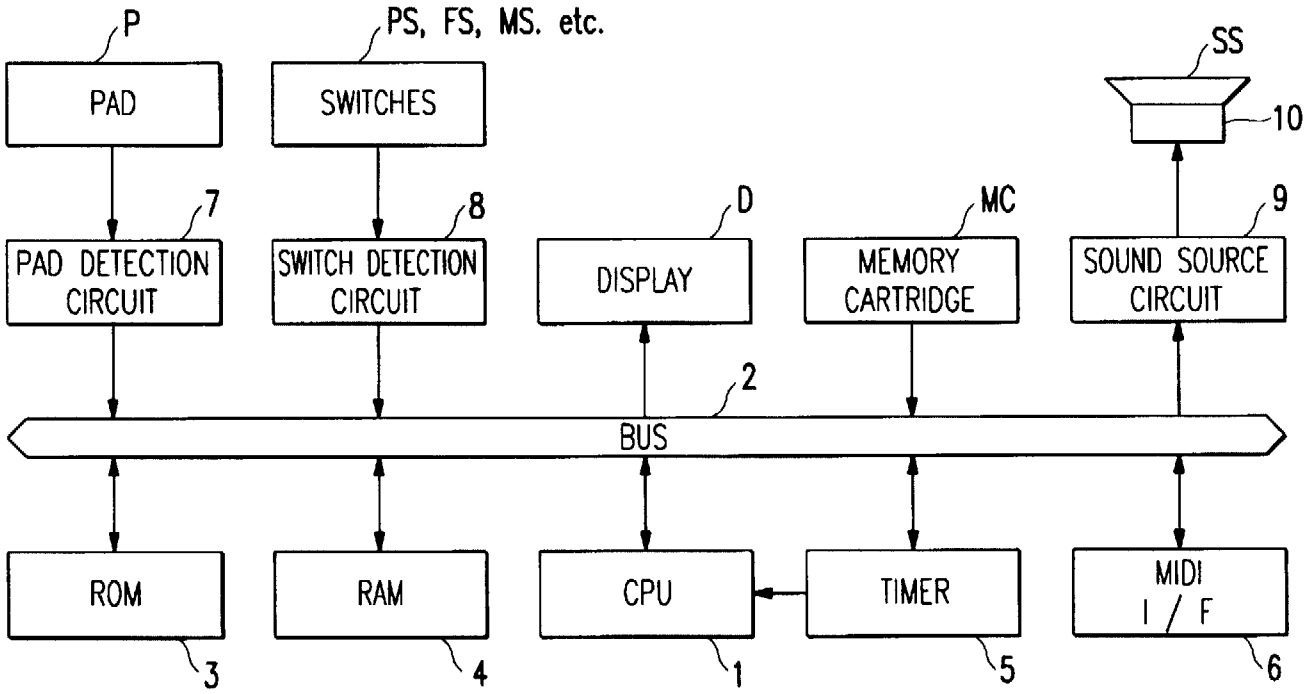
FIG. 3A is a block diagram of hardware components of an electronic musical instrument in accordance with an embodiment of the present invention.

FIG. 3A shows a block diagram of a hardware structure of an electronic musical instrument in accordance with an embodiment of the present invention. A CPU (central processing unit) 1 controls the operation of the electronic musical instrument, and executes processes according to control programs stored in a ROM (read only memory) 3. The CPU connects to various sections via a bus 2, and various data is transmitted through the bus 2.

A RAM (random access memory) 4 has memory regions, such as register regions, flag regions, and the like for temporarily storing a variety of data that is generated when the CPU 1 executes various processes. The RAM 4 also has memory regions for storing controlled part data and melody part data (which will be described below in detail) that are used when performing a melody part or a background part. A timer 5 supplies interrupt signals to the CPU 1, and generates interrupt signals at a predetermined cycle. Sequence data stored in the memory cartridge MC or controlled part data stored in the RAM 4 are read out by an interrupt process that is executed by the CPU at a specified cycle.

A musical instrument digital interface (MIDI I/F) 6 of FIG. 3A performs data transfer to and data reception from an external apparatus. For example, a performance event may be outputted through the MIDI I/F 6 to an external sound source module to perform the event with higher quality sound. A pad detection circuit 7 detects operation of the pad P. The pad detection circuit 7 detects the presence or the absence of operation of the pad P and also detects the striking force that is generated when the pad P is operated. A switch detection circuit 8 detects an on/off operation of the panel switch PS, the fret switch FS and the mute switch MS. The switch detection circuit 8 also detects a rotating operation of the wheel W, a rotating operation and a depressing operation of the pad P, a depressing operation of the mute switch MS and a depressing operation of the fret switch FS. The CPU 1 executes a variety of functions according to operation data supplied by the switch detection circuit 8.

A sound source circuit 9 forms a musical sound waveform signal based on supplied performance event data. In a preferred embodiment, the sound source circuit 9 is composed of a waveform memory read out and a filter system. In alternative embodiments, the sound source circuit 9 may be composed of a known frequency modulation (FM) system, a physical model simulation system, a harmonic synthesis system, a formant synthesis system, or an analog synthesizer system which is a combination of oscillators and filters. A musical sound waveform signal formed by the sound source circuit 9 is converted into appropriate sound by a sound system 10. Embodiments of the present invention are not limited to the sound source circuit that is composed of dedicated hardware, but the sound source may also be composed of a digital signal processor (DSP) plus micro programs, or a CPU and software programs. Also, a single circuit may be used on a time-division basis to form a plurality of sound generation channels, or one sound generation channel may be formed by one circuit.

The character D of FIG. 3A designates a display apparatus.

Figure 3B:
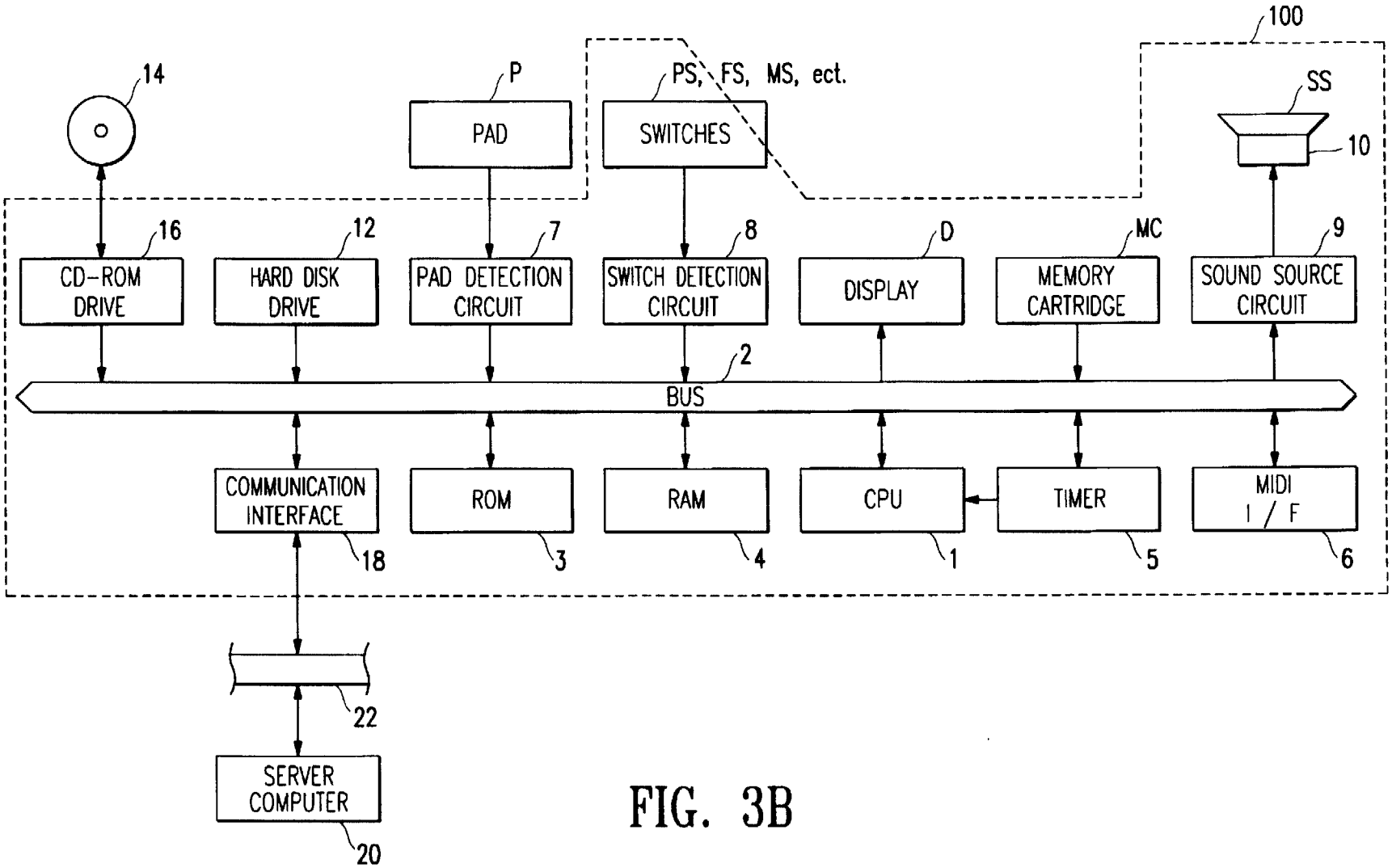
FIG. 3B is a block diagram of hardware components of an electronic musical apparatus in accordance with an embodiment of the present invention.

In the above embodiment, the present invention is implemented in electronic musical instruments. However, the present invention is not limited to electronic musical instruments. For example, FIG. 3B shows another embodiment of the present invention in which the functions and effects similar to those of the above-described embodiment shown in FIGS. 1–3A are achieved by an electronic musical apparatus. In the embodiment shown in FIG. 3B, the same components are denoted by the same reference numerals as those of the embodiment shown in FIG. 3A.

A typical electronic musical apparatus is formed from a computer apparatus, such as, for example, a personal computer, a game-computer and the like, and performance operation devices connected to the computer apparatus. In one embodiment, a variety of performance operation devices, such as, for example, a fret switch device FS, a pad device P, a mute switch device MS and the like may be connected to a personal computer 100 to achieve the functions described herein. In this case, a panel switch PS, a display apparatus D, and other performance controlling sections encircled by a broken line shown in FIG. 3B are implemented by the personal computer 100. In an alternative embodiment, the performance operation devices including the fret switch device F, the pad device P and the mute switch device MS may be implemented by appropriate keys of the keyboard (not shown) of the personal computer 100.

In the apparatus shown in FIG. 3B, storage devices such as ROM 3, RAM 4 and a hard disk 12 store various data such as waveform data and various programs including the system control program, the waveform reading or generating program and other application programs. Normally, the ROM 3 provisionally stores these programs. However, if not, any program may be loaded into the computer apparatus. The loaded program is transferred to the RAM 4 to enable the CPU 1 to perform a variety of processes. It is noted that the programs stored, for example, in the hard disk 12 and the RAM 4 are rewritable, therefore, new or up-graded programs can be readily installed in the system. For this purpose, a machine-readable media such as a CD-ROM (compact disk read only memory) 14 is utilized to install the programs. The CD-ROM 14 is set in a CD-ROM drive 16 to read out and download programs from the CD-ROM 14 into the RAM 4 or the hard disk 12 through the bus 2. Besides the CD-ROM 14, other machine-readable media, such as, for example, a magnetic disk, an optical disk and the like may be utilized.

In one embodiment, a communication interface 18 is connected to an external server computer 20 through a communication network 22 such as LAN (local area network), public telephone network and the Internet. If the internal storage does not stores needed data or program, the communication interface 18 is activated to receive the data or program from the server computer 20. The CPU I transmits a request to the server computer 20 through the communication interface 18 and the network 22. In response to the request, the server computer 20 transmits the requested data or program to the apparatus. The transmitted data or program is stored in the storage media such as the hard disk 12 and the RAM 4.

Figures 4A, 4B:
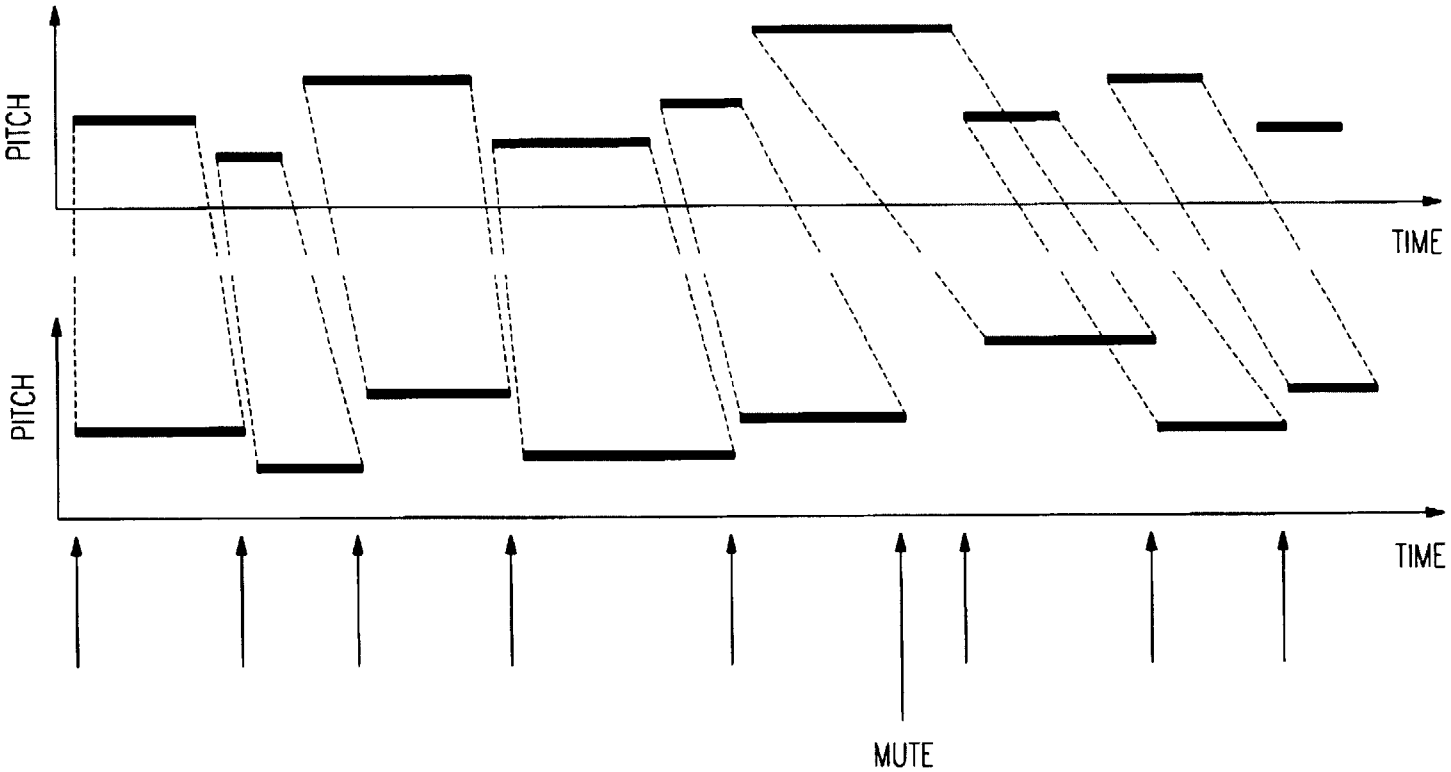
FIG. 4 shows a performance pattern in a sequence mode in a first melody mode in accordance with an embodiment of the present invention.

FIG. 4 shows a performance in the first melody mode of the sequence mode in accordance with an embodiment of the present invention. FIG. 4(A) shows tones representative of original melody data that is stored in the sequence data, and FIG. 4 (B) shows tones that are generated when the player operates the pad P at timings indicated by upwardly pointing arrows. Periods of sound generation are indicated by thick, solid horizontal lines. In this embodiment, the player's operation of the pad P is somewhat delayed with respect to the timing of the original performance of the melody. In FIG. 4, an arrow marked by "Mute" indicates a moment the mute switch MS of FIG. 1 is operated. At this moment, sound being generated is muted, with the result that a staccato performance can be achieved. In portions other than this moment, the operation of the pad P mutes a tone that has been generated; and at the same time, generation of a new tone is uninterruptedly started, with the result that a legato performance is achieved.

Figures 5A, 5B:
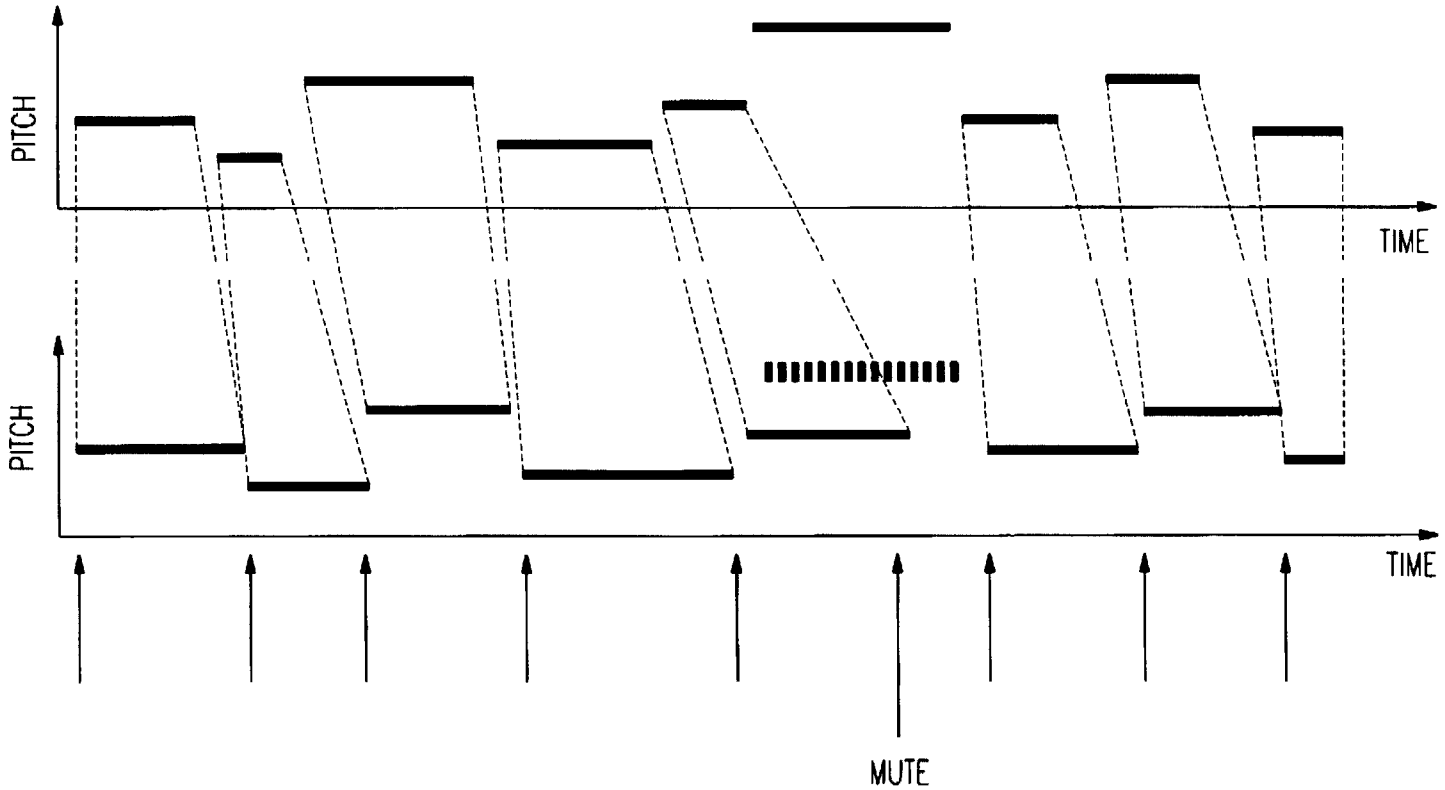
FIG. 5 shows a performance pattern in a sequence mode in a second melody mode in accordance with an embodiment of the present invention.

FIG. 5 shows a performance of the second melody mode of the sequence mode in accordance with an embodiment of the present invention. FIG. 5(A) shows tones representative of original melody data that is stored in the sequence data, and FIG. 5 (B) shows tones that are generated when the player operates the pad P at the same timings shown in FIG. 4(B). In this embodiment, the player's operation of the pad P is somewhat delayed with respect to the timing of the original performance of the melody. In particular, a tone that is indicated by "L" is not generated because the pad P is not operated during a specified period for generating the tone. In FIG. 5, an arrow marked by "Mute" indicates a moment the mute switch MS of FIG. 1 is operated. As a result, a tone being generated is muted at that timing, in a similar manner as described above with reference to FIG. 4.

A scale assignment table of FIG. 6 contains a plurality of scales that are assigned to the fret switches FS when an ad-lib performance is played. The scale assignment table is stored in the RAM 4. In this embodiment, the table contains tones assigned to a total of 21 fret switch positions composed of an open fret switch position (0) and twenty fret switch positions 1–20. A scale for "Diatonic", "Pentatonic 1" or "Pentatonic 2" is determined by a key of a piece of music that is performed. A scale for "Chord Composing Notes" is determined based on a chord appearing during the musical performance. A scale for "Melody Composing Notes" is determined based on melody tones appearing during the musical performance. The determined scale tones are stored in the scale assignment table.

The "Diatonic", "Pentatonic 1" are "Pentatonic 2" are not modified during the performance of a piece of music. In other words, the contents of the table do not change from the start to the end of the musical performance. It should be noted that the contents of the table may be changed if a piece of music have modulations. On the other hand, the stored contents of "Chord Composing Note" and "Melody Composing Notes" are successively changed as the musical performance advances because chords and melody tones of the piece of music change during the musical performance. For example, the contents of the "Chord Composing Notes" in the table may be renewed at locations where the chords are changed, and the contents of the "Melody Composing Notes" may be renewed at each position where a specified phrase is cut. In an embodiment, the specified phrase is determined by a cut position in a song lyric, which is described below. However, in alternative embodiments, the phrase cut position may be determined by analyzing the structure of the melody part and the other performance parts. It should be noted that the illustrated scale assignment table is merely one embodiment of the present invention.

Figure 7:
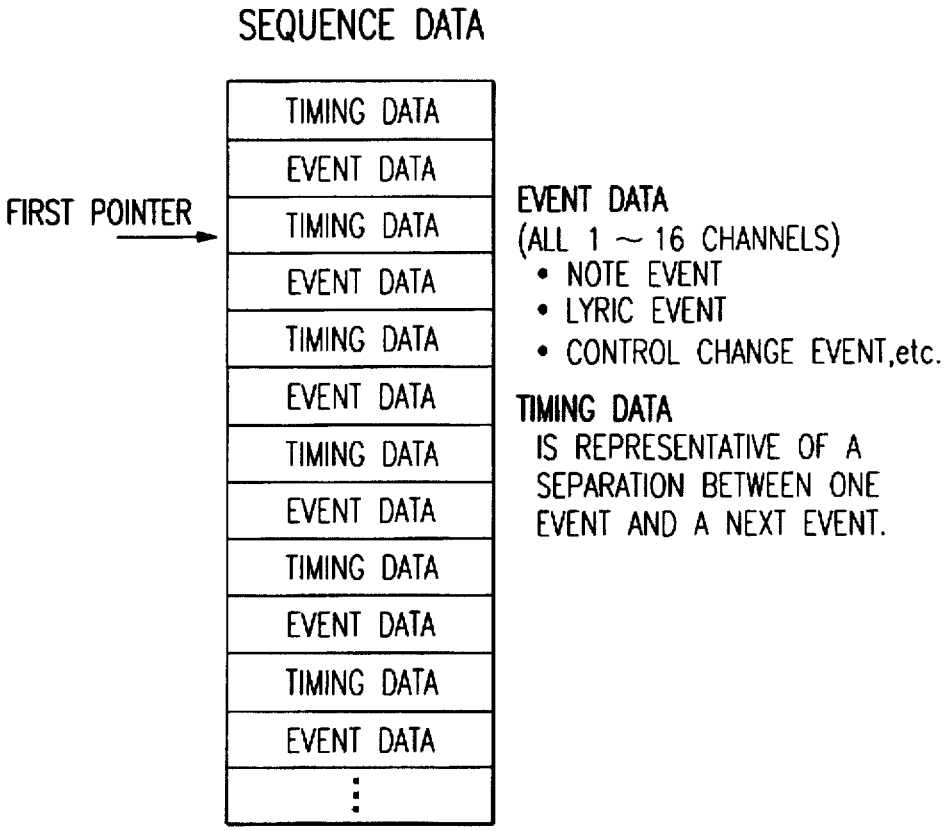
FIG. 7 shows a configuration of original sequence data in accordance with an embodiment of the present invention.

Next, a data structure for a piece of music to be performed will be described with reference to FIGS. 7, 8 and 9. FIG. 7 shows original sequence data for the piece of music. The sequence data is stored in the memory cartridge MC. The sequence data is composed of timing data and event data that are stored according to a sequence of the performance. The timing data is representative of a time separation between one event data and the next event data, and is defined by a clock number equivalent to a predetermined note length (for example, using a unit of a three hundred eighty fourth (384th) note). When a plurality of event data simultaneously occur, timing data "0" is stored.

The event data is composed of note event data, lyric event data representative of a lyric of the piece of music and control change event data. The note event data is composed of data representative of note-on or note-off, pitch data and velocity data. The control change data includes a variety of data required for performance of the piece of music. For example, the control change data includes data for changes in loudness, pitch bend, tone and the like. Each of the note event data and the control change event data has channel data representative of which one of channels 1–16 is used. A determination is made by the channel data as to which one of the channels each of the event data belongs. It is noted that each of the channels corresponds to each of the performance parts, and the channel data is associated with the event data. As a result, event data for a plurality of parts can be stored in a mixed state. Also, each of the event data includes end data at its end (not shown). The sequence data is read out by a read-out pointer, which is described in detail below.

Figure 8:
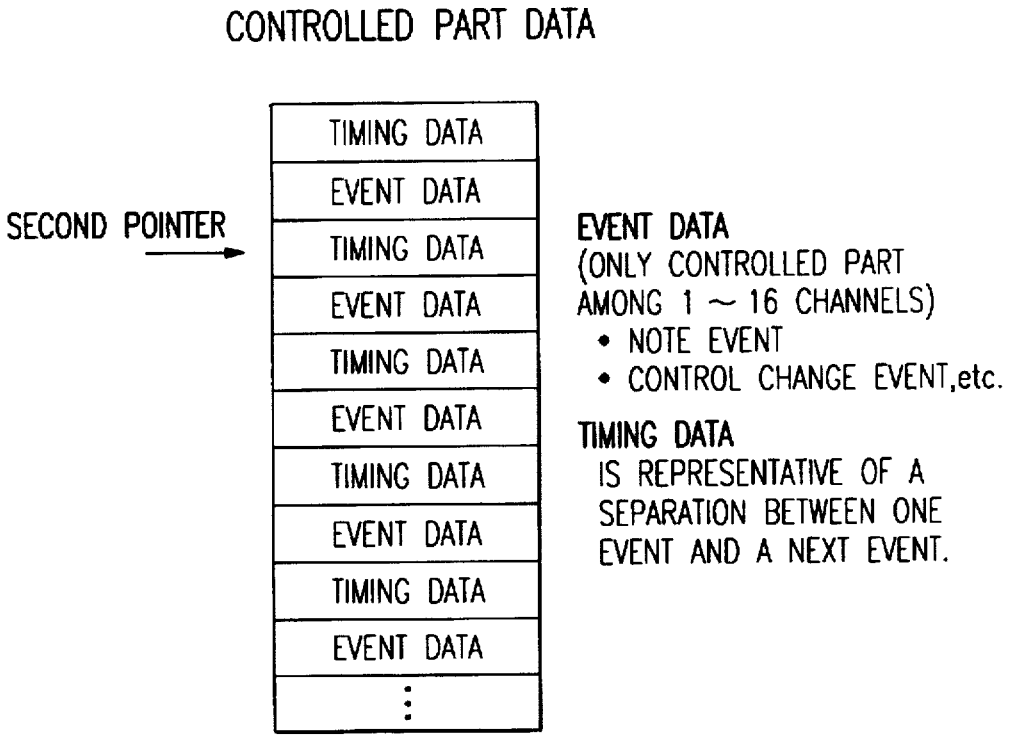
FIG. 8 shows a configuration of data for a variety of controlled parts (a melody part, a base part, a first chord part and a second chord part) read out by the operation of a pad in accordance with an embodiment of the present invention.

FIG. 8 shows controlled part data for a plurality of different parts to be controlled (a melody part, a base part, a first chord part, a second chord part), that is extracted from the above-described sequence data which is composed of performance data for a plurality of parts and lyric event data. The controlled part data is stored in the RAM 4 and is read out by the operation of the pad P. The controlled part data is used for the melody part performance in the second melody mode, the base part performance, the first chord part performance and the second chord part performance. The controlled part data (that is included in the sequence data) includes performance data for each of the parts that is slightly modified to a form suited for the performance control, as will be described in detail below. The controlled part data is composed of timing data and event data in the same format as the sequence data described above. Accordingly, a detailed description of the format is omitted. The controlled part data is read out by a second read-out pointer.

Figure 9:
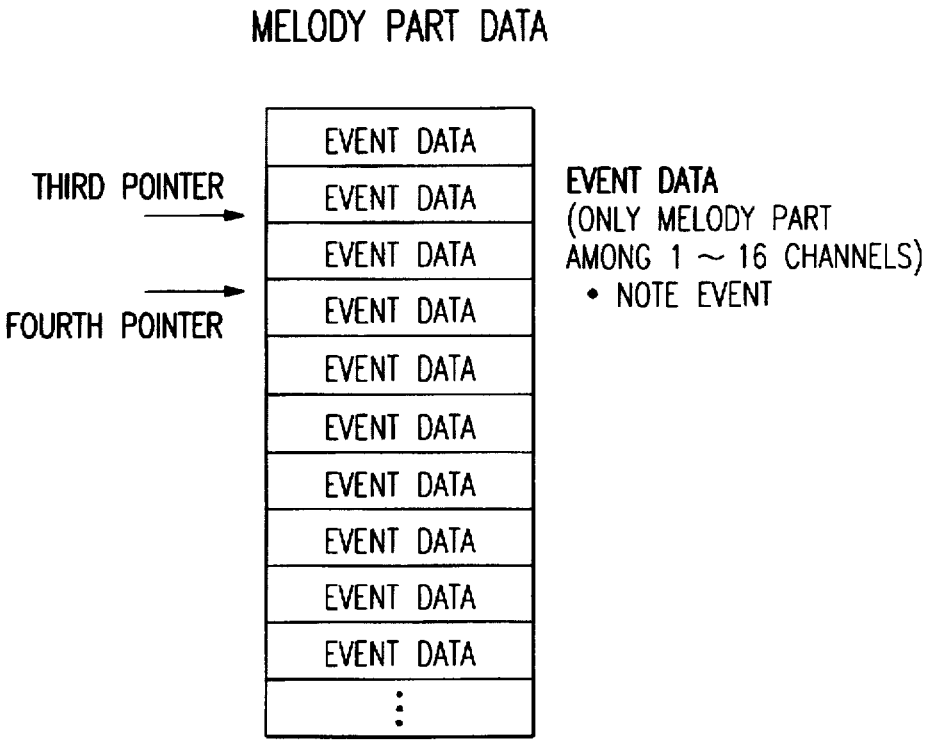
FIG. 9 shows a configuration of data for a melody part in accordance with an embodiment of the present invention.

FIG. 9 shows melody part data that is included in the above-described sequence data which is composed of performance data for a plurality of parts and lyric event data. The melody part data is stored in the RAM 4. Unlike the above-described sequence data and the controlled part data, the melody part data does not include timing data or control change event data. Also, among data stored in note event data, note-on event data is included, but note-off event data is not included. The melody part data is used for performing the melody part performance in the first melody mode. The melody part data is read out by a third read-out pointer.

With reference to FIGS. 10 (A) and 10 (B), pitch control for tones generated during the base part performance, the first chord performance and the second chord performance will be described. Tones for the base part performance, the first chord performance and the second chord performance are generated based on note events of controlled parts that are read out, and octaves of the tones are changed depending on positions of the fret switches FS that are depressed by the player's fingers. In an embodiment, when the fret switches FS that are located closer to the top of the neck portion are operated, tones having lower pitches are generated, and when the fret switches FS that are located closer to the body portion B are operated, tones having higher pitches are generated. Accordingly, tones are not only generated at pitches designated by note event data that is read out from the memory, but are also generated at pitches that are controlled by the player. As a result, a rich variation in the performance can be created.

FIG. 10 (A) shows a tone range control table that is stored in the ROM 3. According to positions of the fret switches being manipulated to generate tones, a tone range that covers pitches of the generated tones is determined by this table. In an embodiment, the table is arranged so that the tone range shifts by two semitones as the fret position shifts by one. Therefore, in this embodiment, a tone range of pitches E0–E2 is covered at the fret position "0" (open position), a tone range of pitches C2–C4 is covered at the fret position "10", and a tone range of pitches G#3–G#5 is covered at the fret position "20" (which is the fret position closest to the body portion).

FIG. 10 (B) shows an example of how an octave of generated tones is controlled by the tone range control table. Let us consider cases in which inputted tones (defined by note events read out from the controlled part data) have pitches C4, C3 and C2, respectively. When an inputted tone has the pitch C4, and one of the fret positions "0" through "9", which does not include the pitch C4, is manipulated, the pitch C4 is changed to the pitch C2. Since the tone ranges at the fret positions "10" through "20" include the pitch C4, the pitch is not changed when any one of these fret positions is manipulated.

When an inputted tone has the pitch C3, and one of the fret positions "0" through "3", which does not include the pitch C3, is manipulated, the pitch C3 is changed to the pitch C1. Since the tone ranges at the fret positions "17" through "20" do not include the pitch C3, the pitch C3 is changed to the pitch C5 when any one of these fret positions is manipulated.

When an inputted tone has the pitch C2, the pitch is not changed when any one of the fret positions "0" through "10" is manipulated since the pitch C2 is included in the tone ranges at these fret positions. Since the tone ranges at the fret positions "11" through "20" do not include the pitch C2, the pitch C2 is changed to the pitch C4 when any one of these fret positions is manipulated. Therefore, the rule for changing the pitch is defined as follows. When a pitch of an inputted tone is not included in a tone generation range, the pitch is changed to a different pitch that is included in the tone generation range. Further, in the case of a pitch with an even number, the pitch is changed to a different pitch with a different even number that is the closest to the even number. In the case of a pitch with an odd number, the pitch is changed to a different pitch with a different odd number that is closest to the odd number. It should be noted that the above-described pitch change rule is presented solely as one embodiment. In an alternative embodiment, the even numbers and the odd numbers may be ignored. It should be noted that tone ranges to be controlled are not limited to the ones shown in the figure.

Figure 11:
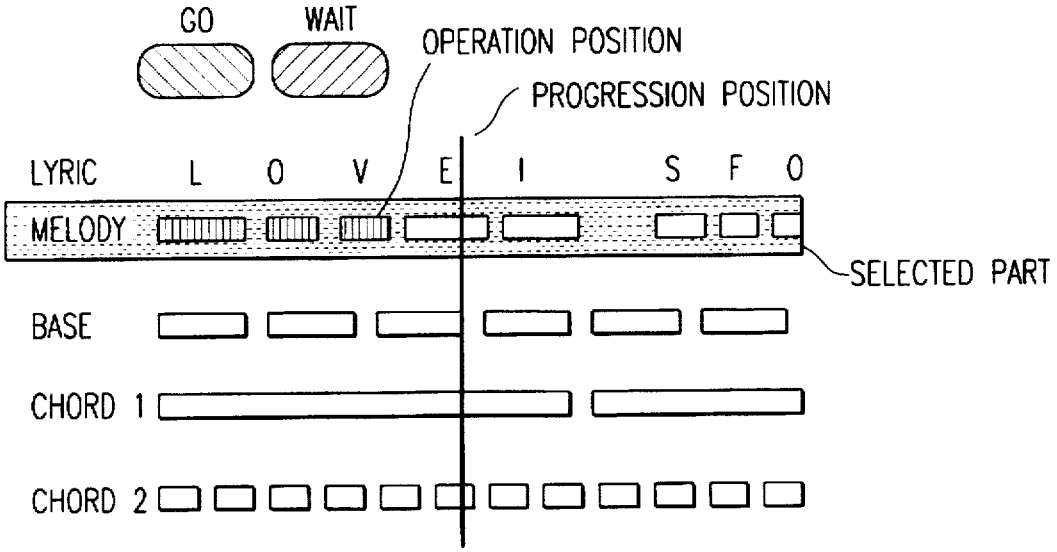
FIG. 11 shows a front view of a display panel in accordance with an embodiment of the present invention.

Next, a presentation by the monitor apparatus D, in accordance with an embodiment of the present invention, will be described with reference to FIG. 11. In this embodiment, the monitor apparatus D displays lyrics, performance timings for the melody part, the base part, the first chord part and the second chord part, selected parts, the current position of progression of the performance, the current position of operation by the player and the degree of progression of the performance. In FIG. 11, sections for the lyric, the performance timing of the melody part, the performance timing of the base part, the performance timing of the first chord part, and the performance timing of the second chord part are vertically arranged in parallel with one another. Each of the sections displays a progression of each of the parts from the left-hand side to the right-hand side. For the melody part, the base part, the first chord part and the second chord part, tones are generated during periods of time that correspond to rectangular segments. In an embodiment, the left side end of each of the rectangular segments corresponds to the start of tone generation, and the length of each of the rectangular segments corresponds to the duration of time for which a tone is generated. In an embodiment, a velocity value included in a note event may be detected and represented by a corresponding length of a rectangular segment so that a recommended strength for operating the pad is displayed.

A section shaded with dots indicates that the section is selected as a part to be controlled. In FIG. 11, the melody part is shaded with dots to indicate that the melody part is selected as a part to be controlled. The current position of progression is indicated by a vertical solid line. The vertical solid line shifts toward the right-hand side as the performance progresses. A section shaded with vertical lines indicates that the section is currently operated by the player. In FIG. 11, the section for the tone generation timing of the melody part is shaded with vertical lines at the third rectangular segment from the left-hand side. This means that the current position of operation is at the third note.

How a performance is progressed is indicated by sections shaded by slanted lines. In FIG. 11, the sections shaded by the slanted lines are progression indicators that indicate "Go" and "Wait". When the current position of progression of the piece of music is generally at the same position as the performance position of the piece of music performed by the player, the section "Go" is lighted. If the display apparatus is capable of color display, the section may be lighted, for example, in blue. When the performance position of the piece of music performed by the player is delayed with respect to the current position of progression of the piece of music, the section "Go" is lighted to indicate that the performance should be "faster". On the other hand, when the performance position of the piece of music performed by the player is advanced with respect to the current position of progression of the piece of music, the section "Wait" is lighted. If the display apparatus is capable of color display, the section may be lighted, for example, in red. The player can confirm, at a glance, whether the performance operation should be continued at the same pace, whether the performance operation should be faster, or whether the player should wait for a while. The manner of indication is not limited to the above-described embodiment. For, example, three different indications, "Go", "Faster" and "Wait", may be provided as an alternative advancement indication form.

Figure 12:
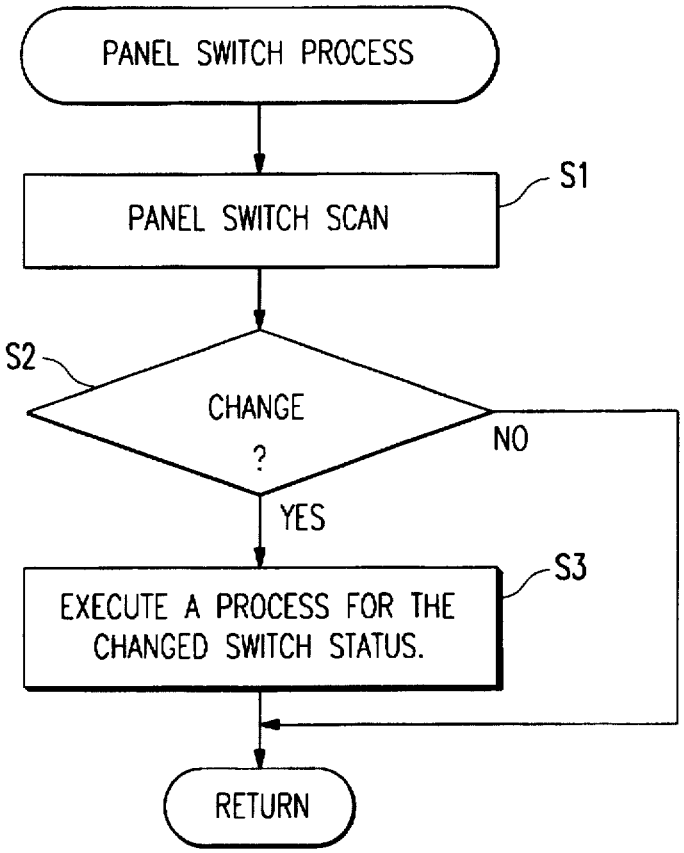
FIG. 12 is a flow chart of a panel switch process in accordance with an embodiment of the present invention.

Next, with reference to FIGS. 12 through 43, flows of processes by the CPU 1 will be described. FIG. 12 shows a flow chart representing a panel switch process. The panel switch process is executed at a specified cycle, for example, every 10 ms. In step s1, the panel switch is scanned. In step s2, a determination is made whether there has been changes in switch status of the switches. If there is a change in the switch status, a process responsive to the changed switch status is executed in step s3.

Figure 13:
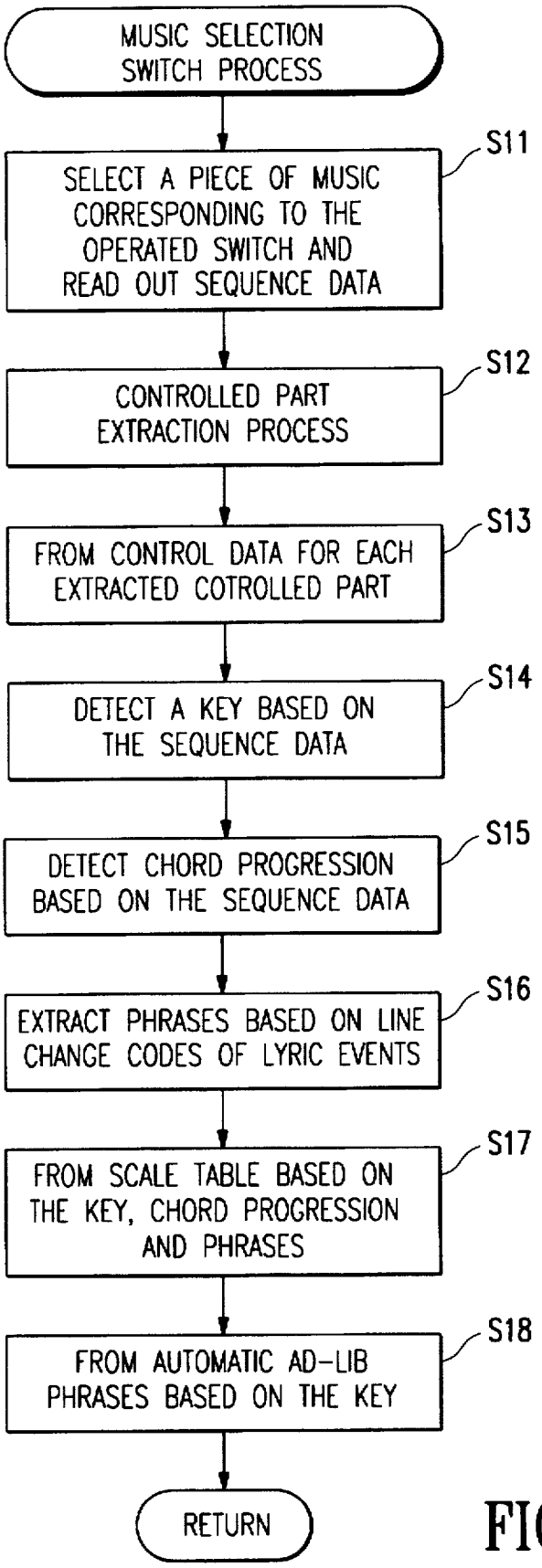
FIG. 13 is a flow chart of a music selection switch process in accordance with an embodiment of the present invention.

FIG. 13 shows a flow chart of a music piece selection process that is a part of the "process responsive to the changed switch status" executed in the above step s3 of FIG. 12. In step s11, a piece of music corresponding to the depressed switch is selected, and associated sequence data is read out from the memory cartridge MC. In step s12, performance parts to be controlled are extracted from a plurality of performance parts in the read sequence data. In an embodiment, a melody part, a base part, a first chord part and a second chord part are defined in the following manner as the parts to be extracted. The melody part is a performance part at the fourth channel; the base part is a performance part in which a program change event representative of a specified base tone color is stored as an initial tone color; the first chord part is a performance part which includes the highest number of tones among all of the performance parts except a drum part; and the second chord part is a performance part which includes the second highest number of tones among all of the performance parts except the drum part. In the above embodiment, the performance part at a fourth channel is set as the melody part because, in the field of computer music, the fourth channel is generally used for a melody part. In alternative embodiments, the performance data may store comment data, for example a comment "melody", and the melody part may be extracted based on the comment data if the comment data includes the comment "melody" or an equivalent comment. Also, in the above embodiment, the base part is defined as the performance part in which the program change event represents the tone color of the base. However, in an alternative embodiment, comment data, such as for example, a comment "base", may be used in a similar manner as the extraction method for the melody part, or a performance part in which lower tones occur at the highest frequency among all of the performance parts may be determined as the base part.

In accordance with other embodiments, to extract the first chord part and the second chord part, the duration of tones to be generated is determined and a part that has the longest duration may be extracted as either the first chord part or the second chord part. Alternatively, a part that has the highest number of tones to be generated may be extracted as either the first chord part or the second chord part. Also, comment data may be used in a similar manner as the above extraction method used for extracting the melody part and the base part. Further, the performance data may be arranged to include data that indicates which parts should be extracted as parts to be controlled. Moreover, an arrangement is made so that parts to be controlled are automatically determined, and a player can modify the parts.

In step s13 of FIG. 13, control data is formed for each of the extracted performance parts to be controlled. Contents of the original sequence data for each of the performance parts to be controlled are modified to form the control data which is better suited for a particular control. An original sequence data may be provided in a format that is not suitable for the control to be performed in accordance with the present invention. If such a sequence data is used without a modification, the control may not be properly performed. For example, normally, there is a no-tone generating period between two adjacent notes in each of the parts in the sequence data. (For example, If there is not a no-tone generating period at all, a legato performance is always performed, and the music lacks a rhythmical feeling and becomes monotonous.) In the performance of the melody part in the second melody mode, the base part, the first chord part and the second chord part 2, tones are generated when the pad P is operated. Therefore, if the player operates the pad P during the no-tone generating 5 period, no tone is generated. In order to avoid such inconveniences, performance data which does not have no-tone generating periods is formed in advance and stored as data for parts to be controlled.

For example, the performance data which does not have no-tone generating periods is formed based on any one of the following rules:

(1) A no-tone generating period is filled by a note event that comes next to the no-tone generating period. Namely, a timing to start generation of a tone of a next note event comes immediately after a timing to mute a tone of a previous note event.

(2) A timing to mute a tone of a previous note event and a timing to start generation of a tone of a next note event are brought to an intermediate position of the no-tone generating period. Namely, the timing to mute a tone of a previous note event is delayed to the intermediate position of the no-tone generating period and the timing to start generation of a tone of a next note event is advanced to the intermediate position of the no-tone generating period.

(3) A timing to start generation of a tone of each one of all note events is advanced by a specified amount of time. By doing so, particular inconveniences are avoided. For example, even when a player operates the pad at a timing slightly earlier than a first beat while intending to generate the tone at the first beat, the tone of the first beat is still generated. If no-tone generating periods still exist even by implementing this rule, the above-described rules (1) and (2) may also be used to eliminate no-tone generating periods.

The rules to form performance data without no-tone generating periods are not limited to the above-described embodiments. In another embodiment, a different performance data forming rule may be utilized for each of the controlled parts.

In step s14, a key of the piece of music is detected based on the sequence data. For example, for each note appearing in the piece of music, a sum of time duration (note value) of the note is obtained and a key of the piece of music is obtained based on a distribution of the sums of time durations of the notes. It is noted that there has been proposed a variety of methods to obtain a key of a piece of music, and therefore any appropriate one of the methods is adapted. In step s15, a chord progression of the piece of music is detected based on the obtained key and note data in the sequence data. A plurality of performance parts may be considered to determine the chord progression, or alternatively, a particular one of the performance parts may be considered. The particular one of the performance parts may be defined by a performance part that has the greatest number of tones or a performance part that has the longest average tone generation duration. It is noted that there has also been proposed a variety of methods to obtain a chord progression of a piece of music, and therefore an appropriate one of the methods is adapted.

In step s16, phrase cut positions are extracted based on line-change codes that are included in the lyric event data. As described above, the sequence data stores lyric events according to the progression of the lyric of the piece of music. For example, each of the lyric events (that is representative of each character of the lyric) is stored at the same location of a note event representative of a note that is associated with the lyric character. When the lyric is displayed, the lyric may be cut into specified phrases so that each phrase is displayed in a different line. In the illustrated embodiment of the present invention, a phrase of the lyric is displayed in a single line. In another embodiment, a plurality of phrases may be displayed in a corresponding plurality of lines. In order to display each of the phrases in a different line, some of lyric event data contains line-change codes at certain locations to direct changing lines. It can be assumed that the line-change code is included in each of the phrases. Therefore, in accordance with this embodiment, phrase cut positions are extracted by detecting the line-change codes. Alternatively, the structure of the music data is analyzed to extract the phrase cut positions.

In step s17, a scale table is formed based on the key of the piece of music, the chord progression, and the phrases of the lyric that are obtained above. Namely, a diatonic scale, a first pentatonic scale and a second pentatonic scale are formed based on the obtained key; a scale of chord composing tones is formed based on the chord progression; and the melody is cut at the phrase cutting positions and a scale of melody composing tones is formed based on pitches that appear in each of the phrases. It is noted that, since the chord composing tones and the melody composing tones successively change with the progression of the piece of music, a scale for each of the chord types and a scale for each of the phrases that appear are formed in this step. The scales in the table are successively changed as the piece of music progresses.

In step s18, automatic ad-lib phrases are formed based on the obtained key in the same number of the frets switches. For example, a plurality of automatic ad-lib phrases in the pentatonic scales and a plurality of automatic ad-lib phrases in the diatonic scale are formed and assigned to the fret switches. Preferably, tone ranges should be changed according to the positions of the fret switches. In another embodiment, ad-lib phrases may be formed by randomly arranging scale tones of the key. Alternatively, specified phrases may be stored in advance and ad-lib phrases are formed by modifying the pitches of the phrases in response to the obtained key.

Figure 14:
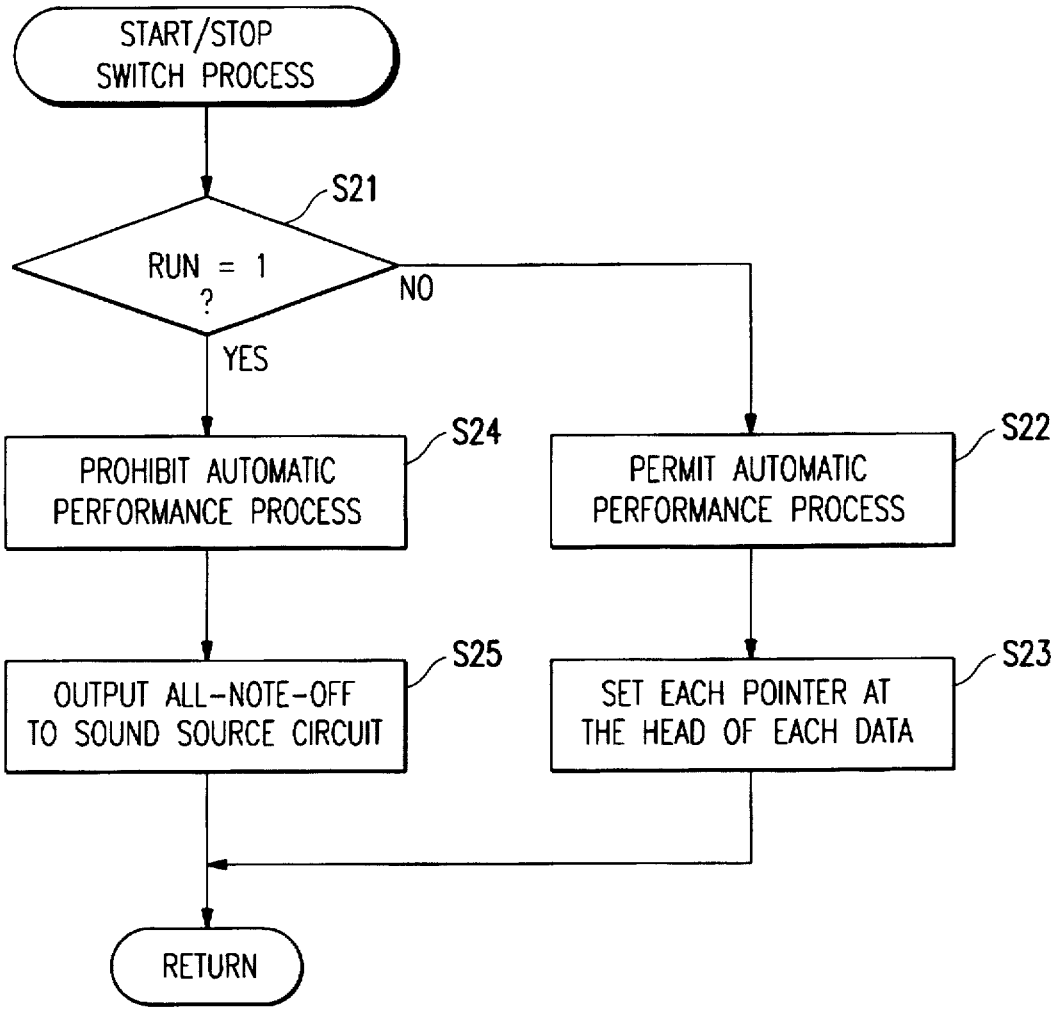
FIG. 14 is a flow chart of a start/stop switch process in accordance with an embodiment of the present invention.

FIG. 14 shows a flow chart of a start/stop switch process that is a part of the "process responsive to the changed switch status" executed in the above step s3 of FIG. 12. In step s21, a determination is made whether a run flag is RUN=1 that is representative of an automatic performance in progress. When it is not "1", namely, when the automatic performance is not performed or is in a non-performing state, an automatic performance process (described later) is permitted in step s22. Accordingly, the automatic performance process is started. In step s23, the first read-out pointer, the second read-out pointer, the third read-out pointer and the fourth read-out pointer are set at the leading sections of the corresponding data, respectively.

On the other hand, when a determination is made in step s21 that the run flag RUN is "1", the automatic performance process is prohibited in step s24 to stop the automatic performance, and an all-note-off command is outputted to the sound source circuit in step s25 to mute tones that are being generated at the moment.

Figure 15:
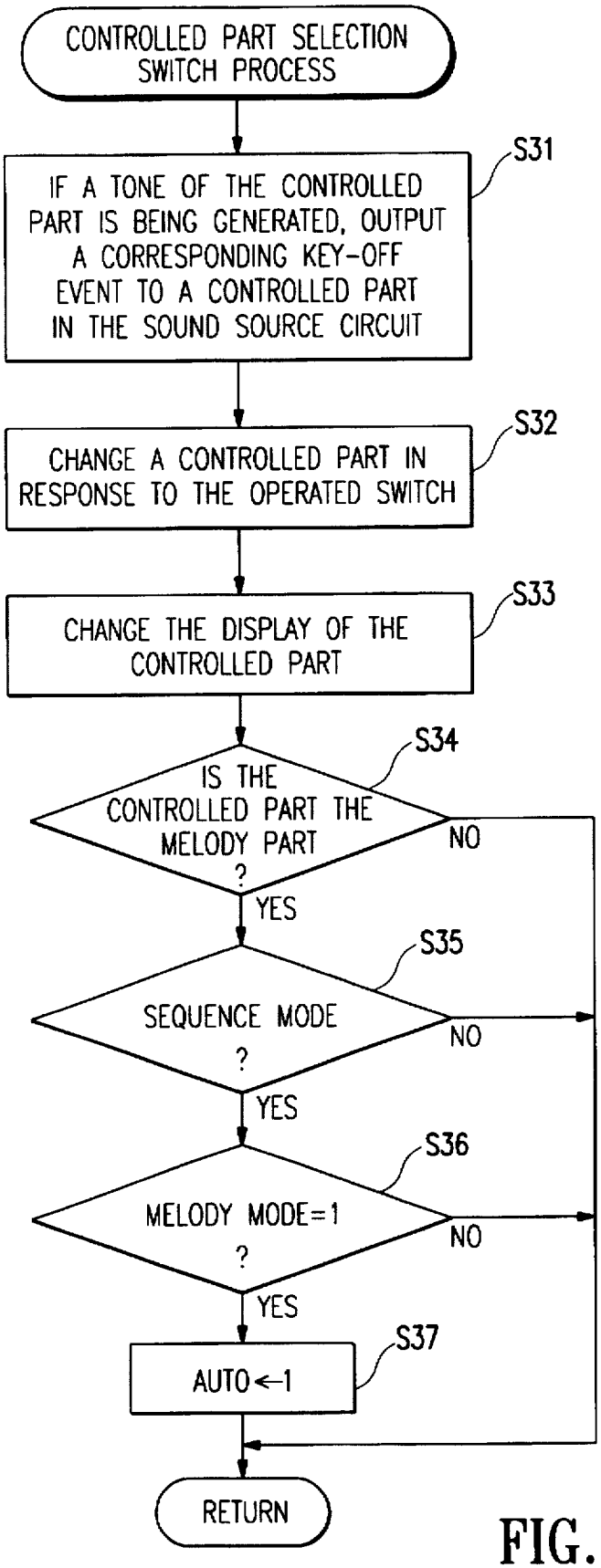
FIG. 15 is a flow chart of a controlled part selection process in accordance with an embodiment of the present invention.

FIG. 15 shows a flow chart of a controlled part selection switch process that is one of the "processes responsive to the changed switch statuses" executed in the above step s3. In step s31, if there is a tone in a controlled part being generated, a key-off event corresponding to the tone is outputted to a channel in the sound source circuit that is allocated to the controlled part. As a result, when the current controlled part is changed to a different one, tones of the current controlled part are muted. In step s32, the controlled part is changed to a different controlled part in response to an associated switch operated by the player. In step s33, to indicate the different controlled part, a display of the previous controlled part in the monitor apparatus D is changed to a newly-selected controlled part, and light emitting diodes (LEDs) corresponding to the newly-selected controlled part are lighted.

Next in step s34, a determination is made whether the newly-selected controlled part is the melody part. When it is not the melody part, the controlled part selection switch process is terminated immediately after step s34. When it is the melody part, a determination is made in step s35 whether the melody part is in the sequence mode or whether it is in the ad-lib mode. When the melody part is in the ad-lib mode, the controlled part selection switch process is terminated. When the melody part is in the sequence mode, a determination is made whether the melody part is in the first melody mode or in the second melody mode. When the melody part is in the second melody mode, the controlled part selection switch process is terminated. When the melody part is in the first melody mode, in step s37, a flag AUTO is set to "1" indicating a prosecution of an automatic performance of the melody part. By this step, the melody part is set in an automatic performance state, in which the melody part is automatically performed without a player operating the pad. Also, the automatic performance of the melody part is synchronized with the current position of progression of the piece of music.

The synchronization of the automatic performance of the melody part and the current position of progression is done for the following reasons. In the first melody mode, tones do not shift from one tone to the next tone unless the pad is operated. Therefore, unless the pad is operated immediately after one controlled part is switched to the melody part, the position of progression of the melody part is delayed. Such a delay increases rapidly unless the pad is immediately operated. However, when one performance part is switched to the melody part, a player often does not know how the performance of the melody part is progressing. In other words, the player does not know how he should operate the pad to perform the melody part correctly. Accordingly, by automatically performing the melody part immediately after one part is switched to the melody part, the player can readily recognize the flow of the melody part. Later, the player can start operating the pad at an appropriate moment so that the player can control the performance of the melody part by his own manipulations.

Figure 16:
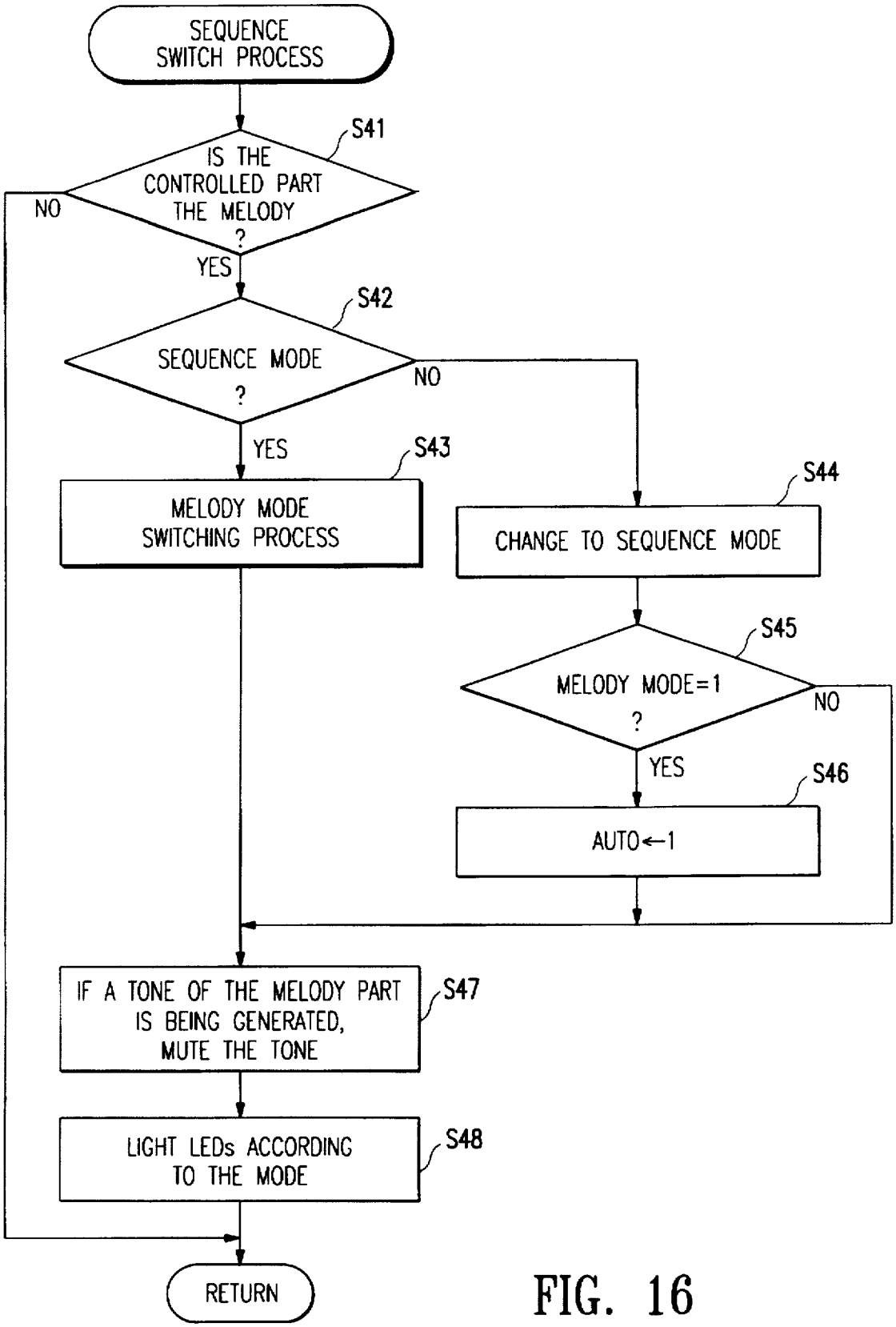
FIG. 16 is a flow chart of a sequence selection process in accordance with an embodiment of the present invention.

FIG. 16 shows a flow chart of a sequence switch process that is a part of the "process responsive to the changed switch status" executed in the above step s3. In step s41, a determination is made whether the part to be controlled is the melody part. When it is one of the parts other than the melody part, the succeeding steps are irrelevant and thus this process is terminated. When it is the melody part, a determination is made in step s42 whether the current mode is the sequence mode or the ad-lib mode. When it is the sequence mode, a melody mode switching process (described below) is executed in step s43. On the other hand, when it is the ad-lib mode, the mode is switched to the sequence mode in step s44, and a determination is made whether the sequence mode is in the first melody mode or in the second melody mode. When it is in the first melody mode, the flag AUTO is set to "1" in step s46 in a manner similar to the above-described step s37. By this step, automatic performance of the melody part is performed synchronized with the current position of progression of the piece of music. When the sequence mode is in the second melody mode, the process in step s46 is not executed. In step s47, if there is a tone in the melody part being generated, a key-off event corresponding to the tone is outputted to a corresponding channel for the melody part in the sound source circuit to mute the tone. In step s48, the LEDs according to the selected mode are lighted.

Figure 17:
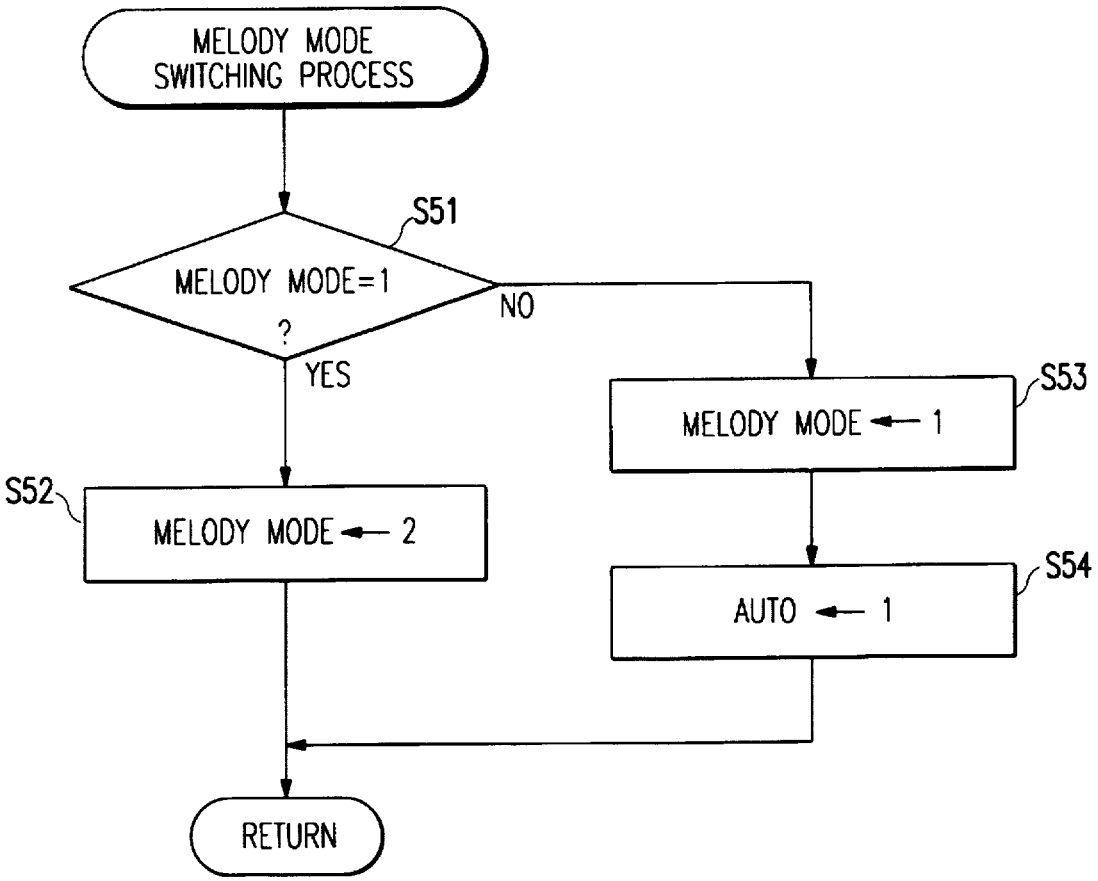
FIG. 17 is a flow chart of a melody mode switching process in accordance with an embodiment of the present invention.

FIG. 17 shows a flow chart representative of the melody mode switching process in detail, as executed in step s43 described above. In step s51, a determination is made whether the first melody mode is currently set or the second melody mode is currently set. When a determination is made that the first melody mode is set, the second melody mode is set in step s52. On the other hand, when a determination is made that the second melody mode is set, the first melody mode is set in step s53. In step s54, the flag AUTO is set to "1". By this step, an automatic performance of the melody part is performed synchronized with the current position of progression of the piece of music.

Figure 18:
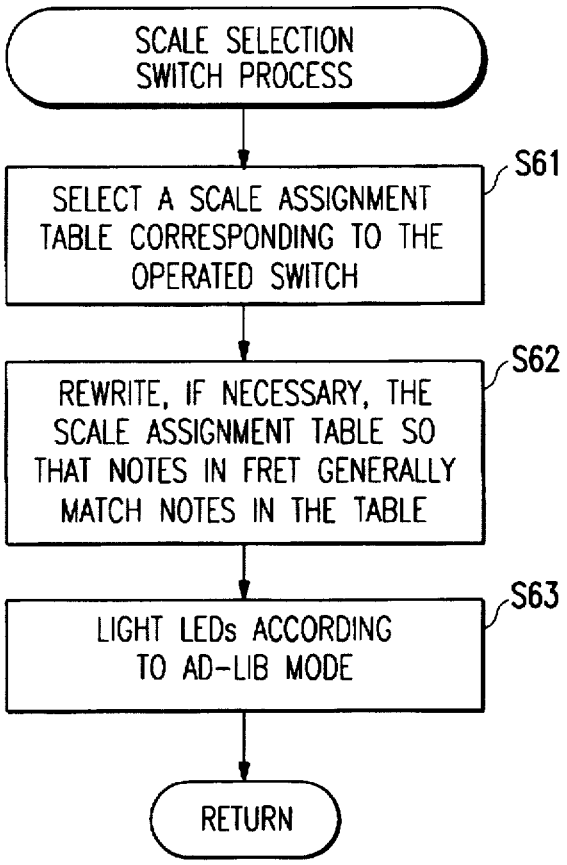
FIG. 18 is a flow chart of a scale selection switching process in accordance with an embodiment of the present invention.

FIG. 18 shows a flow chart of a scale selection switch process that is a part of the "process responsive to the changed switch status" executed in the above step s3. In step s61, a scale assignment table corresponding to a switch depressed is selected. In step s62, the content of the scale assignment table is rewritten if necessary so that the present note names stored at a fret register FRET that stores the latest fret positions are the same or similar to the previous note names. In step s63, the LEDs corresponding to the selected scale are lighted.

Figure 19:
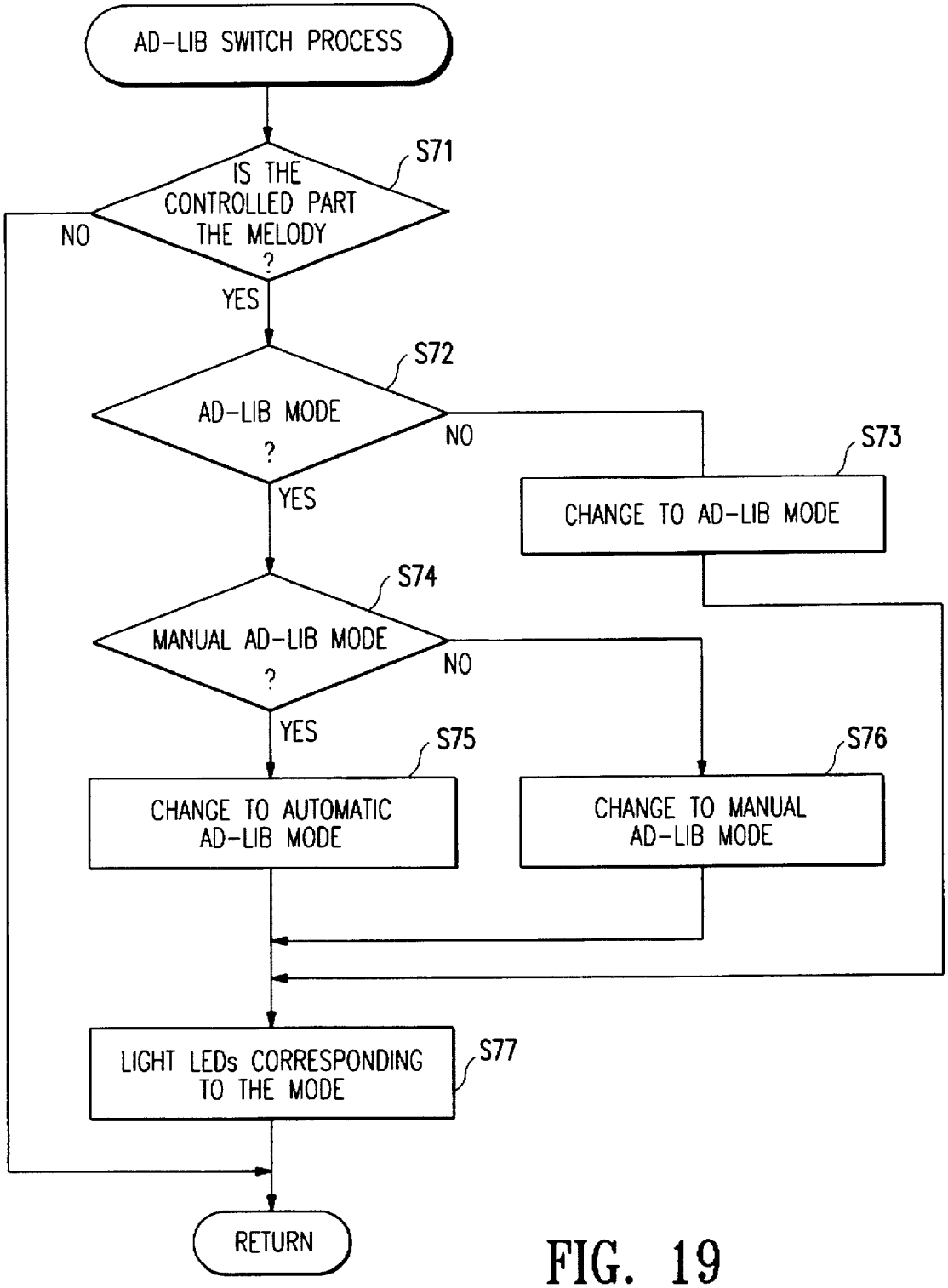
FIG. 19 is a flow chart of an ad-lib switch process in accordance with an embodiment of the present invention.

FIG. 19 shows a flow chart of an ad-lib switch process that is a part of the "process responsive to the changed switch status" executed in the above step s3. In step s71, a determination is made whether the part to be controlled is the melody part. When it is one of the parts other than the melody part, the ad-lib switch process is terminated. On the other hand, when the melody part is set, a determination is made in step s72 whether the ad-lib mode is set or the sequence mode is set. When the sequence mode is set, the sequence mode is switched to the ad-lib mode in step s73. When the ad-lib mode is set, a determination is made in step s74 whether the manual ad-lib mode is set or the automatic ad-lib mode set. When the manual ad-lib mode is set, the manual ad-lib mode is switched to the automatic ad-lib mode in step s75. On the other hand, when the automatic ad-lib mode is set, it is switched to the manual ad-lib mode in step s76. Later, in step s77, the LEDs are lighted in accordance with the set mode.

Figure 20:
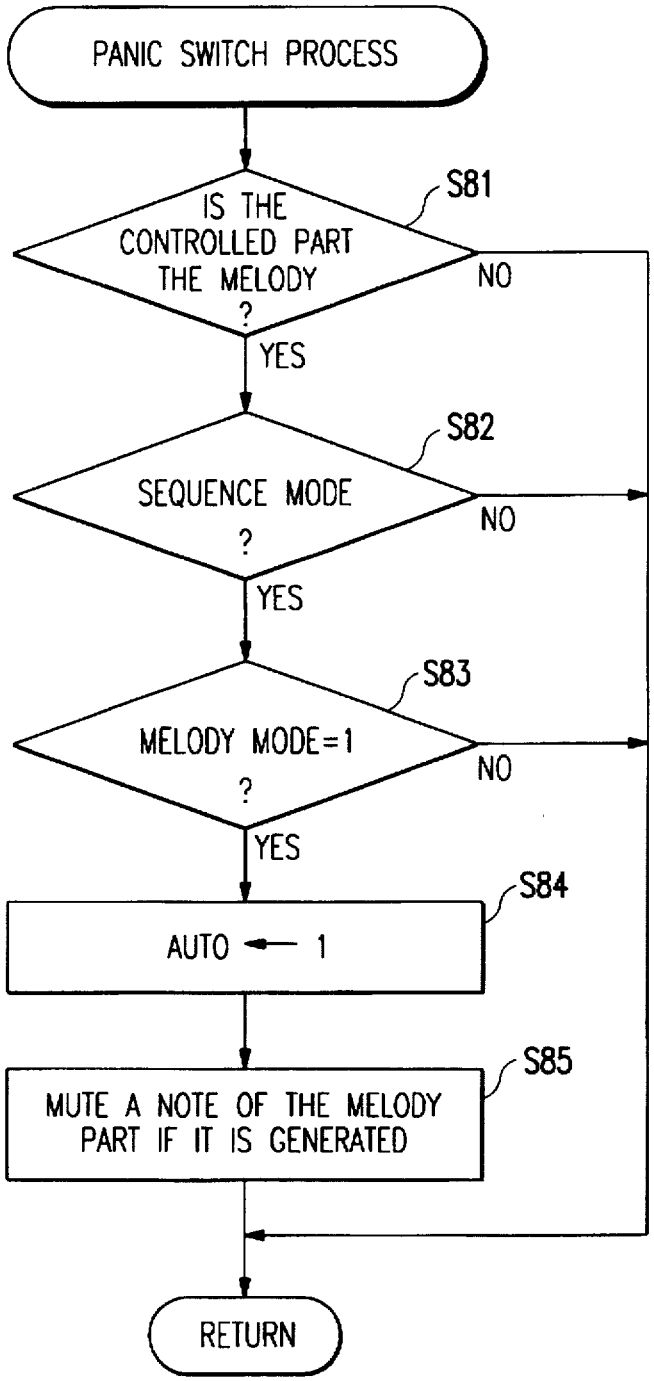
FIG. 20 is a flow chart of a panic switch process in accordance with an embodiment of the present invention.

FIG. 20 shows a flow chart of a panic switch process that is a part of the "process responsive to the changed switch status" executed in the above step s3. In step s81, a determination is made whether the part to be controlled is the melody part. When one of the parts other than the melody part is set, the panic switch process is terminated. When the melody part is set, a determination is made in step s82 whether the melody part is set in the sequence mode or in the ad-lib mode. When the ad-lib mode is set, the panic switch process is terminated. When the sequence mode is set, a determination is made in step s83 whether the first melody mode is set or the second melody mode is set. When the second melody mode is set, the process is terminated. When the first melody mode is set, the flat AUTO is set to "1" in step s84. By this step, an automatic performance of the melody part, that is synchronized with the current position of progression of the piece of music, is performed. In step s85, if there is a tone in the melody part being generated, a key-off event corresponding to the tone is outputted to a channel for the melody part in the sound source circuit to mute the tone.

Figure 21:
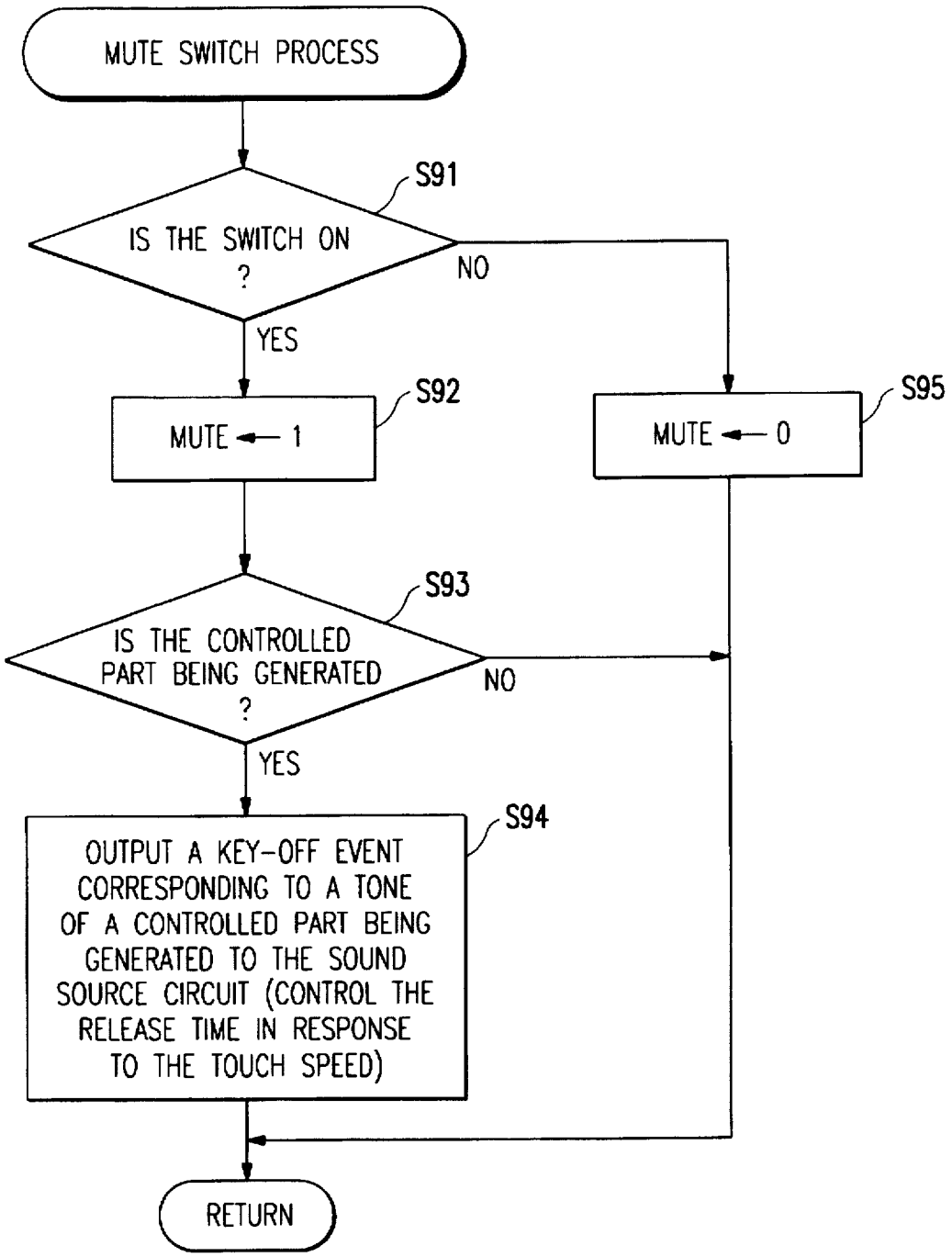
FIG. 21 is a flow chart of a mute switch process in accordance with an embodiment of the present invention.

FIG. 21 shows a flow chart of a mute switch process that is a part of the "process responsive to the changed switch status" executed in the above step s3. In step s91, a determination is made whether the mute switch is turned on or off. When the mute switch is turned on, in step s92, the mute flag MUTE is set to "1", indicating that the mute switch is turned on. In step s93, a determination is made whether a tone in the controlled part is being generated. If a tone in the controlled part is being generated, in step s94, a key-off event for the tone is outputted to a channel in the sound source circuit corresponding to the controlled part to mute the tone. Since the switch touching speed to operate the mute switch is detected, a release time of the tone is controlled in response to the switch touching speed. For example, when the switch touching speed is faster, the release time is made shorter, and when the switch touching speed is slower, the release time is made longer. In alternative embodiments, tone parameters other than the release time, for example, the cut off frequency of filters, may be controlled to control the manner in which the tone is released. By controlling the manner in which a tone is released in response to the mute switch touching speed, attenuation of the tone can be simulated in different ways. For example, attenuation of a guitar string can be simulated in different ways. More specifically, when a guitar string is depressed adjacent the bridge of the guitar, a tone of the guitar string attenuates in a different way as compared when the guitar string is depressed a little away from the bridge. Such different attenuations can be simulated by controlling the release time of the tone. It should be noted that the above-described control is applicable to tones other than that of the guitar.

In step s91, when a determination is made that the mute switch is turned off, the flag MUTE is set to "0" in step s95.

Figure 22:
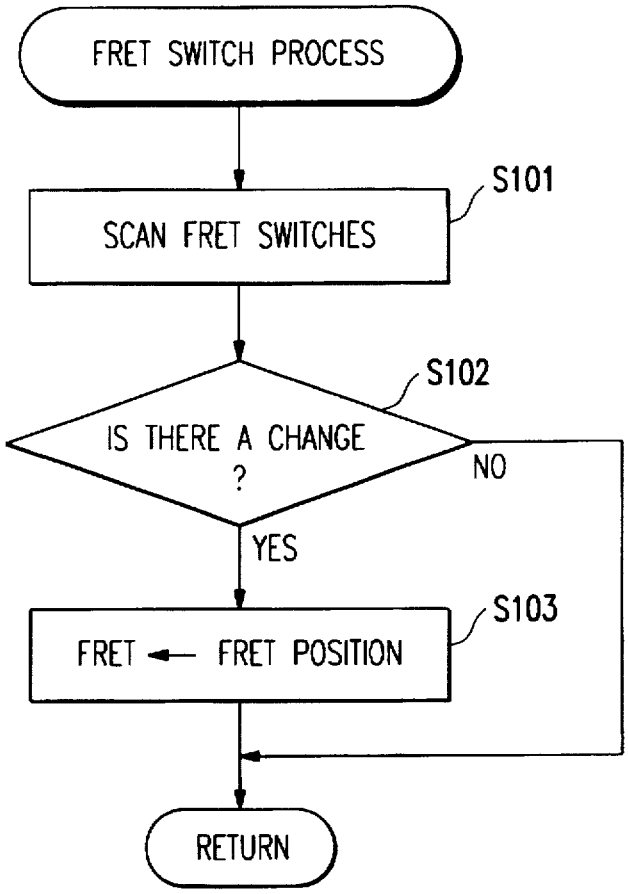
FIG. 22 is a flow chart of a fret switch process in accordance with an embodiment of the present invention.
Figure 23:
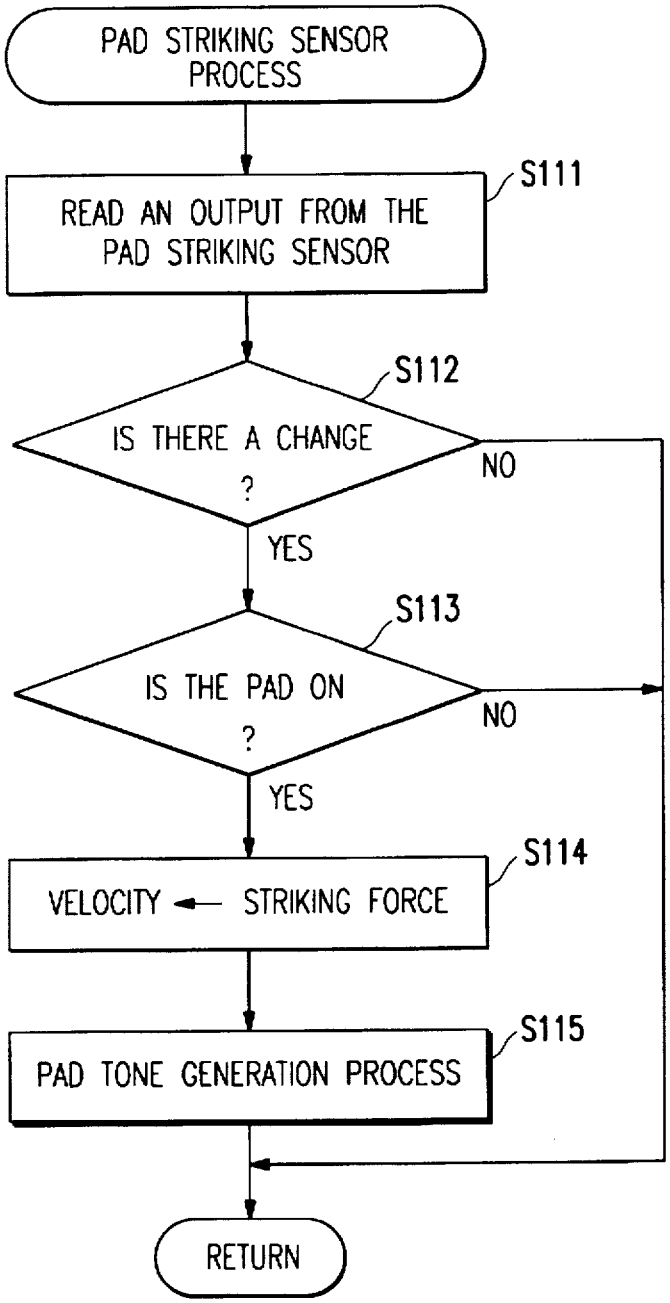
FIG. 23 is a flow chart of a pad strike sensor process in accordance with an embodiment of the present invention.

FIG. 22 shows a flow chart of a fret switch process that is a part of the "process responsive to the changed switch status" executed in the above step s3. In step s101, the fret switches are scanned. When a determination is made in step s102 that there is a change in the depressed condition of the fret switches, the location of one of the operated fret switches that is closest to the body portion B is stored in a fret position register FRET.

Next, referring to FIGS. 23 through 28, a pad striking sensor process will be described. The pad striking sensor process is executed at a specified cycle (for example, at every 10 ms). In step s11, an output value of the pad striking sensor is read. The pad striking sensor provides output values in a plurality of different stages (for example, 128 stages). When the pad is struck, an output value rapidly increases and reaches a peak value. After reaching the peak value, the output value gradually attenuates. A determination is made in step s112 whether there is a change in the output value, and a determination is made in step s113 whether the output value has reached the peak value due to the change. When the output value has reached the peak value, a determination is made that the pad has been operated, and the process proceeds to step s114. Other than the case in which the output value has reached the peak, namely, when the output value is increasing or attenuating, a determination "NO" is made in step s113. In step s114, the peak value is stored as a striking strength in a velocity storing register. In step s115, a pad tone generation process is executed.

Figure 24:
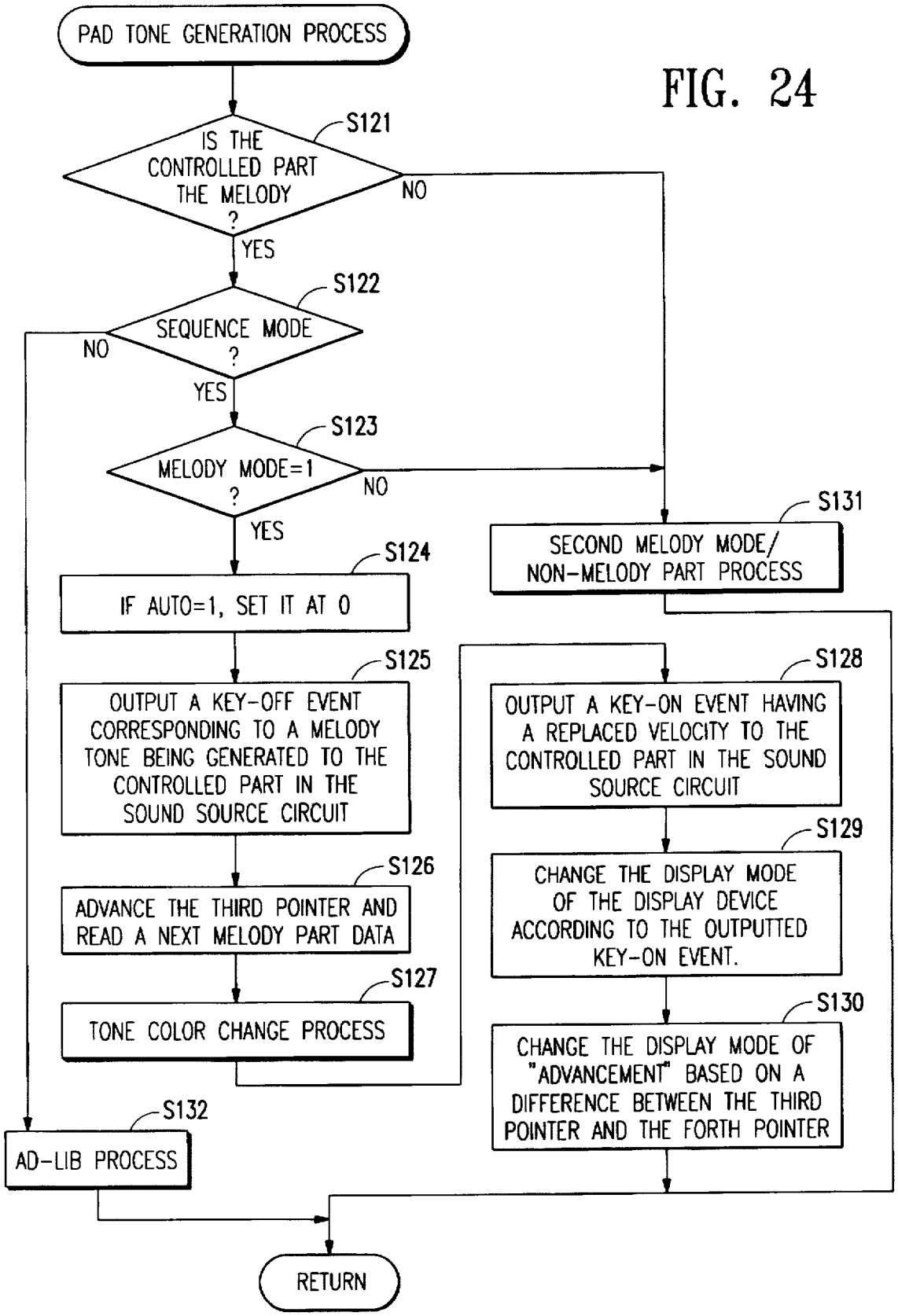
FIG. 24 is a flow chart of a pad tone generation process in accordance with an embodiment of the present invention.

FIG. 24 shows a flow chart representative of the pad tone generation process in detail that is executed in steps 15 described above. In step s121, a determination is made whether the controlled part is the melody part. When it is the melody part, the process proceeds to step s122. When it is a non-melody part, the process proceeds to step s131 in which a second melody mode and non-melody part process is executed. In step s122, a determination is made whether the sequence mode is set or the ad-lib mode is set. When the sequence mode is set, the process proceeds to step s123. When the ad-lib mode is set, the process proceeds to step s132 wherein an ad-lib process is executed.

In step s123, a determination is made whether the first melody mode is set or the second melody mode is set. When the first melody mode is set, the process proceeds to step s124. When the second melody mode is set, the process proceeds to step s131. In step s124, if the flag AUTO is set to "1", the flag is reset to "0". By this, the melody part, that has been automatically performed without operating the pad, is set to a state in which the melody part is not operated without operating the pad. In step s125, if there is a tone in the melody part that is being generated, a key-off event for the tone is outputted to a channel in the sound source circuit that corresponds to the melody part to mute the tone. It is noted that, when the tone has already been muted by the operation of the mute switch, the process in this step is not executed. In step s126, the third read-out pointer is advanced and data for the next melody part is read out. In step s127, a tone color changing process is executed.

Figure 26:
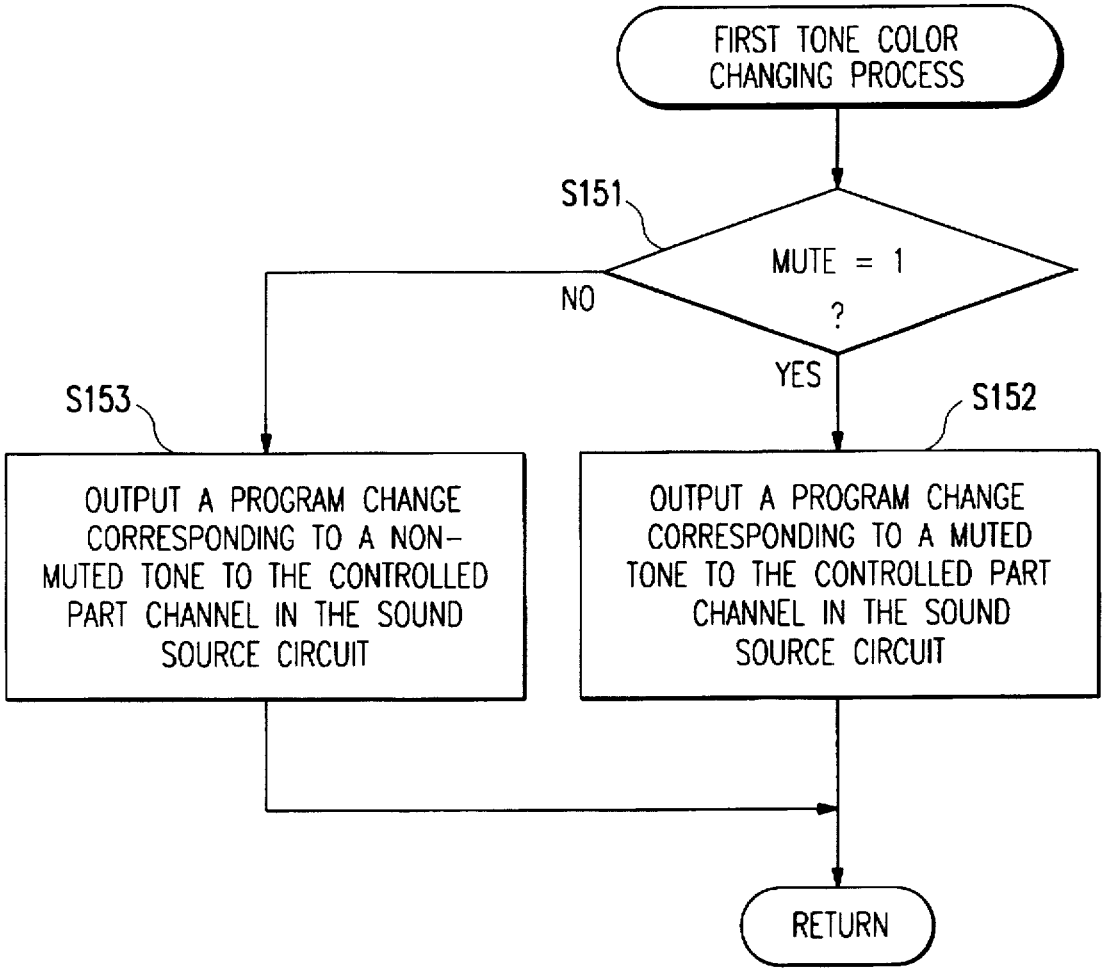
FIG. 26 is a flow chart of a first tone color changing process in accordance with an embodiment of the present invention.
Figure 27:
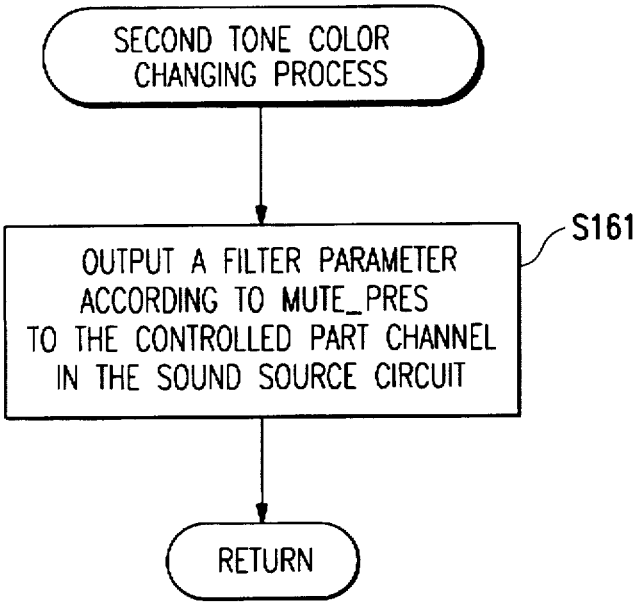
FIG. 27 is a flow chart of a second tone color changing process in accordance with an embodiment of the present invention.

FIGS. 26 and 27 shows flow charts of the tone color changing process. In a process shown in FIG. 26, a tone color of a tone is changed depending upon whether the mute switch has been depressed at the time when the pad is operated. In step s151, a determination is made whether the mute flag MUTE is set to "1". When it is set to "1", a program change event (a tone changing command+a tone color number) corresponding to the muted tone is outputted to a channel for the controlled part in the sound source circuit in step s152. For example, when a tone color of a guitar is set as a tone color in a non-muted state, a program change event is representative of a change from the tone color of the guitar to a tone color of a mute guitar, and when a tone color of a trumpet is set as a tone color in a non-muted state, a program change event is representative of a change from the tone color of the trumpet to a tone color of a mute trumpet. On the other hand, when the flag MUTE is not set to "1", a program change event corresponding to a non-muted sound (for example, those of the guitar and the trumpet described above) is outputted to a channel for the controlled part in the sound source circuit in step s153. As a result, when the pad is operated while depressing the mute switch, a muted tone is generated. When the pad is operated without operating the mute switch, a non-muted tone is generated. In the above embodiment, a program change event is outputted to the sound source circuit each time the pad is operated. However, in a preferred embodiment, if the state of the mute switch is unchanged between when the pad is operated now and when it was operated before, a program change event may not be outputted; and only when there is a change in the state, may a program change event be outputted.

FIG. 27 shows a flow chart of a tone color changing process in accordance with another embodiment in which tone control parameters are changed depending on the depression force applied to the mute switch at the time the pad is operated. In this process, in step s161, a filter parameter is formed according to a value representative of a depression force applied to the mute switch that is stored in a register MUTE_PRES, and the parameter is outputted to a channel for the controlled part in the sound source circuit. For example, when the mute switch is not depressed, a filter parameter corresponding to the depression force=0 is provided to the sound source circuit. As a result, for example, a tone having a relatively high filter cut-off frequency, which is a bright, gay sound, is generated. When the mute switch is depressed, a filter parameter, having a cut-off frequency that is lowered according to the depression force applied to the mute switch, is provided. As a result, a round, soft tone is generated. It is noted that one of the tone color changing processes described above may be adapted, or both of the tone color changing processes may be used at the same time.

Next, in step s128, a velocity value included in the key-on event data is replaced by the velocity value obtained by the pad operation, and then the key-one event data is outputted to a melody part channel of the sound source circuit. As a result, the tone that has been so far generated is muted, and a new tone is generated with a pitch corresponding to the newly-read note event, a velocity corresponding to the pad operation force and a tone color corresponding to the depression condition of the mute switch. In this manner, the melody part is performed.

In step s129, a display mode (the portion shaded by vertical lines shown in FIG. 11) of the display element (the rectangular sections of each of the parts described above with reference to FIG. 11) is changed in accordance with the outputted key-on event to display which one of the notes is currently performed by the player. In step s130, the display mode of a progression indicator is changed in accordance with a difference between the location of the third read-out pointer and the fourth read-out pointer. The fourth read-out pointer is advanced in an automatic performance process, which will be described later, and is advanced synchronized with the original progression of the melody part. The display mode of the progression indicator may be changed in the following manner. For example, the progression indicator is lighted blue when the location of the third read-out pointer and the fourth read-out pointer are generally the same; the progression indicator is flashed blue when the position of the third read-out pointer is substantially delayed with respect to the position of the fourth read-out pointer; and the progression indicator is lighted red when the position of the third read-out pointer is substantially advanced with respect to the position of the fourth read-out pointer. As a result, the player readily understands if his performance is appropriate, too fast or too slow and therefore the performance by the player is facilitated.

Figure 25:
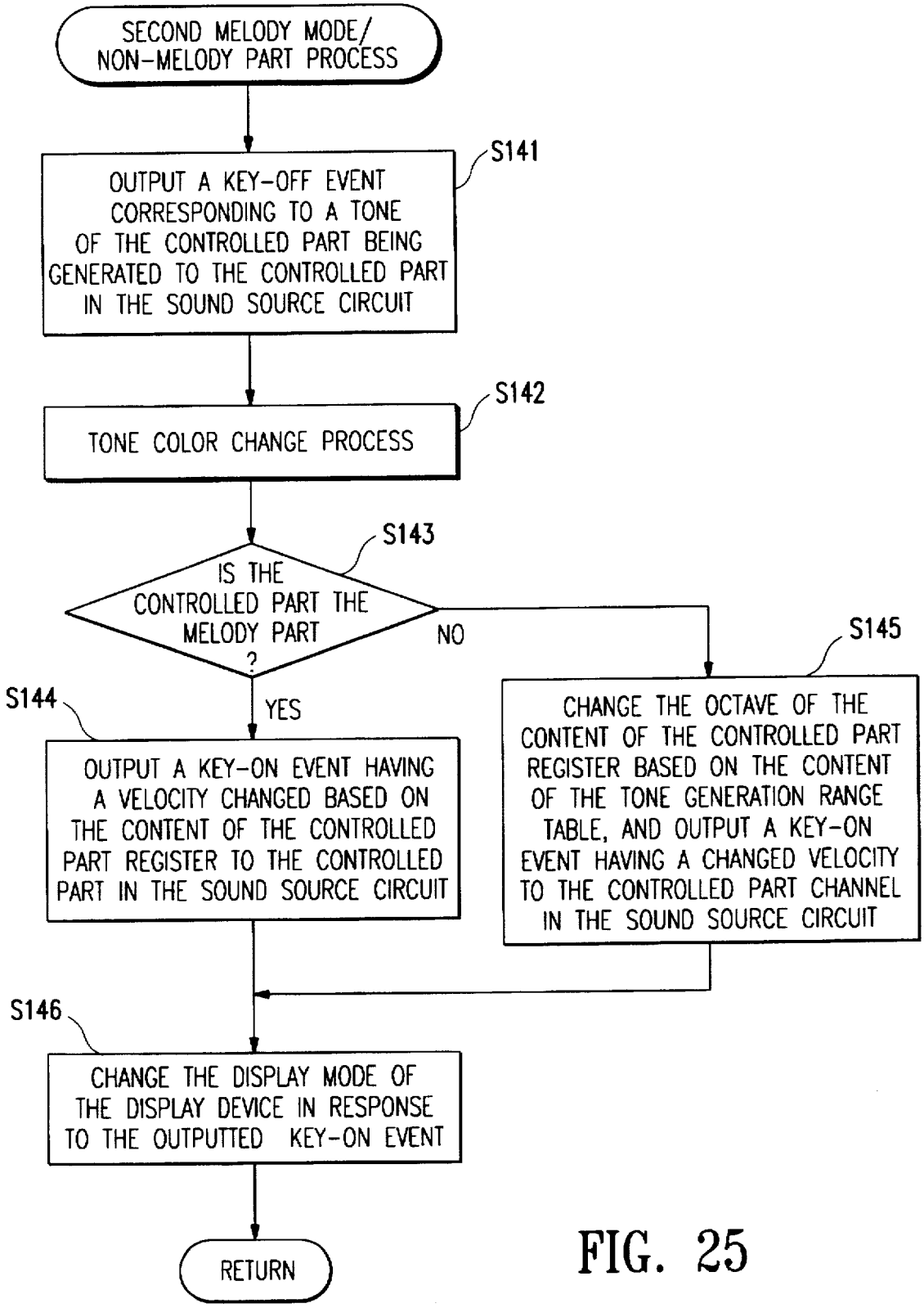
FIG. 25 is a flow chart of a second melody mode and non-melody part process in accordance with an embodiment of the present invention.

FIG. 25 shows, in detail, a flow chart representative of the second melody mode and non-melody part process executed in step s131 described above. In step s141, if there is a tone of the controlled part that is being generated, a key-off event corresponding to the tone is outputted to a channel for the controlled part in the sound source to mute the tone. It is noted that, when the tone has already been muted by the operation of the mute switch, the process in this step is not executed. In step s142, the tone color changing process shown in either FIG. 26 or FIG. 27 is executed. Next, in step s143, a determination is made whether the controlled part is the melody part. When it is the melody part, a velocity value in key-on event is replaced by the velocity value obtained by the pad operation based on the content of a controlled part register, and the key-on event is outputted to a channel for the melody part in the sound source circuit. Accordingly, musical notes representative of the melody data that are successively read out and correspond to the current position of progression of the piece of music are generated upon operation of the pad. In this manner, the melody performance is performed. The controlled part register stores note events of the controlled part, that are read out, at the current position of progression of the piece of music (which will be described later in detail).

On the other hand, when the controlled part is other than the melody part, the process proceeds to step s145. In step s145, if necessary, the following process is executed: an octave for the key chord of note events stored in the controlled part register is changed on the basis of the content of the tone range control table and the content of the fret position register FRET; a velocity value in a key-on event is replaced by the velocity value obtained by the pad operation; and the key-on event is outputted to a channel for the controlled part in the sound source circuit. By this process, upon operation of the pad, at least a tone of either the base part, the first chord part or the second chord part having a pitch at the current position of progression of the piece of music is generated in an octave that is changed based on the location of the fret switch operated. In this manner, the backing performance is performed. The process then proceeds to step s146 in which the display mode of the display element (the rectangle sections shown in FIG. 11) is changed in response to the outputted key-on event.

Figure 28:
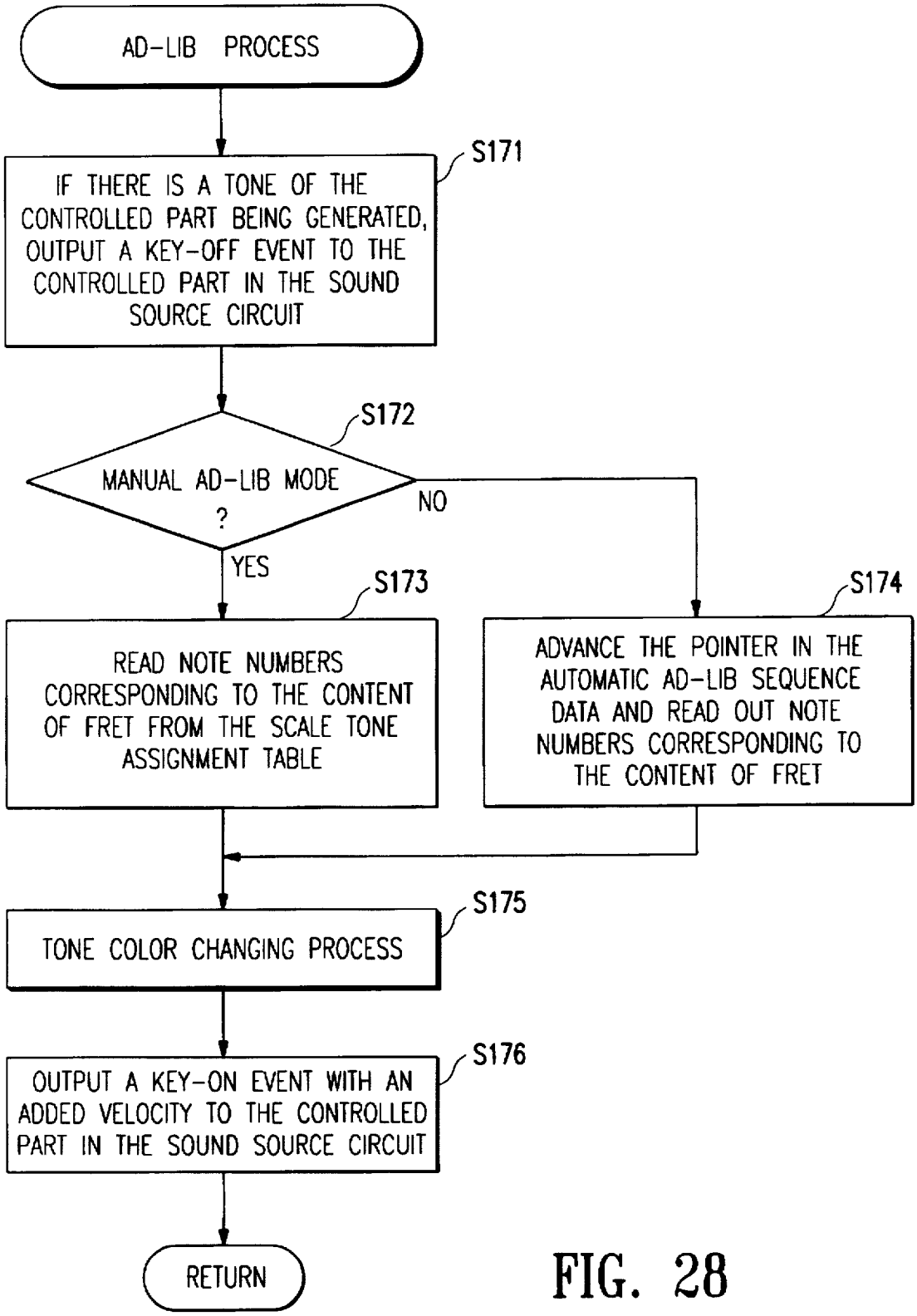
FIG. 28 is a flow chart of an ad-lib process in accordance with an embodiment of the present invention.

FIG. 28 shows, in detail, a flow chart representative of the ad-lib process executed in step s132 described above. In step 171, if there is a tone of the controlled part that is being generated, a key-off event corresponding to the tone is outputted to a channel for the controlled part in the sound source to mute the tone. It is noted that, when the tone has already been muted by the operation of the mute switch, the process in this step is not executed. In step s172, a determination is made whether the manual ad-lib mode is set or the automatic ad-lib mode is set. When the manual ad-lib mode is set, in step s173, note numbers corresponding to the content stored in the fret position register FRET are read out from the selected scale assignment table. On the other hand, when the automatic ad-lib mode is set, in step s174, a read-out pointer in the automatic ad-lib sequence data corresponding to the content stored in the fret position register FRET is advanced and note numbers are read out. In step s175, the tone color changing process shown in either FIG. 26 or FIG. 27 is performed. In step s176, key-on events that formed by adding the velocity values obtained by the pad operation to the note number determined in either step s173 or step s174 are outputted to the melody part channel in the sound source circuit. By this process, an ad-lib performance of the melody part is performed.

Next referring to FIGS. 29 through 38, an automatic performance process that is executed at a specified cycle (for example, at every 10 ms) will be described.

Figure 29:
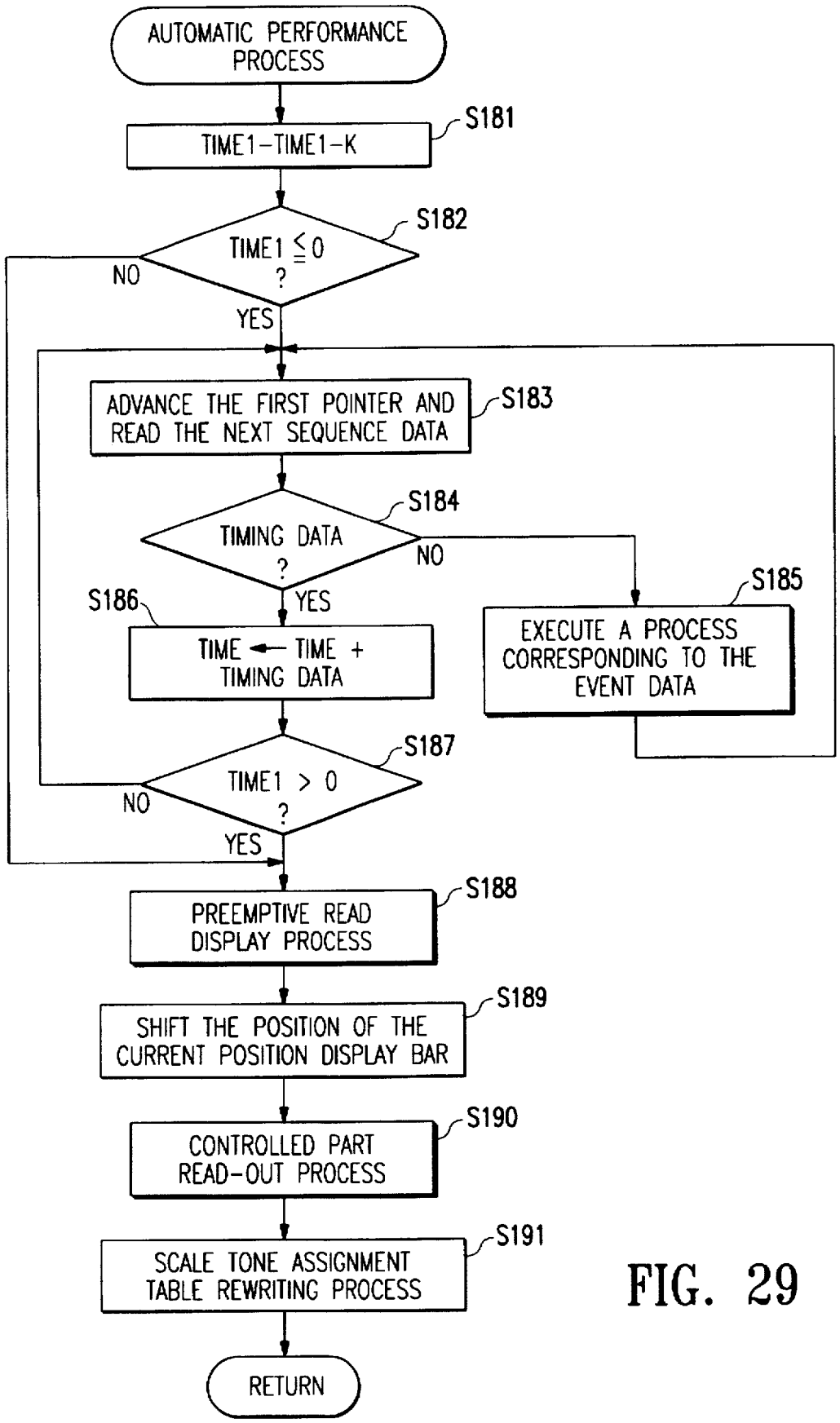
FIG. 29 is a flow chart of an automatic performance process in accordance with an embodiment of the present invention.

Referring to FIG. 29, in step s181, a specified value K is subtracted from a value of the register TIME 1 that stores a timing data read out from the sequence data. The specified value K corresponds to a duration of unit notes that are progressed during a predetermined cycle (for example, 10 ms) of the automatic performance process. The specified value K is defined by K=(tempo×resolution×execution cycle)/ (60×1000), where the "tempo" is the number of quarter notes that are performed in one minute, and the "resolution" represents a number that divides a quarter note to obtain the timing data in the sequence data. For example, when the timing data is defined based on a three hundred eighty fourth (384th) note as a unit note as described above, a three hundred eighty fourth (384th) note is obtained by dividing a quarter note by 96. In this case, the resolution is "96". The "execution cycle" is a process cycle for executing the automatic performance process. As described above, in accordance with an embodiment of the present invention, the execution cycle is 10 ms. Therefore, when the "tempo", the "resolution" and the "interrupt cycle" are 120, 96 and 10 ms, respectively, the value K is 1.92. Accordingly, the timing data is advance by 1.92 in a single cycle of the automatic performance process. This means that, when the value of the timing data is 192 (corresponding to a time duration of a half note), the performance for a time duration of a half note is progressed in 100 cycles of the automatic performance process. In other words, by changing the value K, the reproducing tempo can be changed. In alternative embodiments, the tempo of the performance can be changed in a variety of different ways. For example, the execution cycle of the automatic performance process may be changed, or the value of the timing data may be changed without changing the execution cycle. It is noted that first timing data in the sequence data (not shown) is set as an initial value of the register TIME 1 at the time performance is started.

When the value of the register TIME 1 becomes 0 or less, as a result of the process executed in step s118, a determination "YES" is made in step s182. In step s183, the first read-out pointer is advanced and sequence data indicated by the pointer is read out. In step s184, a determination is made whether the read data is timing data. Since the leading timing data has already been read out when the performance is started, event data that is stored next to the timing data is read out in step s183. Therefore, a determination "NO" is made in step s184, and the process proceeds to step s185.

In step s185, a process corresponding to the event data read out is executed. The process in step s 85 will be described later. After step s185, the process returns to step s183, wherein the first read-out pointer is advanced and the next data is read out. Since timing data is stored next to the event data, a determination "YES" is made in step s184. In step s186, the timing data read out is added to the value stored in the register TIME 1. When the value of the register TIME 1 is a positive value as a result of the addition of the timing data, the process proceeds to step s188. When note event data and lyric event data are successively stored, or note event data for a chord is stored, the value of the timing data may become "0" or near "0". In such cases, a determination "NO" is made in step s187, and the process in step s183 through step s187 is repeated.

In step s188, a preemptive reading display process (described later) is executed. Then, in step s189, a display bar indicating the position of the current progression is shifted toward the right-hand side by an amount corresponding to the execution cycle of the automatic performance process (for example 10 ms), and in step s190, a controlled part read out process (described later) is executed. Then, in step s191, the scale assignment table is revised. It is noted that, among the scales in the scale assignment table, the scale for the chord composing tones and the scale for the melody composing tone are required to be revised with the progression of the piece of music to a current scale. Accordingly, in the scale assignment table revising process, when the current position of progression of the piece of music is at a chord changing position, the scale for the chord composing tones is changed to a scale corresponding to the changed chord; and when the current position of progression of the piece of music is at a phrase cutting position, the scale for the melody composing tones is changed to a scale corresponding to the current phrase. A determination as to whether it is at the code changing position or at the phrase cutting position may be made in the following manner. For example, when a chord progression is detected in step s15 and a phrase is extracted in step s16 as described above with reference to FIG. 13, the chord changing position and the phrase cutting position at that moment are stored. The current position of progression is managed by the automatic performance process shown in FIG. 29, and the chord changing position and the phrase cutting position are compared with the current position of progression of the piece of music to make the determination.

Figure 30:
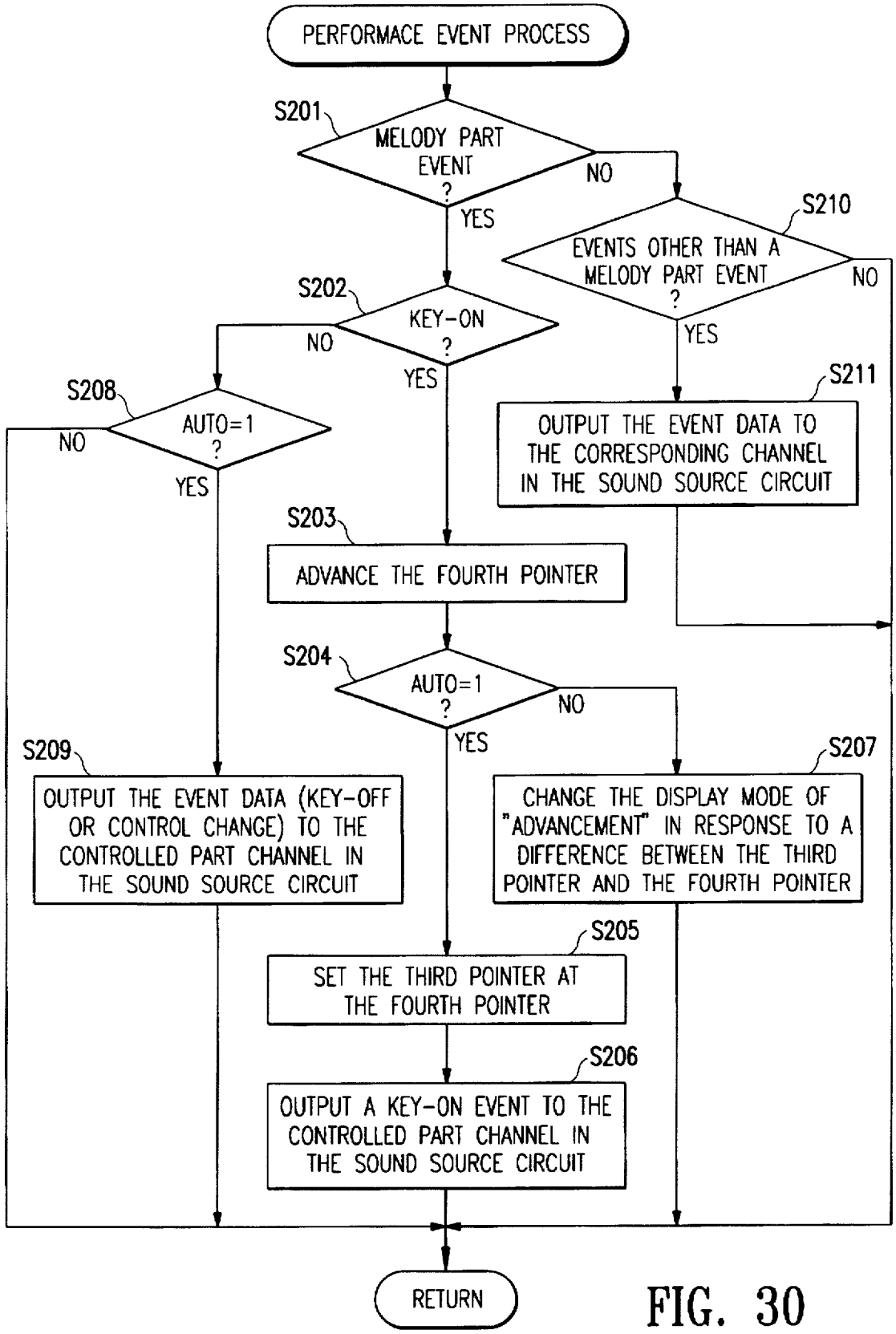
FIG. 30 is a flow chart of a performance event process in accordance with an embodiment of the present invention.

FIG. 30 shows a flow chart of a performance event process that is a part of the "process responsive to the event data" executed in the above step s185. In step s201, a determination is made as to whether the read event data is event data of the melody part. Since each event data has a channel number attached to it, the channel number is detected and a determination is made based on the detected channel number as to which of the parts the event belongs. When the read event data is event data in the melody part, a determination is made in step s202 whether the event data is representative of a key-on event. When it is a key-on event, the fourth read-out pointer is advanced in step s203. By this process, the fourth read-out pointer is advanced, synchronized with the correct position of progression of the piece of music. A determination is made in step s204 whether the flag AUTO is set to "1". When it is set to "1", the process proceeds to step s205, wherein the third read-out pointer is set to the position of the fourth read-out pointer. By this process, the automatic performance of the melody part is also advanced with the third read-out pointer synchronized with the original position of progression of the piece of music. By operating the pad at a later time, the performance in the first melody mode can be resumed at a position corresponding to the original position of progression. In step s206, the key-on event data is outputted to the channel for the melody part in the sound source circuit to generate a tone of the melody part. When the flag is not set to "1", in step s207, the display mode of the "progression" indicator is changed in response to a difference between the third and the fourth read-out pointers in a similar manner as in step s130 described above. Because the player is performing the melody part by operating the pad, the data is not outputted to the sound source circuit.

When a determination is made in step s202 that the read event data is not key-on event data (namely, when the read data is representative of a key-off event or a control change event), the process proceeds to step s208 wherein a determination is made whether the flag AUTO is set to "1". When it is set to "1", in step s209, the event data is outputted to the channel for the melody part in the sound source circuit to mute the tone of the melody part or to control the loudness, the pitch or the tone color. When the flag AUTO is not set to "1", the data is not outputted to the sound source circuit because the player is performing the melody part by operating the pad.

On the other hand, when a determination is made that the event data is other than those of the melody part, a determination is made in step s210 whether the event data is other than those of the controlled part. When the event data is other than those of the controlled part, in step s211, the event data is outputted to a corresponding channel in the sound source circuit to generated tones, mute tones or the like. When the data is event data of the controlled part, the data is not outputted to the sound source circuit because the tones are being generated by the player's pad operation.

Figure 31:
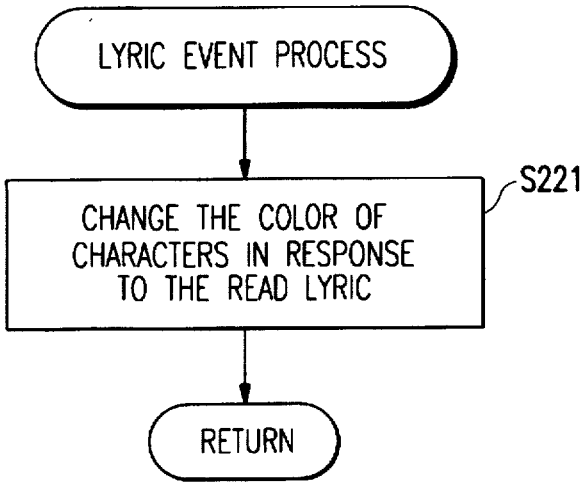
FIG. 31 is a flow chart of a lyric event process in accordance with an embodiment of the present invention.

FIG. 31 shows a flow chart of a lyric event process that is a part of the "process responsive to the event data" executed in the above step s185. In step s221, the color of lyric characters is changed in response to the lyric data read out to indicate the current position of progression of the lyric. In embodiments, the color of lyric characters may be changed successively from the left-hand side or may be changed at once.

Figure 32:
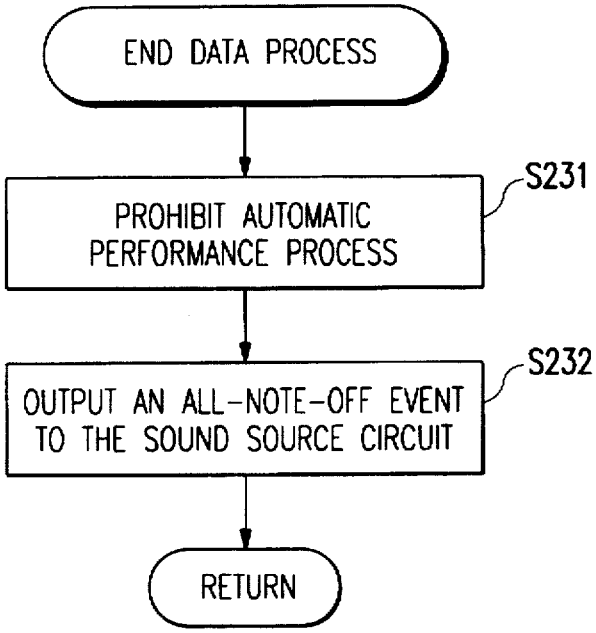
FIG. 32 is a flow chart of an end data process in accordance with an embodiment of the present invention.

FIG. 32 shows a flow chart of an end data process that is a part of the "process responsive to the event data" executed in the above step s185. The automatic performance process is prohibited in step s231, and an all-note-off event is outputted to the sound source circuit s232. As a result, the automatic performance is stopped.

Figure 33:
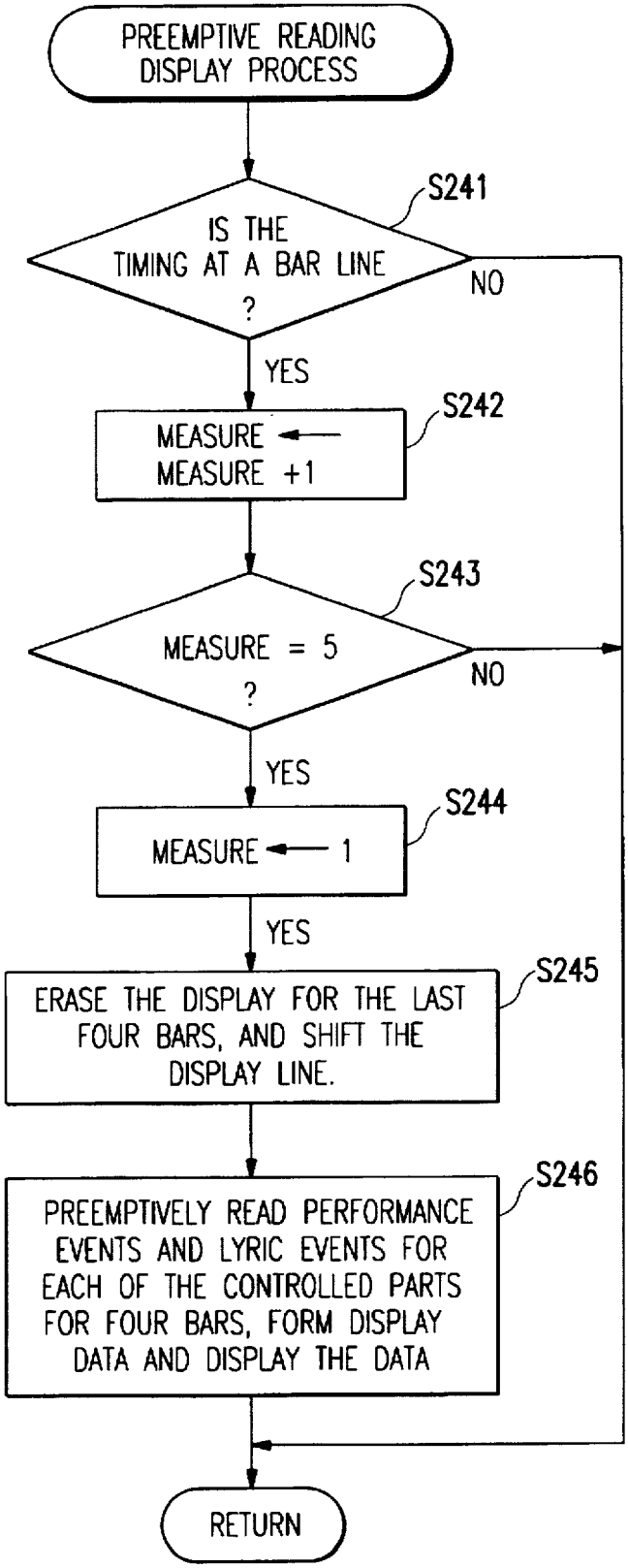
FIG. 33 is a flow chart of a preemptive reading and display process in accordance with an embodiment of the present invention.

FIG. 33 shows, in detail, a flow chart of the preemptive read-out display process executed in step s188 described above. A determination is made in step s241 whether the current position of progression is at a timing corresponding to a bar line. If the timing is at the bar line, a value stored at the bar count register MEASURE is incremented by one in step s242. A determination is made in step s243 whether the value is five. If the value is five, the value at the register MEASURE is set to one in step s244, and the past four bars, that are displayed in one display stage, are erased and a new set of bars is shifted to the display stage in step s245. In step s246, performance event data and lyric event data for four bars in each of the controlled parts are preemptively read out from the sequence data; display data for display is formed based on the read data; and the display data is displayed on the monitor apparatus D. In this embodiment, data for four bars is displayed in each of a plurality of display stages (for example, two display stages). Each time the performance for four bars is completed, the display for the oldest four bars is erased, and performance data and lyric data for four bars ahead from the present position are preemptively read and displayed. When the display for the past four bars in a first stage is erased, an empty display region is created in the first stage. Then, the display that has been shown on a second stage is shifted to the empty display region for displaying data for the newest four bars. It should be noted that the display method is not limited to the above-described embodiment.

Figure 34:
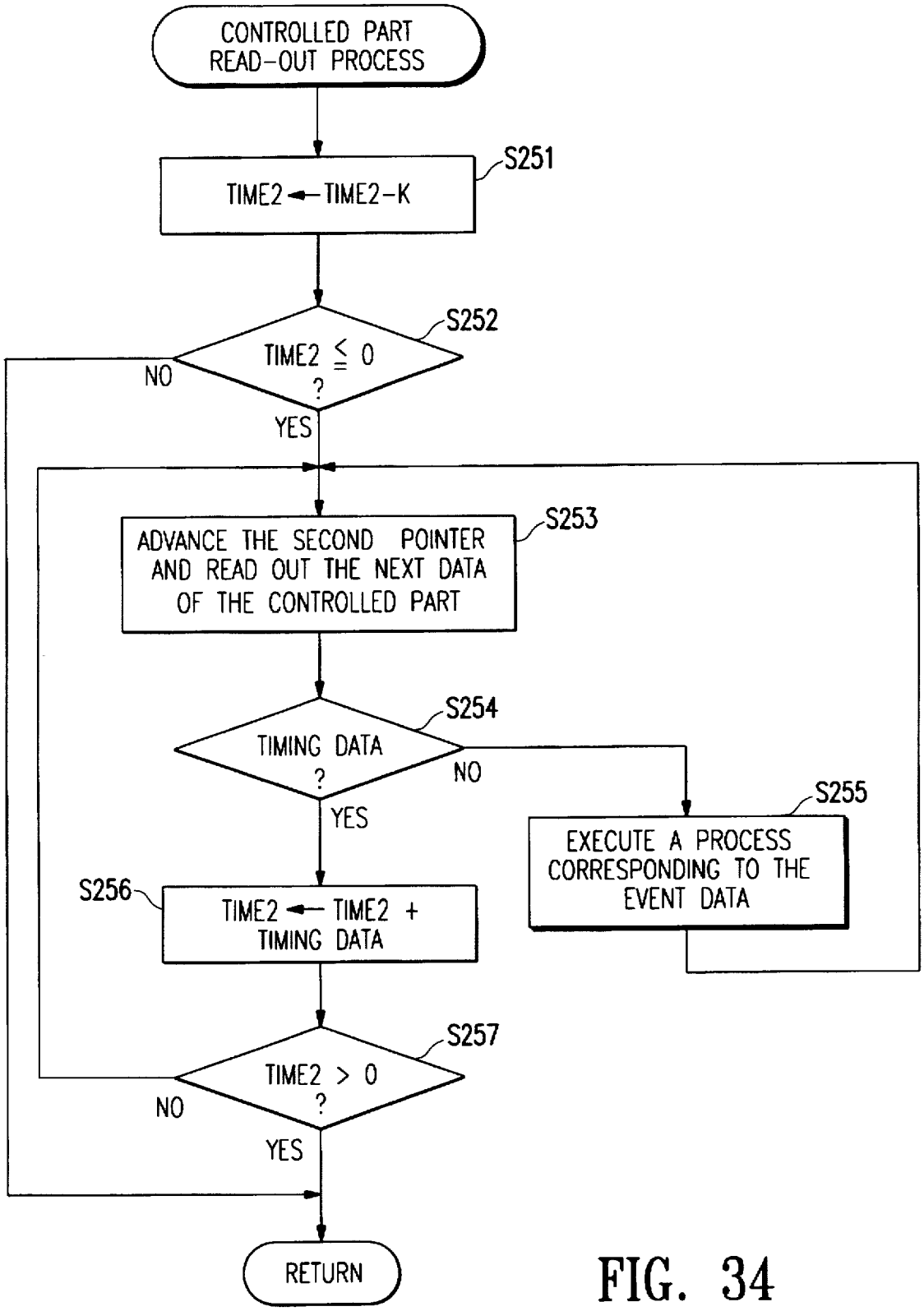
FIG. 34 is a flow chart of a controlled part read-out process in accordance with an embodiment of the present invention.

FIG. 34 shows, in detail, a flow chart of the controlled part read-out process executed in step s190 described above. In step s251, a specified value is deducted from the value stored in the register TIME 2 that stores timing data read out from the controlled part data. The specified value K is the same value that is deducted in step S181. Timing data in the controlled part data is set in the register TIME 2 (not shown) as an initial value at the time the performance is started.

When the value at the register TIME 2 is zero or less as a result of the process in step s251, a determination "YES" is made in step s252. The second read-out pointer is advanced and controlled part data indicated by the pointer is read out in step s253. A determination is made in step s254 whether the read out data is timing data. Since the leading timing data is read out at the time the performance is started, event data, that is stored next to the timing data, is read out. Therefore, a determination "NO" is made in step s254 and the process proceeds to step s255.

In step s255, a process in response to the read event data is executed. The process in step s255 will be described later. After step s255, the process returns to step s253, wherein the second read-out pointer is advanced and next data is read out. Since timing data is stored next to the event data, a determination "YES" is made in step s254. The read timing data is added to the value of the register TIME 2 in step s256. When the value of the register TIME 2 is positive as a result of the addition of the timing data, this process is completed. When note event data are successively stored, the value of the timing data becomes zero or near zero. In such circumstances, a determination "NO" is made in step s257, and the process in step s253 and thereafter is repeated.

Figure 35:
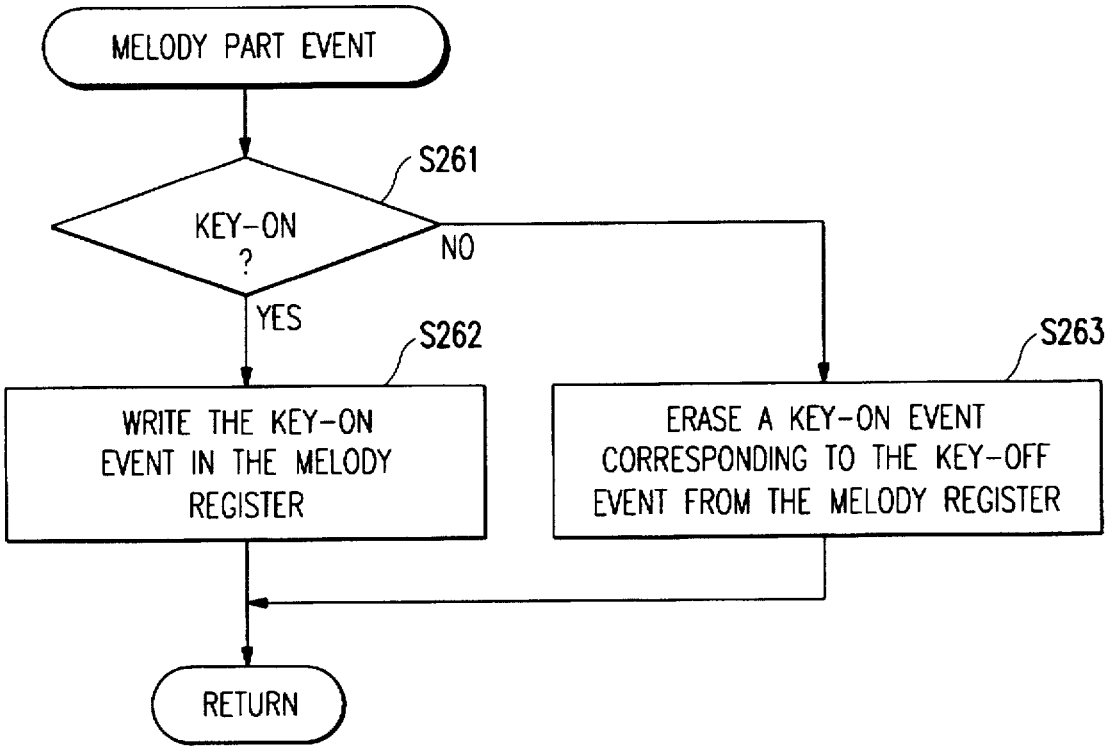
FIG. 35 is a flow chart of a melody part event process in accordance with an embodiment of the present invention.

FIGS. 35 through 38 show, in detail, a flow chart of "the process in response to the read event data" that is executed in step s255 described above. FIG. 35 shows a flow chart of a process that is executed when event data of the melody part is read out. First, a determination is made in step s261 whether the read event data is representative of key-on event data. When it is key-on event data, the key-on event data is written in a melody register in step s262. On the other hand, when it is key-off event, the process proceeds to step s263. In step s263, key-on event data, that has been stored in the melody register and corresponds to the key-off event data, is erased from the melody register. The melody register has a plurality of memory regions for storing key events whose tones are to be generated at a current position of progression of the piece of music. When key-on event data is read out, the key-on event data is written in this register. When key-off event data is read out, key-on event data corresponding to the key-off event data is erased from this register. Basically, a single tone is generated for the melody part. However, for a duet, a plurality of tones may be simultaneously generated. Considering such circumstances, a plurality of memory regions are provided. When the pad is operated in the second melody mode, the content of this register is read out in step s144 described above and a tone for the content is generated.

Figure 36:
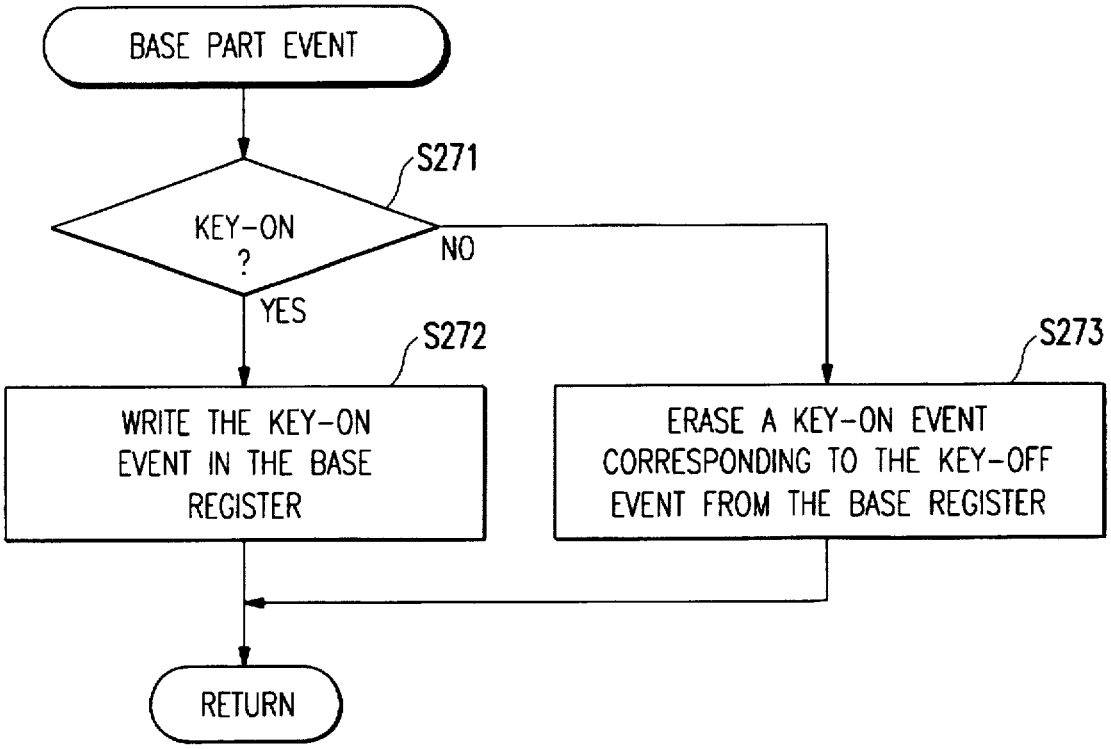
FIG. 36 is a flow chart of a base part event process in accordance with an embodiment of the present invention.

FIG. 36 shows a flow chart of a process that is executed when event data for the base part is read out. First, a determination is made in step s271 whether the read event data is representative of a key-on event. When the read event data is representative of a key-on event, the key-on event is written in a base register in step s272. On the other hand, when it is a key-off event, the process proceeds to step s273. In step s273, the key-on event, that has been stored in the base register and corresponds to the key-off event, is erased from the base register. The base register has the same functions as those of the above-described melody register. When the pad is operated in the base performance mode, the content of this register is read out in step s144 described above and a tone for the content is generated.

Figure 37:
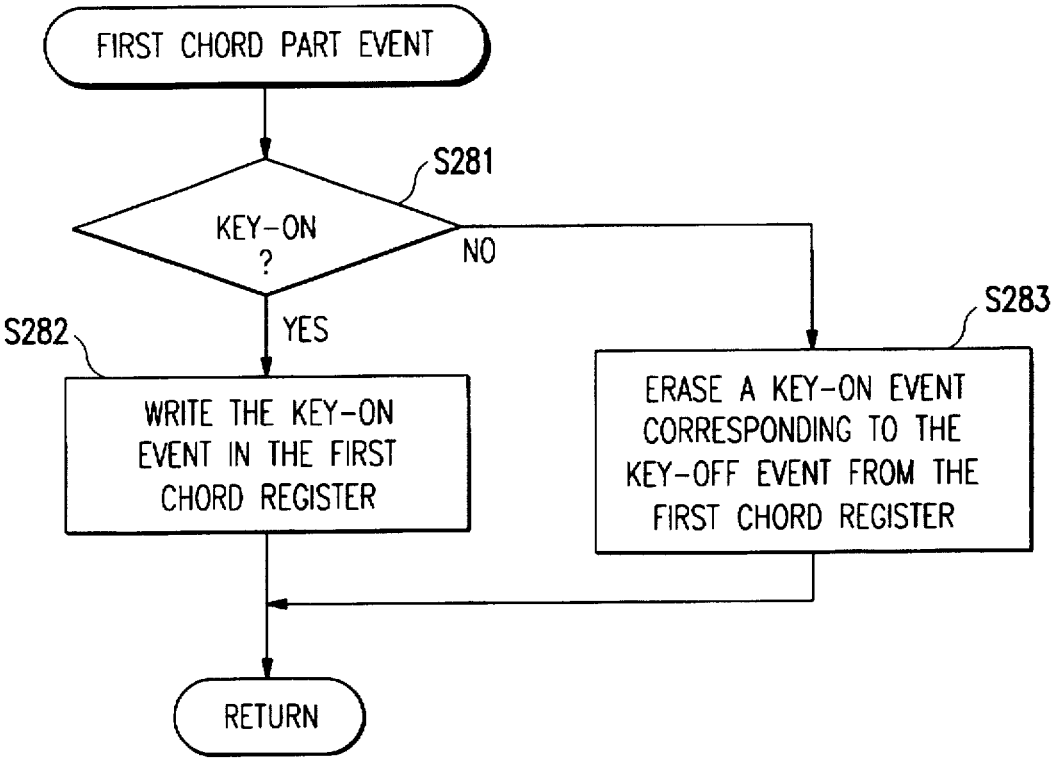
FIG. 37 is a flow chart of a first chord part event process in accordance with an embodiment of the present invention.

FIG. 37 shows a flow chart of a process that is executed when event data for the first chord part is read out. First, a determination is made in step s281 whether the read event data is representative of a key-on event. When it is a key-on event, the key-on event is written in a first chord register in step s282. On the other hand, when it is a key-off event, the process proceeds to step s283. In step s283, the key-on event, that has been stored in the first chord register and corresponds to the key-off event, is erased from the first chord register. The first chord register also has the same functions as those of the above-described melody register. When the pad is operated in the first chord performance mode, the content of this register is read out in step s144 described above and a tone for the content is generated.

Figure 38:
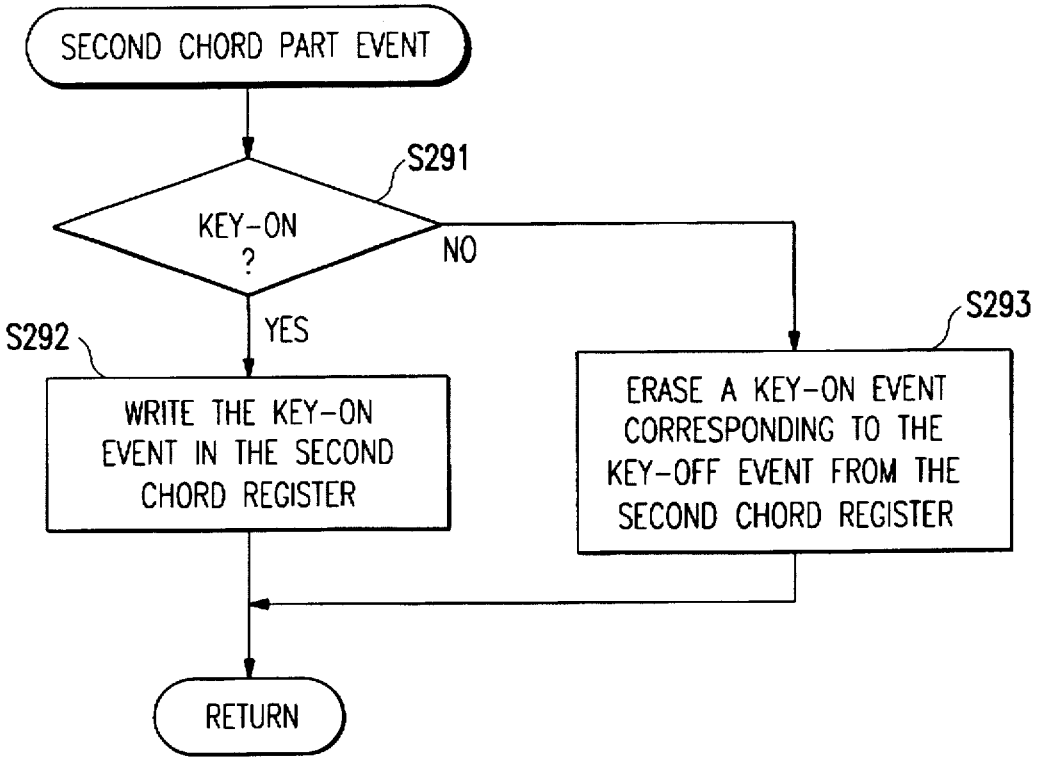
FIG. 38 is a flow chart of a second chord part event process in accordance with an embodiment of the present invention.

FIG. 38 shows a flow chart of a process that is executed when event data for the second chord part is read out. First, a determination is made in step s291 whether the read event data is representative of a key-on event. When the read event data is representative of a key-on event data, the key-on event data is written in a second chord register in step s292. On the other hand, when it is representative of a key-off event, the process proceeds to step s293. In step s293, the key-on event, that has been stored in the second chord register and corresponds to the key-off event, is erased from the second chord register. The second chord register also has the same functions as those of the above-described melody register. When the pad is operated in the second chord performance mode, the content of this register is read out in step s144 described above and a tone for the content is generated.

Figure 39:
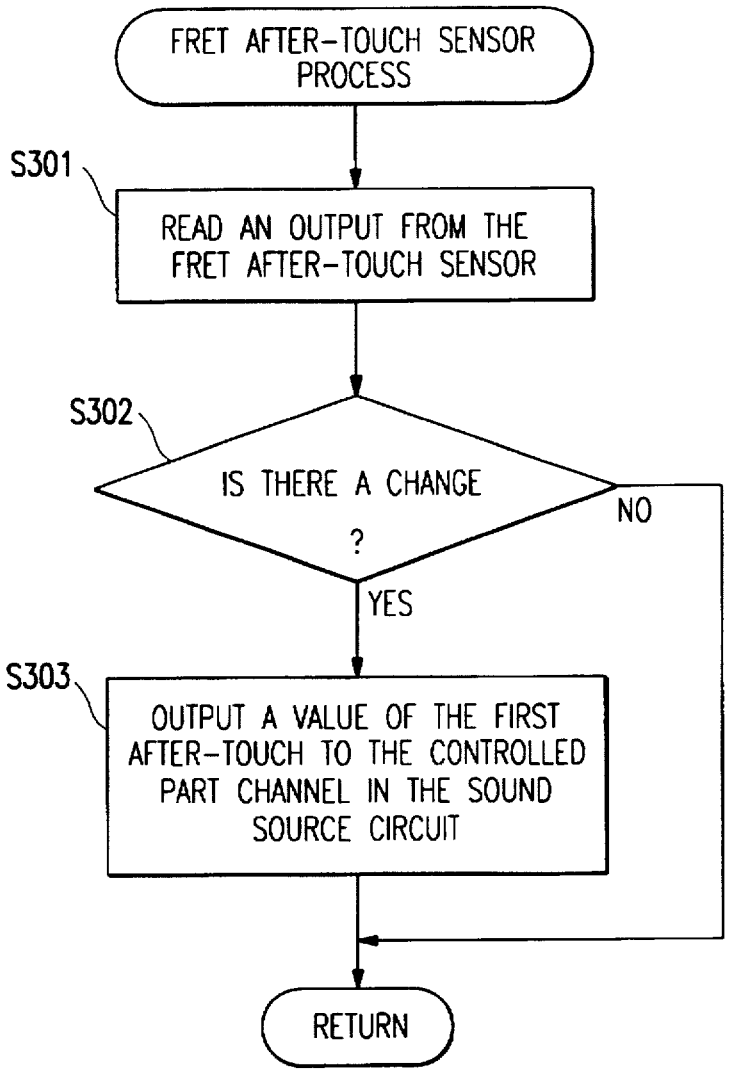
FIG. 39 is a flow chart of a fret after touch sensor process in accordance with an embodiment of the present invention.

Referring to FIGS. 39 through 43, other processes that are executed in response to the operation of other sensors will be described. Each of the processes is executed at a specified cycle (for example, at each 10 ms). FIG. 39 shows a flow chart of a process executed in response to a fret after-touch sensor. In step s301, an output from the fret after-touch sensor is read. A determination is made in step s302 whether there is a change in the sensor output from the fret after-touch sensor. When there is a change, in step s303, the output value from the fret after-touch sensor is defined as a first after-touch value and is outputted to a corresponding channel for the controlled part in the sound source circuit. The first after touch value can be used to control any of musical parameters. In one embodiment, the value is used to control the depth of vibrato. In this case, by changing the pressure force applied to a fret, the depth of vibrato can be controlled.

Figure 40:
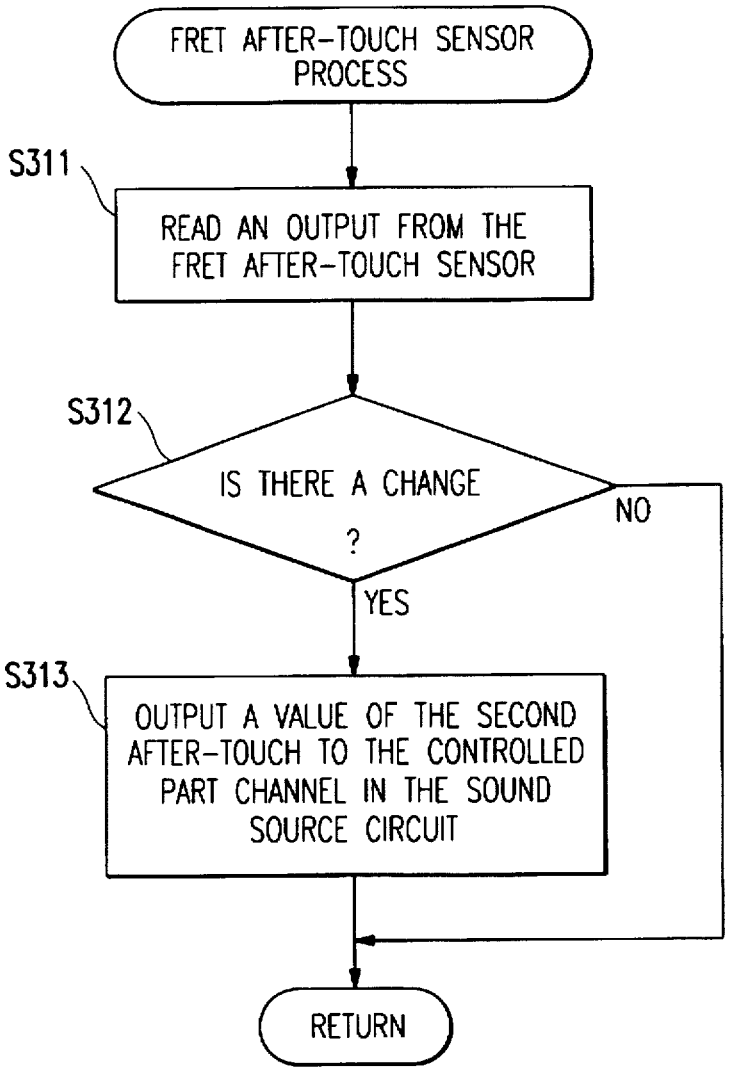
FIG. 40 is a flow chart of a pad after touch sensor process in accordance with an embodiment of the present invention.

FIG. 40 shows a flow chart of a process that is executed in response to a pad after-touch sensor. In step s311, an output from the pad after-touch sensor is read. A determination is made in step s312 whether there is a change in the sensor output. When there is a change, the output value from the pad after-touch sensor is defined as a second after-touch value and is outputted to a channel for the controlled part in the sound source circuit, in step s313. The second after-touch value can be used to control any of musical parameters. In one embodiment, the value is used to control the loudness. In this case, the pad is operated in a manner that, after striking the pad to generate a tone, the pad is further depressed. As a result, the loudness of the tone is controlled after the pad is struck. It should be noted that the pad after-touch sensor and the pad striking sensor are different type sensors, and that, in a preferred embodiment, the pad striking sensor should not respond well to the pad depressing operation.

Figure 41:
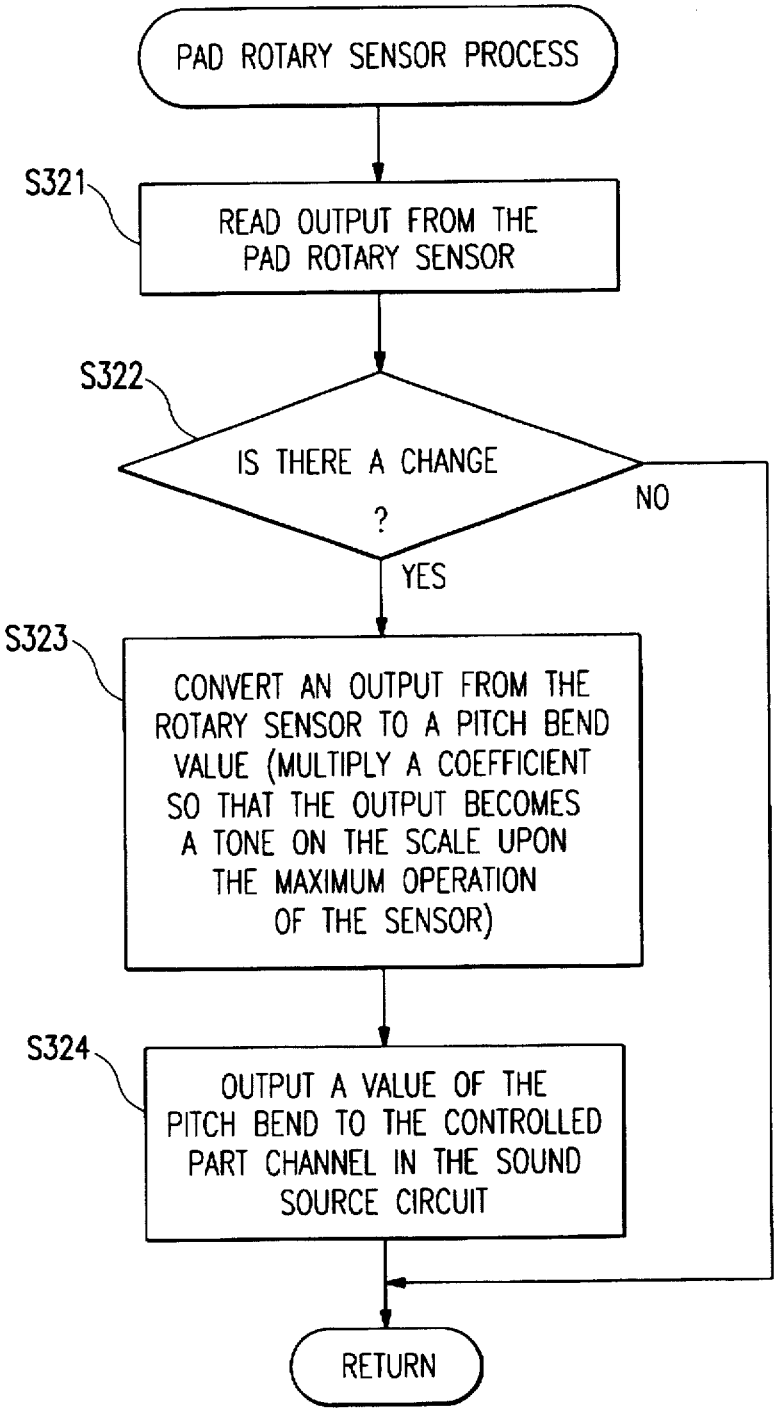
FIG. 41 is a flow chart of a pad rotary sensor process in accordance with an embodiment of the present invention.

FIG. 41 shows a flow chart of a process that is executed in response to a pad rotary sensor. In step s321, an output from the pad rotary sensor is read. A determination is made in step s322 whether there is a change in the sensor output. When there is a change, the output value from the rotary sensor is converted to a pitch bend value in step s323. At this moment, the pitch bend value is multiplied by a specified coefficient that is defined in accordance with the key of the piece of music and the pitch of a tone being currently generated so that the generated tone reaches a tone on the scale for the key of the piece of music when the pad rotary sensor is rotated to its maximum limit. As a result, when the pad rotary sensor is operated to its maximum limit, a generated tone always reaches a tone on the scale. Consequently, even a beginner player can perform a piece of music that sounds musically correct. Then, the pitch bend value, that is multiplied by the coefficient, is outputted to a corresponding channel for the controlled part in the sound source circuit. When the pad rotary sensor is rotated when no tone is generated, and then the pad is operated while the rotary sensor is in that operated condition, what coefficient should be multiplied is not known for finally obtaining a pitch that is on the scale. In such a case, a coefficient is not multiplied, and the sensor output is directly used as a pitch bend value.

Figure 42:
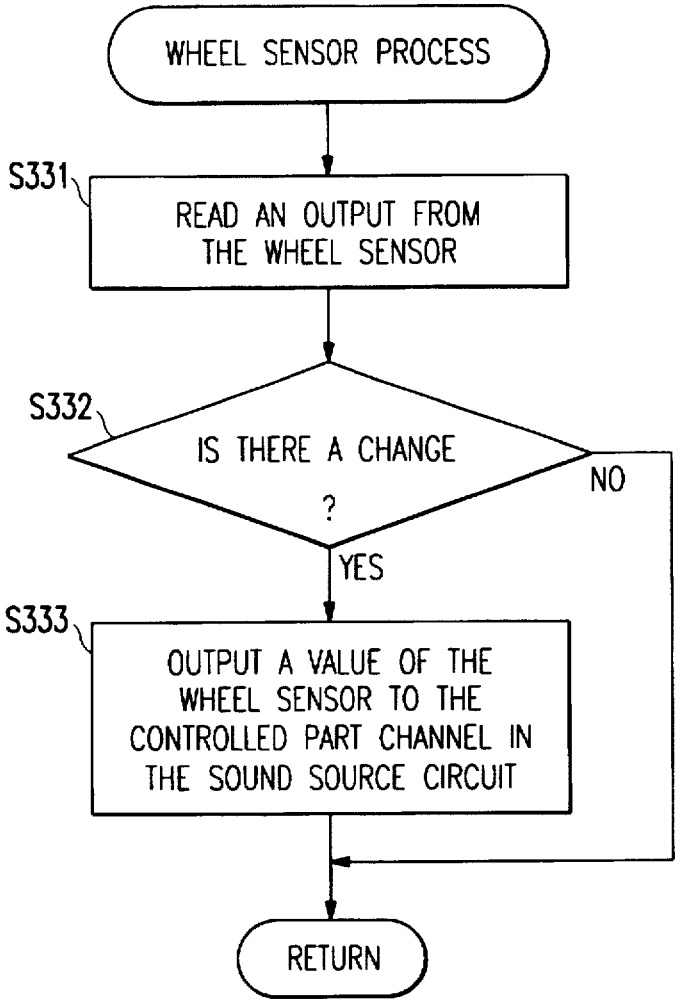
FIG. 42 is a flow chart of a wheel sensor process in accordance with an embodiment of the present invention.

FIG. 42 shows a flow chart of a process that is executed in response to a wheel sensor. In step s331, an output from the wheel sensor is read. A determination is made in step s332 whether there is a change in the output from the wheel sensor. When there is a change, the output value from the wheel sensor is defined as a wheel value and is outputted to a corresponding channel for the controlled part in the sound source circuit, in step s333. The wheel value can be used to control any of musical parameters. In one embodiment, the value is used to control the filter cut-off frequency. As a result, when the wheel adjacent the pad is operated after striking the pad, the color tone of a generated tone can be controlled.

Figure 43:
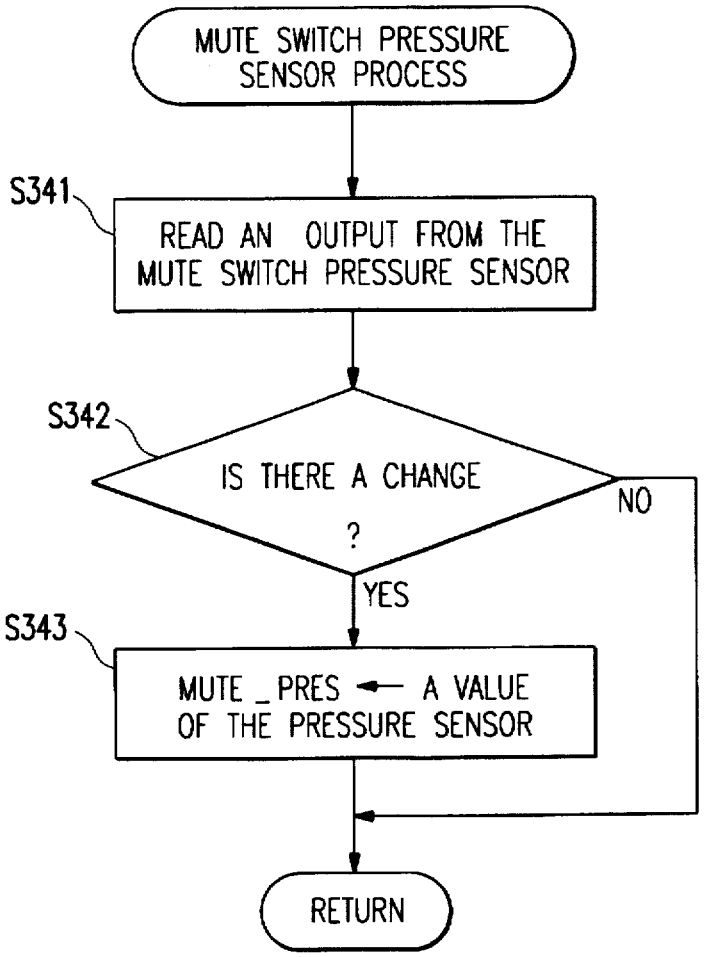
FIG. 43 is a flow chart of a mute switch pressure sensor process in accordance with an embodiment of the present invention.

FIG. 43 shows a flow chart of a process executed in response to a mute switch pressure sensor. In step s341, an output from the mute switch pressure sensor is read. A determination is made in step s342 whether there is a change in the output from the mute switch pressure sensor. When there is a change, the output value from the mute switch pressure sensor is stored in a register MUTE_PRES in step s343. The value stored in the register MUTE_PRES is used for tone control when the pad is operated.

Figure 44A:
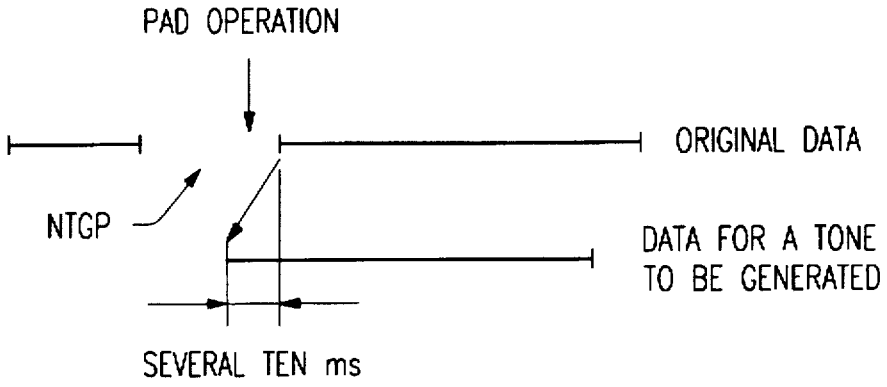
FIGS. 44 (A) and 44 (B) show methods of determining a note event when the pad is operated during a no-tone generating period of performance data in accordance with embodiments of the present invention.
Figure 44B:
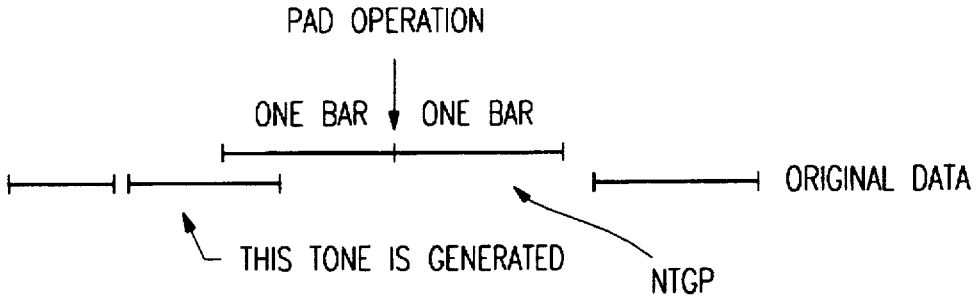

In the above-described embodiments, controlled part data which does not have data for no-tone generation periods is made in advance, and the melody part in the second melody mode, the base part, the first chord part and the second chord part are performed based on the controlled part data. However, in alternative embodiments, such controlled part data may not be formed in advance. Instead, note events to be generated can be searched when the pad is operated if the pad is operated during a no-tone generating period. For example, the following alternative methods, which will be described with reference to FIGS. 44 (A) and 44 (B), may be used, (1) When the pad is operated during a no-tone generating period NTGP as shown in FIG. 44 (A), the data is searched if there is data for a note event (note-on) for a tone that is to be generated in a first specified period of time (for example, within several ten ms). When there is note event data within the first specified period of time, a tone of the note event is generated (see FIG. 44 (A)).

(2) When a note event is not found in the above step (1), the data is searched if there is a note event within a second specified period of time before and after the moment the pad is operated (for example, within a single bar). Namely, when the pad is operated during a no-tone generating period NTGP as shown in FIG. 44 (B), and there is no data for a note event for a tone that is to be generated within several ten ms, the data is searched if there is a note event within a single bar before and after the moment the pad is operated. When there are note events, a tone of the closest one of the note events is generated (see FIG. 44 (B)).

(3) When note events are not found in the above step (2), tones in the parts other than the controlled part are searched, a chord is detected based on the tones that are found, and at least one of the chord composing tones is generated. (One tone is generated for the melody part or the base part, and a plurality of tones are generated for the first chord part and the second chord part.) Other embodiments of the present invention will be described below. The following embodiments are different from the above-described embodiment in the following points:

(1) Scale tones and chord tones are determined without performing strict key detection or chord detection.

(2) The ad-lib performance mode is automatically set when the pad is operated while any one of the fret switches is depressed, and the sequence performance mode is automatically set when the pad is operated without depressing any of the fret switches.

(3) When any of the fret switches is switched off in the ad-lib performance mode, a tone that is being generated is automatically shifted to a closest higher pitch tone among tones of the automatic performance that are being generated. This operation is defined as an ad-lib follow-up mode and continues until any one of the fret switches is operated again or the pad is operated.

Figure 45:
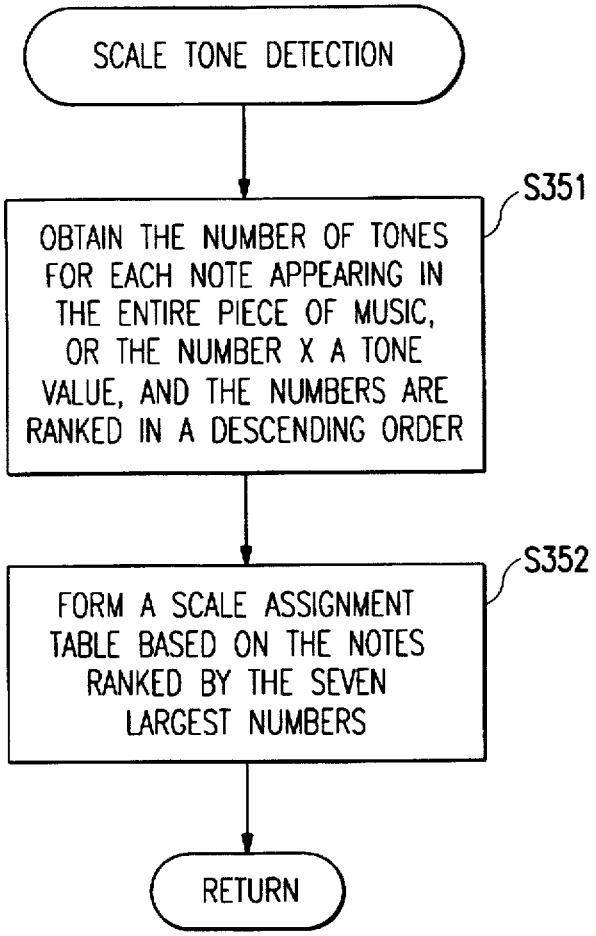
FIG. 45 is a flow chart of a scale tone detection process in accordance with an embodiment of the present invention.

Referring to FIGS. 45 through 51, other embodiments of the present invention will be described. It is noted that only portions that are different from the apparatus described above will be described below. FIG. 45 shows a flow chart of a scale tone detection process. The scale tone detection process is executed in place of the key detection processes in step s14 through the scale assignment table forming process in step s17 shown in FIG. 13. In step s351, the number of each type of notes that appear in the entire piece of music or a value defined by "the number of each type of notes x a tone value (the duration of a tone)" is calculated for each of the notes, and the numbers are ranked in a descending order. In step s352, seven notes that are ranked by the associated seven largest numbers are determined as scale tones. A scale assignment table is formed based on the determined scale tones. Namely, the seven notes that most frequently appear in the performance are assumed to be substantially equivalent to scale tones of the key of the piece of music, and the seven notes are defined as the scale notes of the piece of music. By this operation, a complex key detection algorithm is not required, and the apparatus is simplified.

Figure 46:
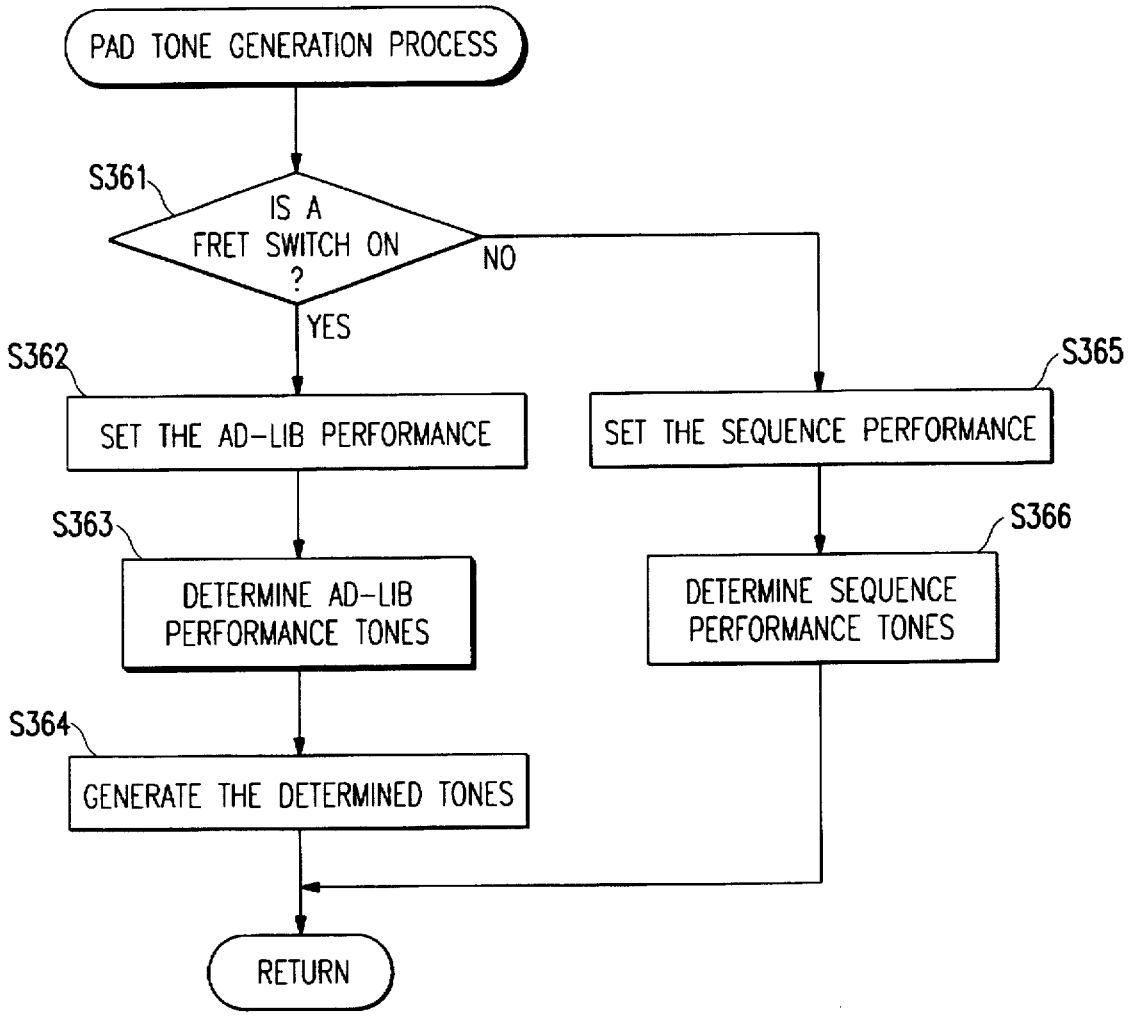
FIG. 46 is a flow chart of a pad tone generation process in accordance with an embodiment of the present invention.

FIG. 46 shows a flow chart of a pad tone generation process. This process is executed in place of the process described above with reference to FIG. 24. In step s361, a determination is made whether any one of the fret switches is turned on. When the fret switch is turned on, the ad-lib performance mode is set and, at the same time, the ad-lib follow-up mode (described later) is released in step s362. Thereafter, an ad-lib performance tone determining process is performed to determine tones for an ad-lib performance in step s363, and the determined tones are generated in step s364. On the other hand, when the pad is operated while all the fret switches are turned off, the sequence performance mode is set in step s365, and tones for the sequence performance are generated in step s366. The process performed in step s366 is the same as the process performed in the sequence mode, and therefore the detailed description is omitted.

Figure 47:
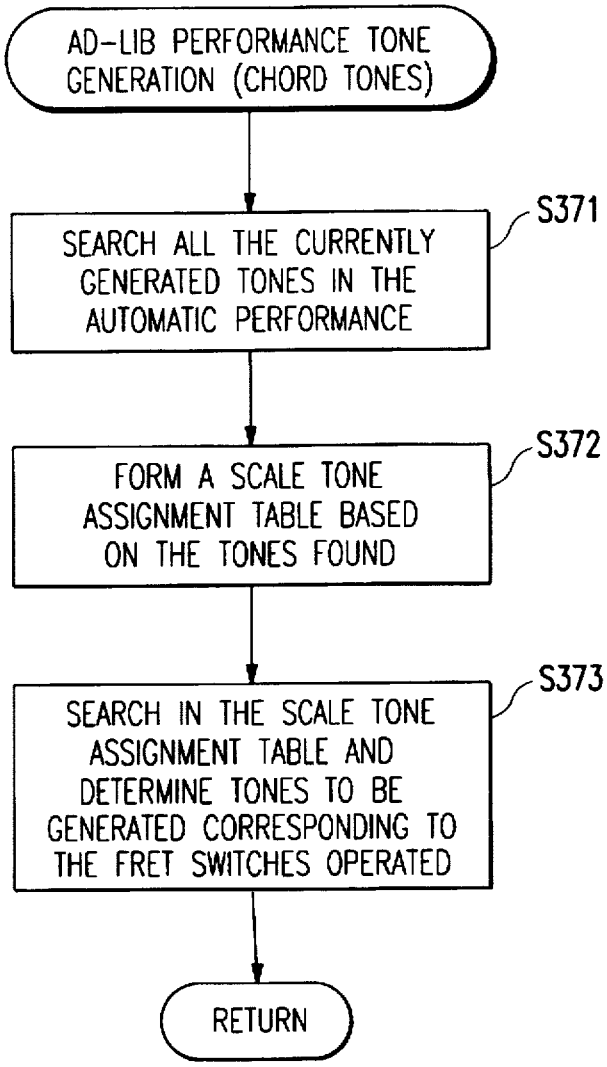
FIG. 47 is a flow chart of an ad-lib performance tone (chord tone) determining process in accordance with an embodiment of the present invention.

FIG. 47 shows a flow chart of the ad-lib performance tone determining process executed in step s363 above in accordance with an embodiment of the present invention. In this embodiment, tones are generated with chord composing notes. In step s371, all notes that are being generated in the automatic performance (including all the parts except the drum part) are searched. In step s372, a scale assignment table is formed based on the notes that are found. Namely, all the notes that are generated when the pad is operated are assumed to be substantially equivalent to the chord composing tones at the time the pad is operated. As a result, a complex chord detection algorithm is not required and thus the apparatus is simplified. In an alternative embodiment, notes, that are generated in a specified period of time (for example, one beat) including the moment the pad is operated, may be detected and defined as the chord composing notes at the time the pad is operated. In step s373, tones corresponding to the fret being operated are searched from the tone assignment table and the tones to be generated are determined.

Figure 48:
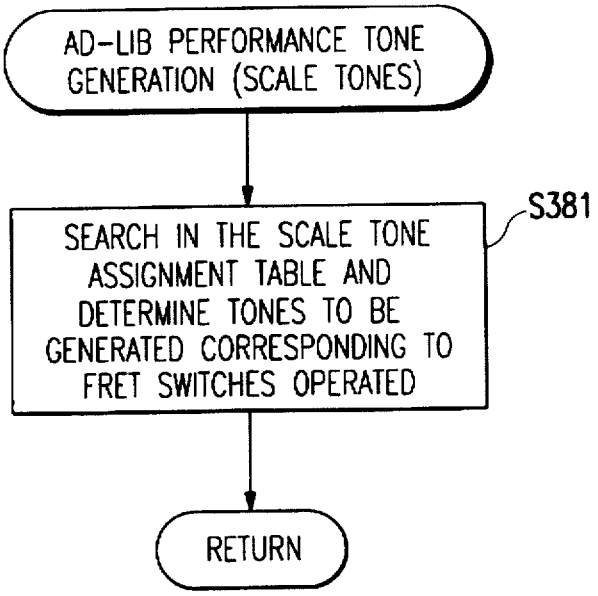
FIG. 48 is a flow chart of an ad-lib performance tone (scale tone) determining process in accordance with an embodiment of the present invention.

FIG. 48 shows a flow chart of the ad-lib performance tone determining process executed in step s363 above in another embodiment. In this embodiment, tones are generated with scale composing notes. The scale assignment table for the scale composing notes is formed in the above-described step s352. Accordingly, in step s381, tones corresponding to the fret being operated are searched from the scale assignment table, and the tones to be generated are determined.

Figure 49:
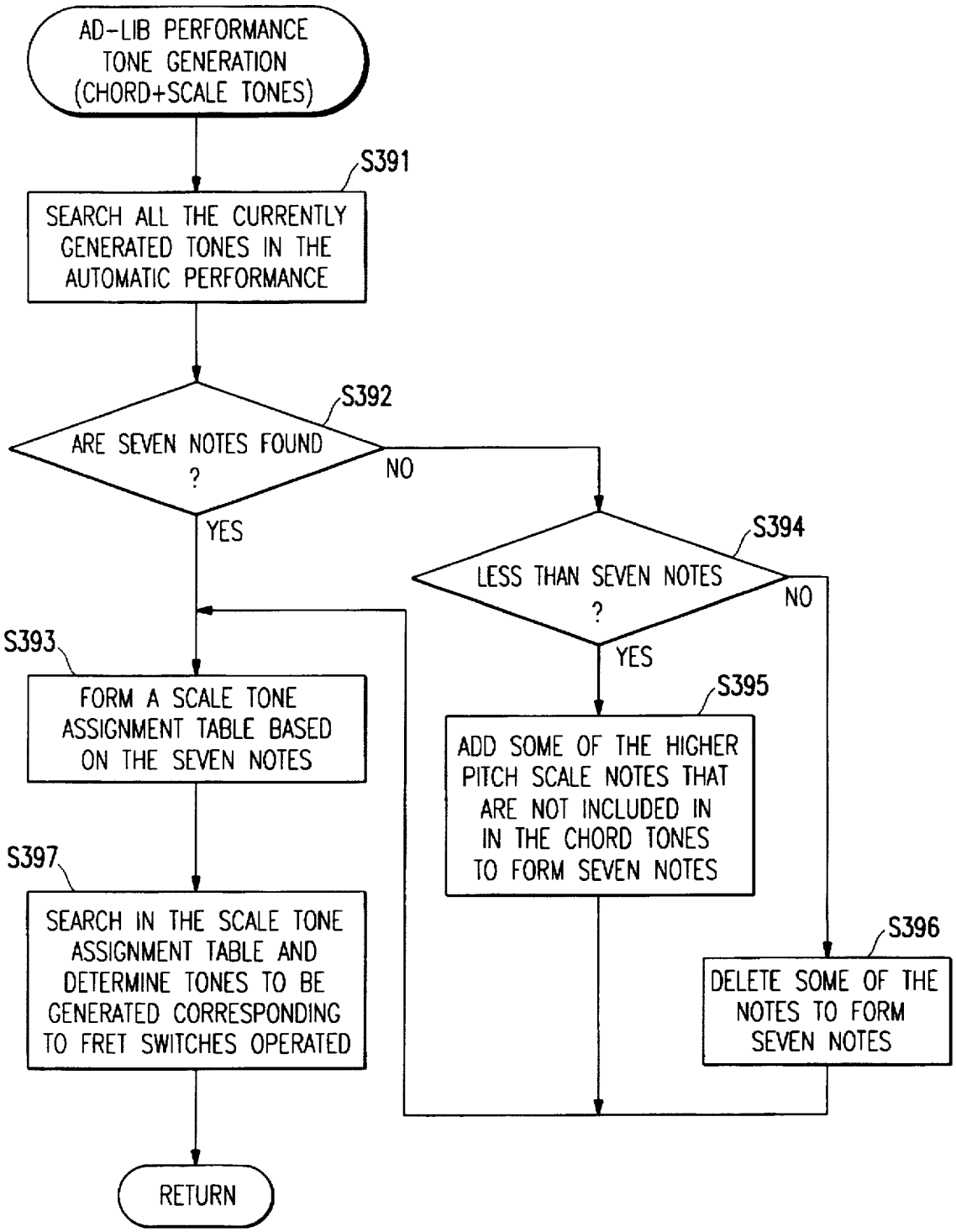
FIG. 49 is a flow chart of an ad-lib performance tone (chord tone+scale tone) determining process in accordance with an embodiment of the present invention.

FIG. 49 shows a flow chart of the ad-lib performance tone determining process executed in step s363 above in accordance with still another embodiment of the present invention. In this embodiment, tones are generated with mixed chord composing tones and scale composing tones. Namely, when less than seven notes or more than eight notes are being generated in the automatic performance, the scale tones are considered to define seven notes. In step s391, all notes that are being generated in the automatic performance are searched. A determination is made in step s392 whether the notes found are seven notes. When there are seven notes, a scale assignment table is formed in step s393 based on the seven notes. When a determination is made in step s392 that there are not seven notes, a determination is made in step s394 whether there are less than seven notes or more than seven notes. When there are less than seven notes, in step s395, higher pitch notes among the scale notes that are not included in the chord notes are added to the notes to define seven notes in total. When a determination is made in step s394 that there are more than seven notes, certain notes are deleted from the notes to define seven notes in total. In this case, notes that are not among higher pitch notes are deleted on a priority basis. A scale assignment table is formed in step s393 based on the thus defined seven notes. Thereafter, in step s397, tones corresponding to the fret being operated are searched from the scale assignment table, and the tones to be generated are determined. As a result, the following advantages are provided. When a scale is determined based only on scale composing notes, the scale does not change with the progression of the performance of the piece of music. Accordingly, tones which do not match a chord may possibly be generated at the time the pad is operated. On the other hand, when a scale is determined based only on chord composing notes, scales successively change with the chord progression. As a result, tones generated at the operation of the pad match chords very well. However, only chord composing tones are generated and the ad-lib performance becomes relatively monotonous and poor in expression. On the other hand, when notes missing from the chord notes are supplemented by scale composing notes, tones that match the chord progression are generated at a higher probability, and tones not present in the chord composing tones may be occasionally generated. As a result, a monotonous ad-lib performance can be avoided. Moreover, when the scale composing tones are added, generated tones do not sound musically wrong.

Figure 50:
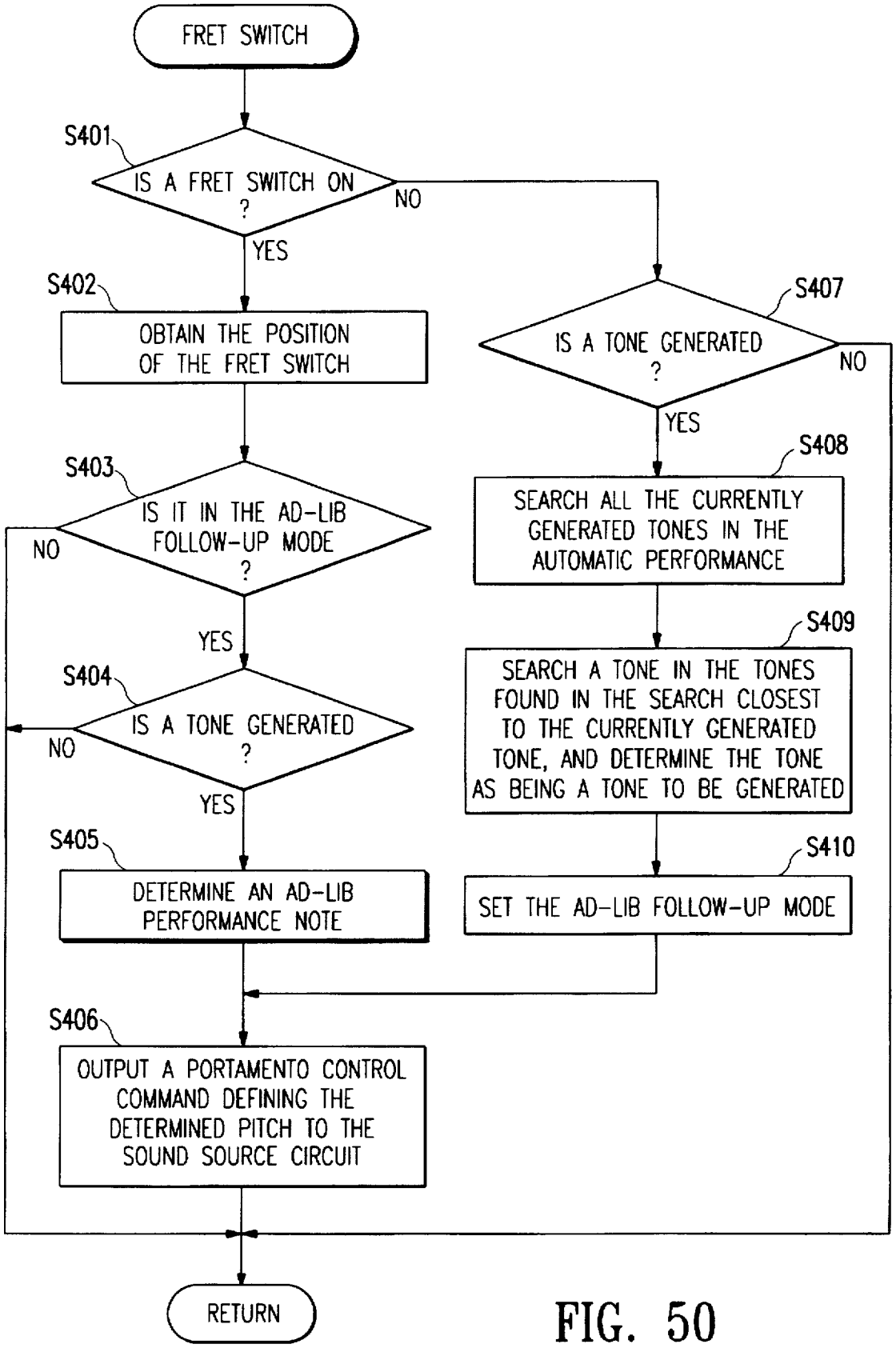
FIG. 50 is a flow chart of a fret switch process in accordance with an embodiment of the present invention.

FIG. 50 shows a flow chart of a fret switch process. This process is executed in place of the fret switch process described above with reference to FIG. 22. In step s401, a determination is made whether a fret switch is turned on or turned off. When the fret switch is turned on, the position of the fret switch is obtained. A determination is made in step s403 whether the ad-lib follow-up mode is currently set, and a determination is made in s404 whether tones are currently being generated. When both of the determinations in step s403 and step s404 are "YES", the above-described ad-lib performance tone determining process is executed to determine a pitch in step s405. Then, in step s406, a portamento control command defining a determined pitch is outputted to the sound source circuit. In response to the command, a tone that is being generated is smoothly shifted to the pitch determined in step s405. The ad-lib follow-up mode is effective in the following situation. Tones generated by the ad-lib performance are composed of non-chord composing tones. Therefore, if the tones are continuously generated for a relatively prolonged period of time, the tones become out of harmony with the other parts of the automatic performance and offensive to the ears. In order to prevent this situation, the ad-lib follow-up mode is automatically started, if the fret switch has been turned off and a determination is made that the ad-lib performance not be continued.

On the other hand, when a determination is made in step s401 that the fret switch is turned off, a determination is made in s407 whether a tone is currently generated. When the mute switch has been operated before the fret switch is turned off, a determination in step s407 is "NO". In cases other that this particular case, a determination "YES" is made. In step s408, all tones that are currently generated in the automatic performance are searched, and quasi-chord composing tones at the present time are detected. In step s409, one of the detected tones that is closest to the tone being currently generated is determined as a tone to be newly generated. Then, in step s410, the ad-lib follow-up mode is set.

Figure 51:
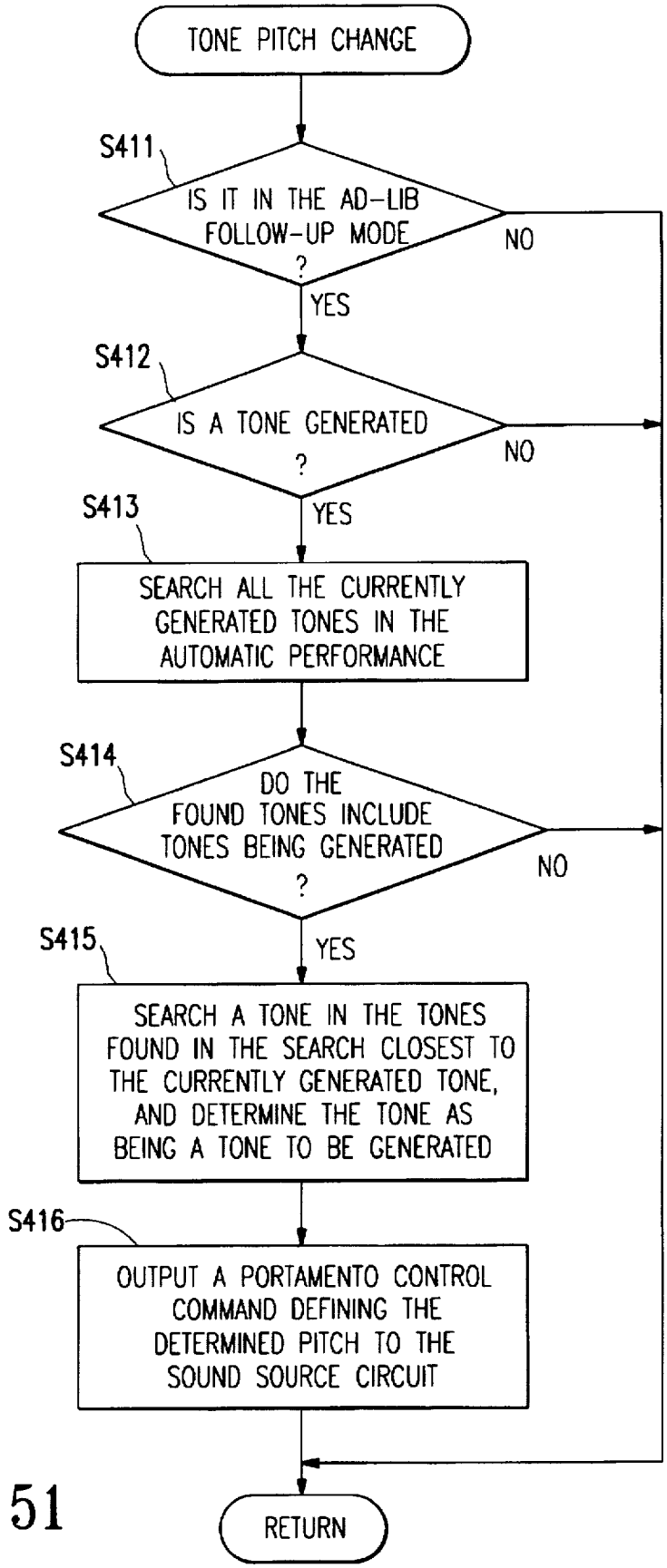
FIG. 51 is a flow chart of a generate tone pitch changing process in accordance with an embodiment of the present invention.

FIG. 51 shows a flow chart of a tone pitch changing process, that is executed at a specified cycle (for example, at every 100 ms). The tone pitch changing process does not correspond to any one of the embodiment processes described above. The tone pitch changing process is executed for the ad-lib follow-up mode. In step s411, a determination is made whether the ad-lib follow-up mode is set. When the ad-lib follow-up mode is set, a determination is made in step s412 whether a tone of the ad-lib performance is currently generated. If the tone is currently generated, all tones being currently generated in the automatic performance are searched in step s413. In step s414, a determination is made whether the currently generated tone of the ad-lib performance is found in tones found in the search. When such a tone is not found, one of the tones found in the search that is closest to the currently generated tone of the ad-lib performance is searched and is determined as a tone to be newly generated. In step s416, a portamento control command defining a pitch that is determined is outputted to the sound source circuit. As a result, a tone that has been generated is smoothly changed to the determined pitch.

While the description above refers to particular embodiments of the present invention, it will be understood that many modifications may be made without departing from the spirit thereof. For example, the following variations are also possible.

In the above embodiments, only a single row of fret switches are disposed. In an embodiment, a plurality of rows of fret switches may be provided in a similar arrangement as guitar strings. In an ad-lib performance in accordance with this arrangement, each row of the fret switches is assigned with a different scale or a different tone range. In a sequence performance mode, each row of the fret switches is assigned with a different part or a different tone range. The fret section can be composed of not only switches but also other devices, such as, piezoelectric sensors.

In the performance in the second melody mode or in the performance of the backing part, if a next tone is read out in response to the pad operation within a specified period of time from the moment the generation of a previous tone is started, a pitch of the tone being generated may be shifted to a pitch of the next tone from the moment the pad is operated. In other words, even when the pad is operated a little earlier than it should be to start generation of a pitch of the next tone, the performance with the intended pitch is provided.

In the above-described embodiments, control change data included in controlled part data are ignored. However, in alternative embodiments, these data may be used.

In the above-described embodiments, a velocity value provided by the operation of the pad is used as a velocity value of a note event. However, a velocity value included in a note event may be directly used. Alternatively, a velocity value provided by the operation of the pad and a velocity value of a note event may be mixed and an intermediate value of these two velocity values may be used.

The shape of the apparatus is not limited to that of a guitar. The operation member is not limited to the pad. Instead, a switch may be used. What is important is that the apparatus has at least an operation member for a performance, such as, for example, a pad, a keyboard, or the like.

All the functions described above may not necessarily be implemented in a single electronic musical instrument. Instead, each of the functions may be implemented independently.

In addition to supplying music data by a memory cartridge, such data may be supplied through a MIDI interface, or through any one of a variety of communication devices. Furthermore, an arrangement may be made to display a background image.

In one embodiment, the quality of performance by a player may be rated. Also, the rating result may be reflected on the control of each of the modes. For example, when the rating is good, the current performance mode may be changed to a mode of a more advanced performance method. On the other hand, when the rating is poor, the current performance mode may be changed to a mode of an easier performance method. Further, when the rating is good, the sound of clapping hands may be generated. On the other hand, when the rating is poor, the sound of booing may be generated. Also, when the rating is poor during a performance by a player, the performance by the player may be changed to an automatic performance.

The switches may be assigned to any type of intended operation. In other words, what functions are executed by what operations, and the like, may be optionally decided. A plurality of electronic musical instruments may be connected to one another, and each of the electronic musical instruments is assigned to a different part so that an ensemble performance is performed. In this case, performance data is exchanged between the electronic musical instruments to achieve an overall control of the operations of all the electronic musical instruments. Alternatively, the control may be performed centrally by one of the musical instruments, and the other musical instruments may provide only operation data to that musical instrument.

Accordingly, the accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electronic musical instrument comprising:

a first operation member;

a second operation member;

a memory device that stores performance data for a performance;

a sound source circuit;

a reading device that reads out the performance data from the memory device in response to operation of the first operation member and instructs the sound source circuit to generate a tone based on the performance data, wherein, at each operation of the first operation member, the reading device renews a progression position of the performance and gives an instruction to mute a tone that has already been instructed to generate; and a mute instructing device that instructs the sound source circuit to mute the tone in response to operation of the second operation member.

2. An electronic musical instrument comprising:

a first operation member;

a second operation member;

a memory device that stores performance data for a performance;

a sound source circuit;

a reading device that successively reads out the performance data from the memory device with progression of the performance;

a tone generation and muting instructing device that, in response to operation of the first operation member, gives an instruction to the sound source circuit to generate a tone based on the performance data being read out at a time of the operation of the first operation member and gives an instruction to mute a tone that has been previously generated; and a mute instructing device that gives an instruction to the sound source circuit to mute the tone in response to operation of the second operation member.

3. An electronic musical instrument comprising:

a first operation member;

a second operation member;

a memory device that stores first and second performance data for a performance;

a sound source circuit;

a first reading device that reads out the first performance data from the memory device in response to operation of the first operation member and gives an instruction to the sound source circuit to generate a tone based on the first performance data, wherein the first reading device gives an instruction at each operation of the first operation member to renew a progression position of the performance;

a second reading device that successively reads out the second performance data from the memory device and gives an instruction to the sound source circuit to generate a tone based on the second performance data; and a switching device that selectively renders effective the tone based on the first performance data read out by the first reading device and the tone based on the second performance data read out by the second reading device, wherein when the second operation member is operated while the tone caused by the first reading device is rendered effective, the tone caused by the second reading device is rendered effective instead of the tone caused by the first reading device.

4. An electronic musical instrument defined in claim 3, wherein when the first operation member is operated while the tone caused by the second reading device is rendered effective, the tone caused by the first reading device is rendered effective instead of the tone caused by the second reading device.

5. An electronic musical instrument comprising:

a first operation member;

a second operation member;

a memory device that stores performance data for a performance;

a reading device that successively reads out the performance data from the memory device with progression of the performance;

a note pitch changing device that changes a pitch of the performance data read out by the reading device in response to operation of the second operation member;

a sound source circuit; and a tone generation instructing device that, in response to operation of the first operation member, gives an instruction to the sound source circuit to generate a tone based on the performance data being read out at a time of the operation of the first operation member and having the pitch changed by the note pitch changing device.

6. An electronic musical instrument comprising:

a first operation member having a plurality of operating sections;

a second operation member;

a memory device that stores performance data for a performance;

a sound source circuit;

an assigning device that determines pitches for a scale matching at least one of a key of the performance data and a chord progression of the performance data and assigns the pitches of the scale to the plurality of operating sections of the first operation member; and a tone generation instructing device that, in response to operation of the second operation member and one of the operating sections of the first operation member, gives an instruction to the sound source circuit to generate at least one tone based on one of the pitches assigned to the one of the operating sections of the first operation member.

7. An electronic musical instrument as defined in claim 6, wherein the assigning device determines a plurality of scales matching at least one of a key of the performance data and a chord progression of the performance data, each of the scales containing a plurality of scale tones, and assigns the plurality of scale tones of one of the determined scales to the plurality of operating positions of the first operation member.

8. An electronic musical instrument comprising:

a first operation member having a plurality of operating positions;

a second operation member;

a memory device that stores performance data for performance;

a sound source circuit;

an assigning device that determines a frequency of appearance of each note included in the performance data and determines a plurality of notes appearing at higher frequencies than other notes within a predetermined frequency range as scale notes for the performance and assigns the scale notes to the plurality of operating positions of the first operation member; and a tone generation instructing device that, in response to operation of the second operation member and one of the plurality of operating positions of the first operation member, gives an instruction to the sound source circuit to generate a tone based on one of the scale notes assigned to the one of the plurality of operating positions of the first operation member.

9. An electronic musical instrument comprising:

a first operation member having a plurality of operating positions;

a second operation member;

a memory device that stores performance data for performance;

a sound source circuit;

a reading device that successively reads out the performance data from the memory device with progression of the performance;

an assigning device that, in response to operation of the second operation member, detects a plurality of notes included in the performance data read out at a time of the operation of the second operation member, determines the detected plurality of notes as chord composing notes that form a chord and assigns the determined chord composing notes to the plurality of operating positions of the first operation member; and a tone generation instructing device that, in response to operation of the second operation member and one of the plurality of operating positions of the first operation member, gives an instruction to the sound source circuit to generate a tone based on a note pitch assigned to the one of the plurality of operating positions of the first operation member.

10. An electronic musical instrument comprising:

a first operation member having a plurality of operating positions;

a second operation member;

a memory device that stores performance data for performance;

a reading device that successively reads out the performance data from the memory device;

a sound source circuit;

a scale determining device that determines a frequency of appearance of each note included in the performance data and determines a plurality of notes appearing at higher frequencies than other notes within a predetermined frequency range as scale composing notes forming a scale for the performance;

an assigning device that detects, in response to operation of the second operation member, a plurality of notes included in the performance data read out from the reading device at a time of operation of the second operation member, determines the detected plurality of notes as chord composing notes that form a chord and assigns the determined chord composing notes to the plurality of positions of the first operation member, wherein when the number of the detected plurality of notes does not reach a specified number appropriate notes are selected from the determined scale composing notes and added to the chord composing notes to reach the specified number; and a tone generation instructing device that, in response to operation of the second operation member and one of the plurality of operating positions of the first operation, gives an instruction to the sound source circuit to generate a tone based on a note pitch assigned to the one of the plurality of operating positions of the first operation member.

11. A method of operating an electronic musical instrument, comprising the steps of:

storing performance data for a performance in a memory;

reading out the performance data from the memory in response to operation of a first operation member and instructing a sound source circuit to generate a tone based on the performance data, wherein at each operation of the first operation member a progression position of the performance is renewed and an instruction to mute a tone that has already been instructed to generate is given; and instructing the sound source circuit to mute the tone in response to operation of a second operation member.

12. A method of operating an electronic musical instrument, comprising the steps of:

storing performance data for a performance in a memory;

successively reading out the performance data from the memory with progression of the performance;

instructing, in response to operation of a first operation member, a sound source circuit to generate a tone based on the performance data being read out at a time of the operation of the first operation member and giving an instruction to mute a tone that has been previously generated; and instructing the sound source circuit to mute the tone in response to operation of a second operation member.

13. A method of operating an electronic musical instrument, comprising the steps of:

storing first performance data and second performance data for a performance in a memory;

reading out the first performance data from the memory in response to operation of a first operation member and instructing a sound source circuit to generate a tone based on the first performance data, wherein at each operation of the first operation member a progression position of the performance is renewed;

successively reading out the second performance data from the memory and giving an instruction to the sound source circuit to generate a tone based on the second performance data; and selectively rendering effective one of the tone based on the first performance data read out and the tone based on the second performance data, wherein when the second operation member is operated while the tone based on the first performance data is rendered effective, the tone based on the second performance data is rendered effective instead of the tone based on the first performance data.

14. A method of operating an electronic musical instrument defined in claim 13, wherein when the first operation member is operated while the tone based on the second performance data is rendered effective, the tone based on the first performance data is rendered effective instead of the tone based on the second performance data.

15. A method of operating an electronic musical instrument, comprising the steps of:

storing performance data for a performance in a memory;

successively reading out the performance data from the memory with progression of the performance;

changing a pitch of the performance data read out in response to operation of a second operation member;

instructing, in response to operation of a first operation member, a sound source circuit to generate a tone based on the performance data read out at a time of the operation of the first operation member and having the changed pitch.

16. A method of operating an electronic musical instrument, comprising the steps of:

providing a first operation member having a plurality of operating sections and a second operation member;

storing performance data for a performance in a memory;

determining pitches for a scale matching at least one of a key of the performance data and a chord progression of the performance data and assigning the pitches of the scale to the plurality of operating sections of the first operation member; and instructing, in response to operation of the second operation member and one of the plurality of operating sections of the first operation member, a sound source circuit to generate one of the pitches assigned to the one of the plurality of operating sections of the first operation member.

17. A method of operating an electronic musical instrument as defined in claim 16, wherein a plurality of scales matching at least one of a key of the performance data and a chord progression of the performance data are determined, each of the scales containing a plurality to scale tones, and the plurality of scale tones of one of the scales is assigned to the plurality of operating positions of the first operation member.

18. A method of operating an electronic musical instrument, comprising the steps of:

providing a first operation member having a plurality of operating positions and a second operation member;

storing performance data for a performance;

determining a frequency of appearance of each note included in the performance data, determining a plurality of notes appearing at higher frequencies than other notes within a predetermined frequency range as scale notes for the performance and assigning the scale notes to the plurality of operating positions of the first operation member; and instructing, in response to operation of the second operation member and one of the plurality of operating positions of the first operation member, a sound source circuit to generate a tone based on one of the scale notes assigned to the one of the plurality of operating positions of the first operation member that is operated.

19. A method of operating an electronic musical instrument, comprising:

providing a first operation member having a plurality of operating positions;

providing a second operation member;

storing performance data for a performance in a memory;

successively reading out the performance data from the memory with progression of the performance;

detecting, in response to operation of the second operation member, a plurality of notes included in the performance data read out at a time of the operation of the second operation member, determining the detected plurality of notes as chord composing notes that form a chord and assigning the determined chord composing notes to the plurality of positions of the first operation member; and instructing, in response to operation of the second operation member and one of the plurality of operating positions of the first operation member, a sound source circuit to generate a tone based on one of the notes assigned to the one of the plurality of operating positions of the first operation member that is operated.

20. A method of operating an electronic musical instrument, comprising the steps of:

providing a first operation member having a plurality of operating positions;

providing a second operation member;

storing performance data for a performance in a memory;

successively reading out the performance data from the memory;

determining a frequency of appearance of each note included in the performance data and determining a plurality of notes appearing at higher frequencies within a predetermined range as scale composing notes forming a scale for the performance;

detecting, in response to operation of the second operation member, a plurality of notes included in the performance data read out at a time of operation of the second operation member, determining the detected plurality of notes as chord composing notes that form a chord and assigning the determined chord composing notes to the plurality of positions of the first operation member, wherein when the number of the detected plurality of notes does not reach a specified number appropriate notes are selected from the determined scale composing notes and added to the chord composing notes to reach the specified number; and instructing, in response to operation of the second operation member and one of the plurality of operating positions of the first operation member, a sound source circuit to generate a tone based on a note pitch assigned to the one of the plurality of operating positions of the first operation member that is operated.

21. A machine readable media containing instructions for causing an apparatus to perform a method of generating musical tones, the method comprising:

storing performance data for a performance in a memory;

reading out the performance data from the memory in response to operation of a first operation member and instructing a sound source circuit to generate a tone based on the performance data, wherein at each operation of the first operation member a progression position of the performance is renewed and an instruction to mute a tone that has already been instructed to generate is given; and instructing the sound source circuit to mute the tone in response to operation of a second operation member.

22. A machine readable media containing instructions for causing an apparatus to perform a method of generating musical tones, the method comprising:

storing performance data for a performance in a memory;

successively reading out the performance data from the memory with progression of the performance;

instructing, in response to operation of a first operation member, a sound source circuit to generate a tone based on the performance data being read out at a time of the operation of the first operation member and giving an instruction to mute a tone that has been previously generated; and instructing the sound source circuit to mute the tone in response to operation of a second operation member.

23. A machine readable media containing instructions for causing an apparatus to perform a method of generating musical tones, the method comprising:

storing first performance data and second performance data for a performance in a memory;

reading out the first performance data from the memory in response to operation of a first operation member and instructing a sound source circuit to generate a tone based on the first performance data, wherein at each operation of the first operation member a progression position of the performance is renewed;

successively reading out the second performance data from the memory and giving an instruction to the sound source circuit to generate a tone based on the second performance data; and selectively rendering effective one of the tone based on the first performance data read out and the tone based on the second performance data, wherein when the second operation member is operated while the tone based on the first performance data is rendered effective, the tone based on the second performance data is rendered effective instead of the tone based on the first performance data.

24. A machine readable media containing instructions for causing an apparatus to perform a method of generating musical tones, the method comprising:

storing performance data for a performance in a memory;

successively reading out the performance data from the memory with progression of the performance;

changing a pitch of the performance data read out in response to operation of a second operation member;

instructing, in response to operation of a first operation member, a sound source circuit to generate a tone based on the performance data read out at a time of the operation of the first operation member and having the changed pitch.

25. A machine readable media containing instructions for causing an apparatus to perform a method of generating musical tones, the method comprising:

storing performance data for a performance in a memory;

determining pitches for a scale matching at least one of a key of the performance data and a chord progression of the performance data and assigning the pitches of the scale to a plurality of operating sections of a first operation member; and instructing, in response to operation of a second operation member and one of the plurality of operating sections of the first operation member, a sound source circuit to generate one of the pitches assigned to the one of the plurality of operating sections of the first operation member.

26. A machine readable media containing instructions for causing an apparatus to perform a method of generating musical tones, the method comprising:

storing performance data for a performance;

determining a frequency of appearance of each note included in the performance data, determining a plurality of notes appearing at higher frequencies than other notes within a predetermined frequency range as scale notes for the performance and assigning the scale notes to a plurality of operating positions of a first operation member; and instructing, in response to operation of the second operation member and one of the plurality of operating positions of the first operation member, a sound source circuit to generate a tone based on one of the scale notes assigned to the one of the plurality of operating positions of the first operation member that is operated.

27. A machine readable media containing instructions for causing an apparatus to perform a method of generating musical tones, the method comprising:

determining a first operation member having a plurality of operating positions and a second operation member;

storing performance data for a performance in a memory;

successively reading out the performance data from the memory with progression of the performance;

detecting, in response to operation of the second operation member, a plurality of notes included in the performance data read out at a time of the operation of the second operation member, determining the detected plurality of notes as chord composing notes that form a chord and assigning the determined chord composing notes to the plurality of positions of the first operation member; and instructing, in response to operation of the second operation member and one of the plurality of operating positions of the first operation member, a sound source circuit to generate a tone based on one of the notes assigned to the one of the plurality of operating positions of the first operation member that is operated.

28. A machine readable media containing instructions for causing an apparatus to perform a method of generating musical tones, the method comprising:

determining a first operation member having a plurality of operating positions and a second operation member;

storing performance data for a performance in a memory;

successively reading out the performance data from the memory;

determining a frequency of appearance of each note included in the performance data and determining a plurality of notes appearing at higher frequencies within a predetermined range as scale composing notes forming a scale for the performance;

detecting, in response to operation of the second operation member, a plurality of notes included in the performance data read out at a time of operation of the second operation member, determining the detected plurality of notes as chord composing notes that form a chord and assigning the determined chord composing notes to the plurality of positions of the first operation member, wherein when the number of the detected plurality of notes does not reach a specified number appropriate notes are selected from the determined scale composing notes and added to the chord composing notes to reach the specified number; and instructing, in response to operation of the second operation member and one of the plurality of operating positions of the first operation member, a sound source circuit to generate a tone based on a note pitch assigned to the one of the plurality of operating positions of the first operation member that is operated.

* * * * *